US006800410B2

(12) United States Patent
Yasutomi et al.

(10) Patent No.: US 6,800,410 B2
(45) Date of Patent: Oct. 5, 2004

(54) IMAGE FORMING APPARATUS

(75) Inventors: Kei Yasutomi, Yokohama (JP); Yasuo Suzuki, Fuji (JP); Nozomu Tamoto, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 105 days.

(21) Appl. No.: 10/260,275

(22) Filed: Oct. 1, 2002

(65) Prior Publication Data

US 2003/0218665 A1 Nov. 27, 2003

(30) Foreign Application Priority Data

Oct. 2, 2001 (JP) ..... 2001-306801
Nov. 5, 2001 (JP) ..... 2001-340055

(51) Int. Cl.[7] ..... G03G 17/04; G03G 13/24; G03G 15/02

(52) U.S. Cl. ..... 430/35; 430/55; 430/58.05; 399/320

(58) Field of Search ..... 430/35, 55, 58.05; 399/320

(56) References Cited

U.S. PATENT DOCUMENTS

| | | | |
|---|---|---|---|
| 5,028,502 | A | 7/1991 | Yuh et al. |
| 5,100,453 | A | 3/1992 | Richards |
| 5,286,588 | A | 2/1994 | Suzuki |
| 5,561,016 | A | 10/1996 | Suzuki et al. |
| 5,578,405 | A | 11/1996 | Ikegami et al. |
| 5,665,500 | A | 9/1997 | Suzuki |
| 5,677,096 | A | 10/1997 | Suzuki |
| 5,789,128 | A | 8/1998 | Adachi et al. |
| 5,834,145 | A | 11/1998 | Yoshinaga et al. |
| 5,846,680 | A | 12/1998 | Adachi et al. |
| 5,910,561 | A | 6/1999 | Adachi et al. |
| 5,928,828 | A | 7/1999 | Suzuki |
| 5,942,363 | A | 8/1999 | Tanaka et al. |
| 5,999,773 | A | 12/1999 | Yasutomi et al. |
| 6,026,262 | A | 2/2000 | Kinoshita et al. |
| 6,030,736 | A | 2/2000 | Ikegami et al. |
| 6,069,224 | A | 5/2000 | Adachi et al. |
| 6,136,483 | A | 10/2000 | Suzuki et al. |
| 6,191,249 | B1 | 2/2001 | Tanaka et al. |
| 6,249,304 | B1 | 6/2001 | Sawayama et al. |
| 6,322,940 | B1 | 11/2001 | Nishigaki et al. |
| 6,326,112 | B1 | 12/2001 | Tamura et al. |
| 6,366,751 | B1 | 4/2002 | Shakuto et al. |
| 6,432,596 | B2 | 8/2002 | Ikuno et al. |
| 6,444,387 | B2 | 9/2002 | Ri et al. |
| 6,492,079 | B2 | 12/2002 | Shimada et al. |

FOREIGN PATENT DOCUMENTS

| | | |
|---|---|---|
| JP | 7-181705 | 7/1995 |
| JP | 8-62862 | 3/1996 |
| JP | 9-304954 | 11/1997 |
| JP | 9-319164 | 12/1997 |
| JP | 11-95462 | 4/1999 |

*Primary Examiner*—Mark A. Chapman
(74) *Attorney, Agent, or Firm*—Oblon, Spivak, McClelland, Maier & Neustadt, P.C.

(57) ABSTRACT

An image forming apparatus has at least a photoconductor, a charger, and an irradiator for irradiating a light for optically writing in on the photoconductor to form a latent electrostatic image using a process for electrophotography in which a resolution of the optical writing in operation is 1200 dpi or more. Further, the optical writing operation is performed using a laser beam having a diameter of 35 $\mu$m or less. The photoconductor is provided with at least a charge generating layer containing a charge generating substance and a charge transporting layer containing a charge transporting substance. The charge transporting layer has a carrier mobility of $1\times10^{-5}$ $cm^2\cdot V^{-1}\cdot sec^{-1}$ or more under an electric field of $3\times10^5$ $V\cdot cm^{-1}$.

48 Claims, 10 Drawing Sheets

IMAGE FORMING APPARATUS

BACKGROUND OF THE INVENTION

1. Field of the Invention

The present invention relates to an image forming apparatus using an electrophotographic process, such as an electrostatic copier or a laser printer. More particularly, the present invention relates to an image forming apparatus involving a so-called fixing step for fixing a toner image onto a recording sheet such as a paper.

2. Description of the Related Art

A conventional image forming apparatus of this type has a structure as shown in FIG. 1. An image forming apparatus shown in FIG. 1 has a photoconductive drum 1, charging means (charging unit) 2, exposing means 3, developing means 4, transferring means 5, cleaning means 7, and fixing means 8 to form an image on a recording sheet 6. A typical image forming process will be shown below.

(1) The charging means 2 charges a surface of the photoconductor 1 to a desired potential.

(2) The exposing means 3 exposes the photoconductor 1 to form a latent electrostatic image corresponding to a desired image on the photoconductor.

(3) The developing means 4 develops the latent electrostatic image formed by the exposing means 3 with a toner and thereby forms a toner image on the photoconductor 1.

(4) The transferring means 5 transfers the toner image from the photoconductor to the recording sheet 6 carried by carrying means not shown.

(5) The cleaning means 7 cleans, from the photoconductor, the toner remaining thereon without being transferred to the recording sheet 6.

(6) The recording sheet 6 is carried to the fixing means 8.

(7) The fixing means 8 heats the toner (recording sheet 6) to fix it onto the recording sheet.

The image forming apparatus forms a desired image on the recording sheet 6 by rotating the photoconductive drum in the direction indicated by the arrow in FIG. 1 and repeating the steps (1) to (7).

In general, the photoconductive drum 1 is formed by coating a photoconductor on a surface of a conductor. The mainstream of the photoconductor has been a so-called organic photoconductor. As the photoconductor, a multilayer type (multilayer organic photoconductor) composed of a so-called charge generating layer and a charge transporting layer stacked on a conductive base has been used in most cases because of the high durability of the charge transporting layer. There has also appeared a photoconductor having a protection layer in addition to the charge generating layer and the charge transporting layer, which is provided to enhance the durability of the charge transporting layer.

There has been known that, to provide such an image forming apparatus capable of image reproduction at even a spatial frequency at which a development field is high, the film thickness of a photoconductor should be reduced (thinned) (*Basic and Applied Electrophotographic Techniques*, pp.150–151, Corona Publishing Co., Ltd.).

However, a photoconductor small in film thickness is low in durability against cleaning-induced abrasion, flaws, or the like. If a charging step and an exposing step are performed repeatedly, the photoconductor small in film thickness deteriorates fast. Briefly, the durability of a photoconductor is reduced significantly if the film thickness thereof is reduced for the formation of a high-quality image. If the film thickness of the photoconductor is increased for the enhanced durability thereof, on the other hand, only a low-quality image is obtainable. To eliminate the tradeoff, it has been requested to satisfy the two requirements of enhanced durability of a photoconductor and high-quality image formation.

In a conventional multilayer organic photoconductor, polycarbonate has been used commonly as a binder resin in a charge transporting layer. In such a photoconductor, the film thickness of the charge transporting layer has normally been adjusted to a range of 20 $\mu$m to 30 $\mu$m. This indicates that a higher priority has been given to the high durability of the photoconductive than to image qualities.

SUMMARY OF THE INVENTION

When the present inventors formed an image at a resolution of 1200 dpi or more which had been known to be necessary for the discrimination of character images (font) by using an image forming apparatus having a multilayer photoconductor in which a charge transporting layer has a film thickness of 20 $\mu$m to 30 $\mu$m, the image forming apparatus could not reproduce an image at a so-called high spatial frequency such as a single isolated dot or a 1-dot line. This indicates that the conventional image forming apparatus cannot perform through outputting of input images such as so-called bit map images due to unsatisfactory reproduction of a single isolated dot or a 1-dot line. In other words, it is not until an input image has undergone complicated image processing steps that an image can be formed.

If the resolution is adjusted to 600 dpi or 400 dpi, a single isolated dot or a 1-dot line can be reproduced. However, since the single isolated dot or 1-dot line is increased in size, only a coarse image is formed. In an image including an oblique line, a reduction in resolution aggravates a so-called jaggy and degrades image qualities.

The present inventors also performed writing of image data processed with a halftoning operation using the number of lines of 200 lpi or more by using an image forming apparatus having a photoconductor including a charge transporting layer with a film thickness of about 20 $\mu$m to 30 $\mu$m. The resulting image was extremely low in tone. This proved that an image which needs tonic representation, such as a photographic image, could not be formed satisfactorily. This also proved that so-called banding was likely to occur and only an image with much noise was obtained.

When a halftoning operation was performed by using the number of lines less than 200 lpi, a sufficient tone was achieved. However, a dither texture was visually observed and a fine-texture image could not be obtained.

The present invention has been achieved in view of the aforementioned problems. It is therefore an object of the present invention to provide an image forming apparatus capable of providing a high-quality image by adjusting the diameter of a beam for forming a latent image which is applied to the photoconductor to 35 $\mu$m or less and combining a condition placed on the carrier mobility of the charge transporting layer of a photoconductor or a condition placed on the transmittance of a protection layer provided on the photoconductor with a condition placed on the film thicknesses of the protection layer and the charge transporting layer.

A first image forming apparatus according to the present invention is an image forming apparatus having at least: a photoconductor; charging means; and optical writing means for performing an optical write operation with respect to the photoconductor to form a latent electrostatic image thereon, the apparatus using an electrophotographic process in which a resolution of the optical write operation is 1200 dpi or more, the optical writing means performing the optical write operation by using a laser beam with a diameter of 35 $\mu$m or less, the photoconductor being provided with at least a charge generating layer containing a charge generating substance and a charge transporting layer containing a charge transporting substance, the charge transporting layer having a carrier mobility of $1\times10^{-5}$ $cm^2\cdot V^{-1}\cdot sec^{-1}$ or more under an electric field of $3\times10^5$ $V\cdot cm^{-1}$.

The image forming apparatus having such a structure is capable of reproducing an image at a high spatial frequency such as a single isolated dot or a 1-dot line and performing through outputting of bit map images or the like. Even in an image including an oblique line, therefore, a so-called jaggy does not occur. In character images also, various fonts can be discriminated.

A second image forming apparatus according to the present invention is an image forming apparatus having at least: a photoconductor; charging means; optical writing means for performing an optical write operation with respect to the photoconductor to form a latent electrostatic image thereon; and image processing means for performing a halftoning operation with respect to an input image, the apparatus using an electrophotographic process which allows the optical writing means to perform the optical write operation based on image data obtained by performing the halftoning operation using a number of lines 200 lpi or more with respect to the input image, the optical writing means performing the optical write operation by using a laser beam with a diameter of 35 $\mu$m or less, the photoconductor being provided with at least a charge generating layer containing a charge generating substance and a charge transporting layer containing a charge transporting substance, the charge transporting layer having a carrier mobility of $1\times10^{-5}$ $cm^2\cdot V^{-1}\cdot sec^{-1}$ or more under an electric field of $3\times10^5\cdot V\cdot cm^{-1}$.

In the image forming apparatus having such a structure, tone is improved so that even an image which needs tonal representation, such as a photographic image, is reproduced satisfactorily. As a result, it becomes extremely difficult to visually observe a dither texture which occurs with a smaller number of lines of 200 lpi or less. In addition, the occurrence of banding is minimized.

The present inventors found that, if at least one compound having a triarylamine structure is contained in the charge transporting layer, the charge transporting layer is allowed to have the aforementioned carrier mobility. This may be because, since a compound having a triarylamine structure has a high carrier mobility, it imparts the aforementioned property to the charge transporting layer.

It was also proved that at least compounds expressed by the following structural formulae (A-I) to (A-VI) as compounds each containing a triarylamine structure are excellent in miscibility with a binder resin contained in the charge transporting layer and capable of enhancing the resistance of the photoconductor to oxidizing gas and the optical stability thereof.

[Structural formula (A-I)]

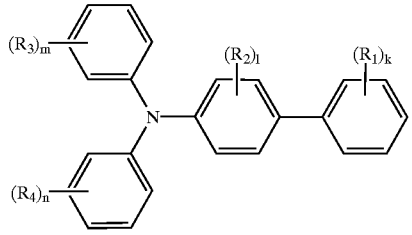

(where $R_1$, $R_3$, and $R_4$ may be the same or different and each independently represents a hydrogen atom, an amino group, an alkoxy group, a thioalkoxy group, an aryloxy group, a methylenedioxy group, a substituted or unsubstituted alkyl group, a halogen atom, or a substituted or unsubstituted aryl group; $R_2$ represents a hydrogen atom, an alkoxy group, a substituted or unsubstituted alkyl group or halogen, except for a combination in which each of $R_1$, $R_2$, $R_3$, and $R_4$ is a hydrogen atom; and k, l, m, and n are each independently 1, 2, 3, or 4).

Structural formula (A-II)

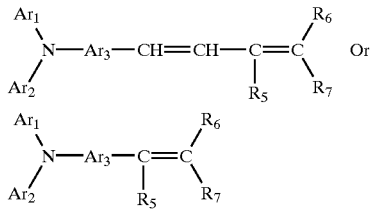

(where $Ar_1$ and $Ar_2$ may be the same or different and each independently represents a substituted or unsubstituted aryl group or a substituted or unsubstituted heterocyclic group; $R_6$, $R_7$, and $R_5$ may be the same or different and each independently represents a hydrogen atom, a substituted or unsubstituted alkyl group, a substituted or unsubstituted alkoxy group, a substituted or unsubstituted aryl group, or a substituted or unsubstituted heterocyclic group, of which $R_7$ and $R_6$ may be combined to form a ring; and $Ar_3$ represents a substituted or unsubstituted allylene group).

[Structural formula (A-III)]

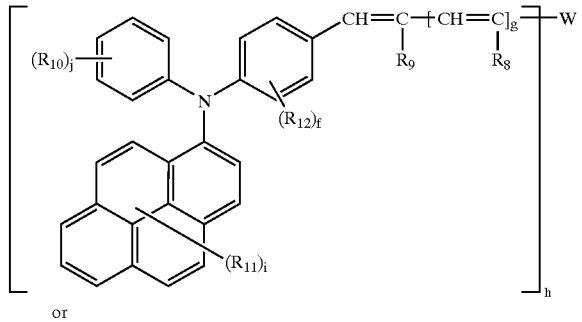

-continued

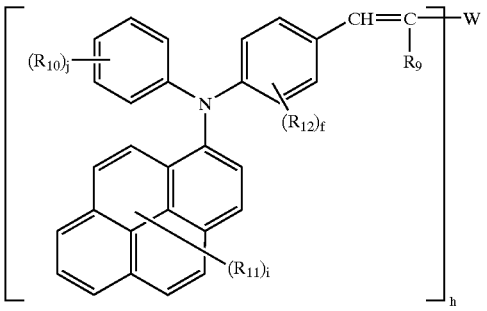

(where $R_{10}$, $R_{11}$, and $R_{12}$ may be the same or different and each independently represents a hydrogen atom, a halogen atom, a nitro group, a substituted or unsubstituted alkyl group, a substituted or unsubstituted alkoxy group, or a substituted or unsubstituted aryl group; $R_8$ and $R_9$ may be the same or different and each independently represents a hydrogen atom, an alkoxycarbonyl group, a substituted or unsubstituted alkyl group, or a substituted or unsubstituted aryl group; W represents a hydrogen atom, a substituted or unsubstituted alkyl group, a phenylthio group, a divalent chain unsaturated hydrocarbon group, a monovalent or divalent and substituted or unsubstituted carbocyclic aromatic group, or a monovalent or divalent and substituted or unsubstituted heterocyclic group; j represents an integer of 1 to 5; f represents an integer of 1 to 4; g represents an integer of 1 or 2; h represents an integer of 1 or 2; and i represents an integer of 1 to 3).

[Structural formula (A-IV)]

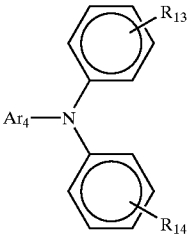

(where $Ar_4$ represents a condensed polycyclic hydrocarbon group having 18 or less carbon atoms; and $R_{13}$ and $R_{14}$ may be the same or different and each independently represents a hydrogen atom, a halogen atom, a substituted or unsubstituted alkyl group, an alkoxy group, or a substituted or unsubstituted phenyl group).

[Structural formula (A-V)]

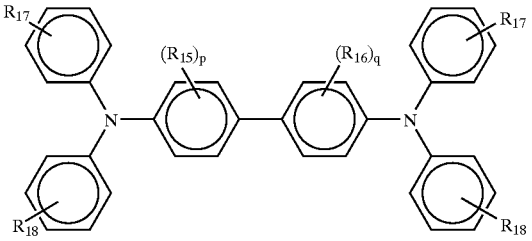

-continued

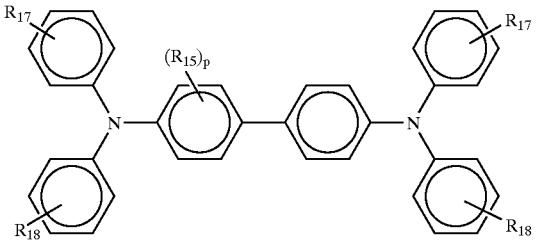

or

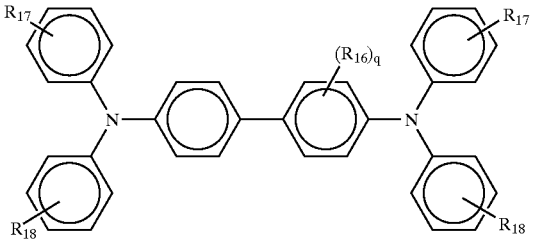

(where $R_{15}$ and $R_{16}$ may be the same or different and each independently represents a lower alkyl group, a lower alkoxy group, or a halogen atom; p and q each independently represents an integer of 1 to 4; and $R_{17}$ and $R_{18}$ may be the same or different and each independently represents a hydrogen atom, a lower alkyl group, a lower alkoxy group, or a halogen atom).

[Structural formula (A-VI)]

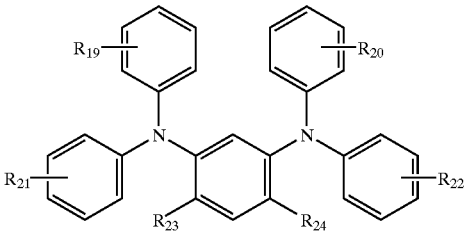

(where $R_{19}$, $R_{20}$, $R_{21}$, and $R_{22}$ may be the same or different and each independently represents a hydrogen atom, an alkyl group which may have a substituent, an alkoxy group, an allyl group, an aryl group, or a halogen atom; and $R_{23}$ and $R_{24}$ may be the same or different and each independently represents a hydrogen atom, an alkyl group, an alkoxy group, a halogen atom, an amino group, an N-substituted amino group, an allyl group, or an aryl group).

A content of the charge transporting substance in the charge transporting layer is adjusted appropriately to 40% by weight or more, preferably 50% by weight or more with respect to a total amount of the charge transporting layer. If the content of the charge transporting substance is increased, the carrier mobility of the charge transporting layer is increased. The present inventors found that, if the content of the charge transporting substance was adjusted to 40% by weight or more with respect to a total amount of the charge transporting layer, extremely excellent image qualities were obtained, while the temperature dependence was reduced and degradation of image qualities by environments (low-temperature/low-humidity or high-temperature/high-humidity environments) was reduced. The present inventors also found that, if the content of the charge transporting substance was adjusted to 50% by weight or more, the dependence of the carrier mobility on the intensity of an electric field was reduced.

In the photoconductor, a film thickness of the charge transporting layer is preferably 20 μm or less. It was found that, if the aforementioned structure was used, both high image qualities and the high durability of the photoconductor were achievable and, if the film thickness of the charge transporting layer (CT film thickness) was 20 μm or less, a sufficient durability was obtainable and an extremely high-quality image was obtainable. Since the CT film thickness is small, cost for manufacturing a photoconductive drum can be reduced and a coated film may be excellently uniform. If such a structure is used, the photoconductor is preferably provided with a protection layer for the high durability (for the prevention of a shorter life) of the photoconductive drum.

A third image forming apparatus according to the present invention is an image forming apparatus having: charging means; a photoconductor; and optical writing means to form an image at a resolution of at least 1200 dpi, the optical writing means emitting a laser beam with a diameter of 35 μm or less, the photoconductor having at least a charge generating layer containing a charge generating substance and a charge transporting layer containing a charge transporting substance which are provided on a conductive support, a protection layer being disposed closer to a surface of the photoconductor than the charge generating layer and the charge transporting layer to have a transmittance of 90% or more with respect to the laser beam, a total film thickness of the charge transporting layer and the protection layer being 20 μm or less.

A fourth image forming apparatus according to the present invention is an image forming apparatus having: image processing means for performing a halftoning operation with respect to an input image; charging means; a photoconductor; and optical writing means, the image processing means performing the halftoning operation with respect to at least the input image by using a number of lines of 200 lpi or more, the optical writing means emitting a laser beam with a diameter of 35 μm or less, the photoconductor having at least a charge generating layer containing a charge generating substance and a charge transporting layer containing a charge transporting substance which are provided on a conductive support, a protection layer being disposed closer to a surface of the photoconductor than the charge generating layer and the charge transporting layer to have a transmittance of 90% or more with respect to the laser beam, a total film thickness of the charge transporting layer and the protection layer being 20 μm or less.

Preferably, the protection layer contains a filler, a charge transporting substance, and/or a binder resin.

Preferably, the filler has a refractive index in a range of 1.0 to 2.0 in terms of providing a high transmittance and a satisfactory image.

Preferably, the filler is at least one of an inorganic pigment and a metal oxide.

Preferably, the protection layer is formed from a water dispersion containing an inorganic pigment and/or a metal oxide dispersed therein and a pH of the water dispersion is 5 or more in terms of a high electric insulating property and a lower probability of an image blur.

Preferably, the inorganic pigment and/or metal oxide is processed with a surface treatment using at least one surface treatment agent in terms of increasing dispersibility, reducing a residual potential at the photoconductor, increasing transparency, preventing a defect in the coat film, imparting wear-resistance, and preventing localized abrasion.

Preferably, the surface treatment agent is at least one of a titanate coupling agent, a higher fatty acid, and/or a metal salt of a higher fatty acid in terms of retaining an insulating property.

Preferably, the inorganic pigment and/or the metal oxide is processed with the surface treatment in an amount of 2 to 30% by weight in terms of achieving the effect of the addition of the filler without increasing the residual potential.

Preferably, the protection layer contains a binder resin containing a resin having an acid value of 10 to 400 (mgKOH/g).

Preferably, the protection layer contains, as a dispersing agent, an organic compound having at least one carboxyl group in a structure thereof and the dispersing agent is a polycarboxylic acid derivative.

Preferably, the dispersing agent is an organic compound having an acid value of 10 to 400 (mgKOH/g).

Preferably, the dispersing agent is added in an amount selected from a range satisfying the following expression:

$$0.1 \leqq (\text{Amount of Added Dispersing Agent} \times \text{Acid Value of Dispersing Agent})/(\text{Amount of Added Filler}) \leqq 20$$

Preferably, a maximum intensity of an electric field applied by the charging means to the charge transporting layer and to the protection layer is −30 V/μm.

DESCRIPTION OF THE PREFERRED EMBODIMENTS

Herein below, a detailed description will be given to the embodiments of an image forming apparatus according to the present invention.

Figure 1:
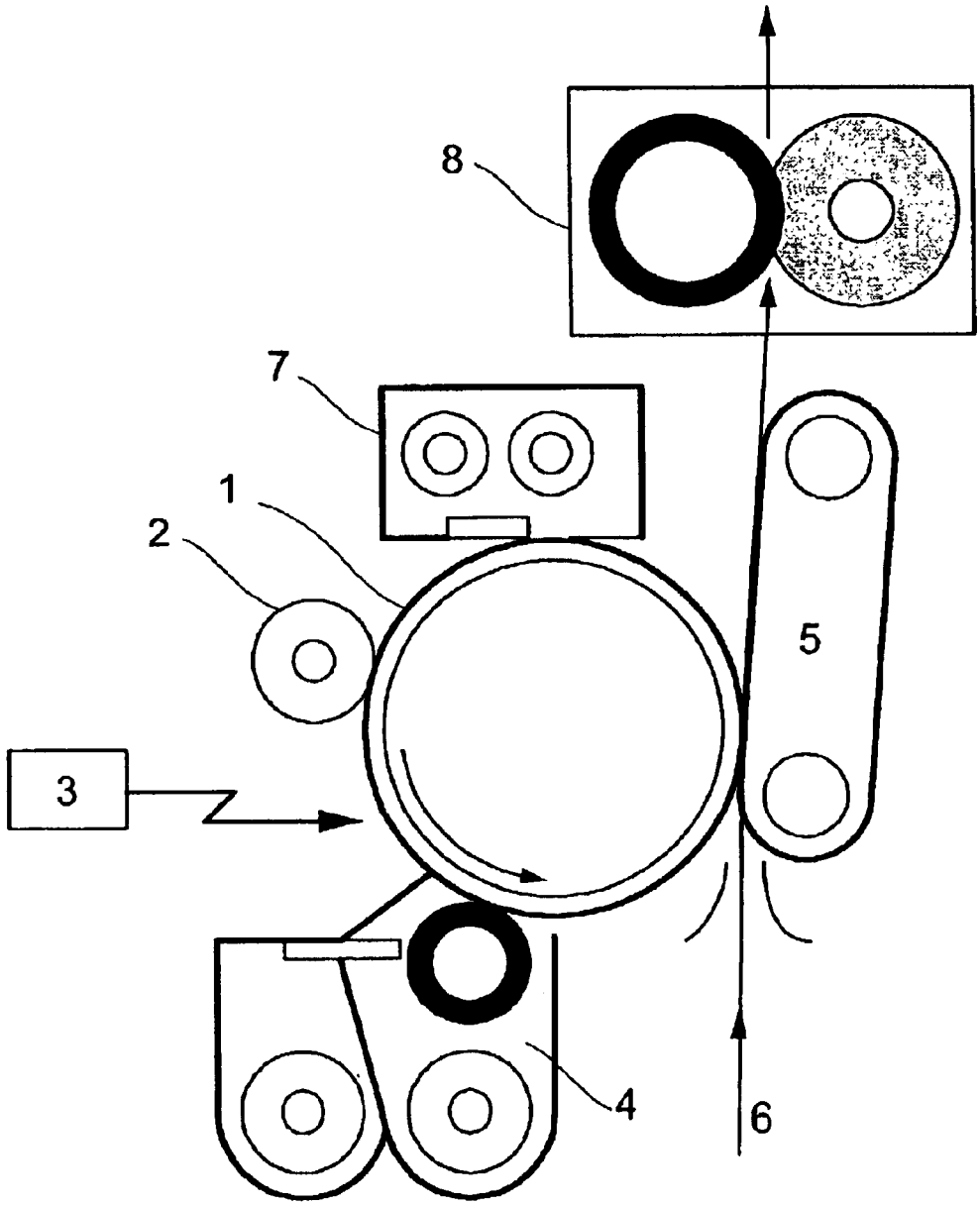
FIG. 1 is a schematic view showing an example of a structure of an image forming apparatus.

The image forming apparatus can use the same structure as used conventionally. Specifically, there can be used any of well-known structures of an electrophotographic image forming apparatus having at least a photoconductor, charging means, and optical writing means (exposing means) for performing an optical write operation with respect to the photoconductor to form a latent electrostatic image thereon. Accordingly, the structure shown in, FIG. 1 is also usable.

As the image forming apparatus, there is used an apparatus in which the resolution of the optical write operation is 1200 dpi or more and/or which is capable of forming an image from data obtained by performing a halftoning operation using the number of lines of 200 lpi or more with respect to an input image (or processed with the halftone operation).

Although each of image forming apparatus according to the first and second aspects of the present invention uses a structure/construction as described above, it is different from a conventional image forming apparatus in that:

(1) the beam emitted from the optical writing means has a diameter of 35 $\mu$m or less; and (2) a carrier mobility in the charge transporting layer of the photoconductor (electrophotographic photoconductor) is $1\times10^{-5}$ $cm^2\cdot V^{-1}$ $sec^{-1}$ or more under an electric field of $3\times10^5$ $V\cdot cm^{-1}$.

Thus, the image forming apparatus according to the present invention is an image forming apparatus obtained by combining the structure of a writing system satisfying the aforementioned conditions (the resolution of the write operation and the beam diameter) with the structure of the photoconductor satisfying the aforementioned condition (prescription for the charge transporting layer).

Although each of image forming apparatus according to the third and fourth aspects of the present invention uses a structure/construction as described above, it is different from a conventional image forming apparatus in that:

(1) the beam emitted from the optical writing means has a diameter of 35 $\mu$m or less; and (2) a protection layer having a transmittance of 90% or more with respect to the laser beam from the optical writing means is provided and a total film thickness of the charge transporting layer and the protection layer is 20 $\mu$m or less.

The beam diameter is defined herein as a diameter at a position where the intensity of the beam decreases to $1/e^2$ of a maximum value in a Gaussian distribution of light intensities. The beam diameter was measured using a Beam Scan Model 180-xy/11/5 HZ manufactured by PHONTON, Inc.

Referring to the drawings, the photoconductor will be described in detail.

(Photoconductor)

A photoconductor according to the present embodiment has a charge generating layer 35 and a charge transporting layer 37.

FIGS. 2, 3, 4, and 5 show examples of a layer structure of the photoconductor according to the present embodiment.

Figure 2:
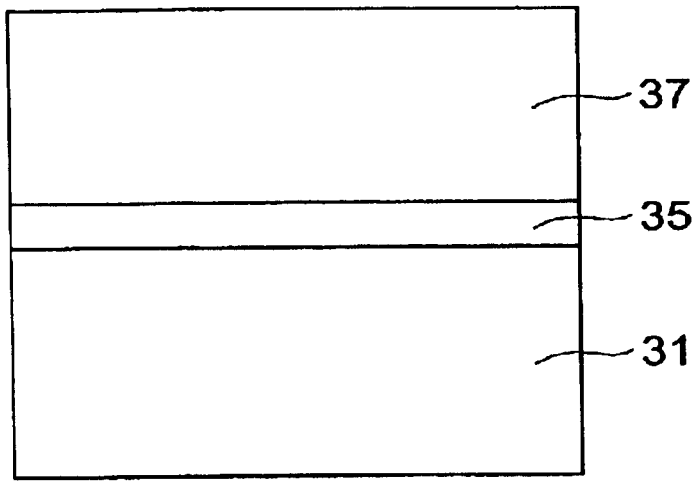
FIG. 2 is a view showing an example of a layer structure of a photoconductor according to the present invention.

The photoconductor shown in FIG. 2 has a multilayer structure composed of the charge generating layer 35 and the charge transporting layer 37 stacked successively on a conductive support 31.

Figure 3:
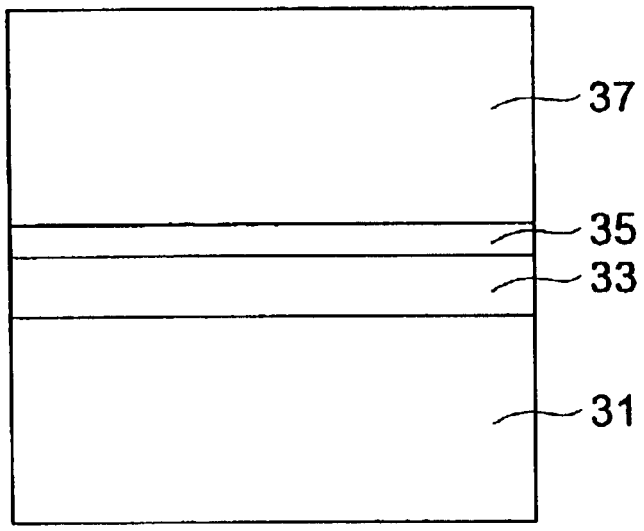
FIG. 3 is a view showing another example of the layer structure of the photoconductor according to the present invention.

The photoconductor shown in FIG. 3 has a structure obtained by providing an undercoat layer 33 between the conductive support 31 and the charge generating layer 35.

Figure 4:
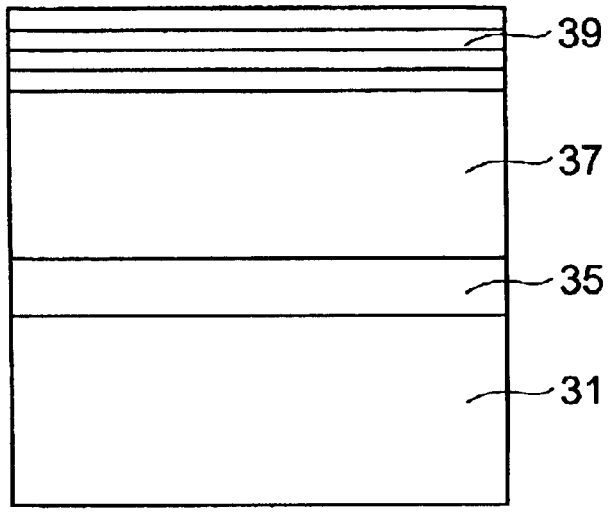
FIG. 4 is a view showing still another example of the layer structure of the photoconductor according to the present invention.
Figure 5:
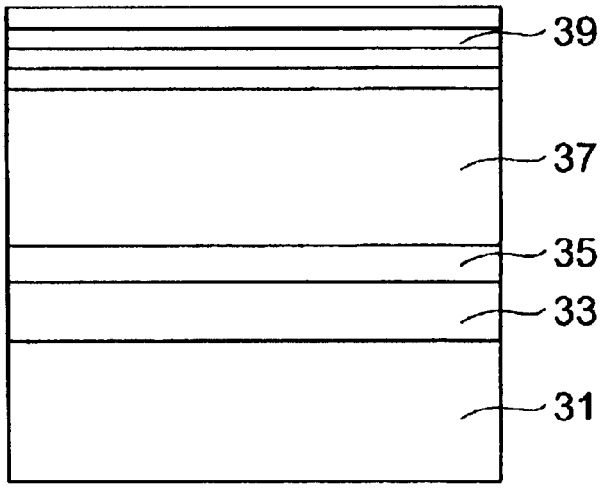
FIG. 5 is a view showing yet another example of the layer structure of the photoconductor according to the present invention.

The photoconductors shown in FIGS. 4 and 5 have structures obtained by further forming protection layers 39 on the respective charge transporting layers 37 of the photoconductors shown in FIGS. 2 and 3.

It is to be noted that the layer structures shown in FIGS. 2 to 5 are only exemplary of the layer structure of the photoconductor according to the present embodiment. If necessary, other structures may also be used as appropriate. For example, an intermediate layer may also be provided between photoconductive layers (the charge generating layer 35 and the charge transporting layer 37) and the protection layer 39. In the image forming apparatus according to the third and fourth embodiments, the protection layers are essential components.

(Conductive Support 31)

As the conductive support 31, any of well-known supports for photoconductors can be used but a support having a conductivity of $10^{10}$ $\Omega\cdot cm$ or less is used preferably. As such a support, there can be used: a support composed of a metal such as aluminum, nickel, chrome, nichrome, copper, gold, silver, or platinum or a metal oxide such as tin oxide or indium oxide which is covered with a film-like or cylindrical plastic or paper by vapor deposition or sputtering; a plate composed of aluminum, an aluminum alloy, nickel, or stainless steel; or a pipe obtained by forming such a plate into a primary tube by a technique such as extrusion or pultrusion and performing thereto a surface treatment such as cutting, super finishing, or polishing. It is also possible to use an endless nickel belt or an endless stainless-steel belt disclosed in Japanese Patent Application Laid-Open (JP-A) No. 52-36016 as the conductive support 31.

A base (support) to which a conductive powder dispersed in a proper binder resin has been applied may also be used as the conductive support 31.

Examples of the conductive powder include carbon black, acetylene black, powders of metals such as aluminum, nickel, iron, nichrome, copper, zinc, and silver, and powders of metal oxides such as conductive tin oxides and ITO. Conductive powders may be used either alone or in a mixture of two or more thereof.

Examples of the binder resin (binder resin for forming the conductive support) include thermoplastic resins, thermosetting resins, and photo-setting resins such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylate resins, phenoxy resins, polycarbonates, cellulose acetate resins, ethyl cellulose resins, polyvinyl butyral, polyvinyl formal, polyvinyl toluene, poly-N-vinylcarbazole, acrylic resins, silicone resins, epoxy resins, melamine resins, urethane resins, phenol resin, and alkyd resins. These resins may be used either alone or in a mixture of two or more thereof.

The conductive support 31 having a conductive layer provided on the base can be produced by dissolving or dispersing a conductive powder and a binder resin in an appropriate solvent or dispersion medium (such as tetrahydrofuran, dichloromethane, methyl ethyl ketone, or toluene) and coating the resulting solution or fluid dispersion on the base.

A proper base (preferably a cylindrical base) covered with a heat-shrinkable tube containing any of the aforementioned conductive powders may also be used as the conductive support 31.

For the thermo-shrinkable tube, there can be used, e.g., polyvinyl chloride, polypropylene, polyesters, polystyrene, polyvinylidene chloride, polyethylene, chlorinated rubber, or Teflon (Trademark).

If a resin that can be used for a thermo-shrinkable tube is impregnated with any of the aforementioned conductive powders and adhered to a proper base, the resulting structure can be used as the conductive support 31.

(Charge Generating Layer 35)

The charge generating layer 35 is a layer containing a charge generating substance as a main component. In general, the charge generating layer 35 is provided on the conductive support 31 or on the undercoat layer 33.

As the charge generating substance, any of well-known charge generating substances can be used. For example, any of well-known materials including a phthalocyanine pigment such as titanyl phthalocyanine, vanadyl phthalocyanine, copper phthalocyanine, hydroxygallium phthalocyanine, or organic phthalocyanine, an azo pigment such as a monoazo pigment, a disazo pigment, an asymmetric disazo pigment, or a trisazo pigment, a perylene pigment, a perinone pigment, an indigo pigment, a pyrrolopyrrole pigment, an anthraquinone pigment, a quinacridone pigment, a quinone condensed polycyclic compound, and a squarylium pigment can be used. These charge generating substances may be used either alone or in a mixture of two or more thereof.

The charge generating layer 35 is produced as follows:

(1) A charge generating substance is dissolved or dispersed in a proper solvent or dispersion medium together with a binder resin (binder resin for forming the charge generating layer 35), if necessary. Dissolution or dispersion is performed by using a ball mill, an attritor, a sand mill, or an ultrasonic wave; and (2) The solution or fluid dispersion (coating liquid) obtained in (1) is coated on a specified layer and dried.

As a method for coating the coating liquid, there can be adopted a method such as dip coating, spray coating, bead coating, nozzle coating, spinner coating, or ring coating.

The proper range of the film thickness of the charge generating layer 35 is about 0.01 to 5 $\mu$m, preferably 0.1 to 2 $\mu$m.

Examples of the binder resin for forming the charge generating layer 35 include polyamide, polyurethane, epoxy resins, polyketone, polycarbonates, silicone resins, acrylic resins, polyvinyl butyral, polyvinyl formal, polyvinyl ketone, polystyrene, polysulfone, poly-N-vinylcarbazole, polyacrylamide, polyvinyl benzal, polyesters, phenoxy resins, vinyl chloride-vinyl acetate copolymers, polyvinyl acetate, polyphenylene oxide, polyamide, polyvinyl pyridine, cellulose resins, casein, polyvinyl alcohol, and polyvinyl pyrolidone. These resins may be used either alone or in a combination of two or more thereof.

The amount of the binder resin is adjusted to a range from 0 parts by weight to 500 parts by weight, preferably from 10 parts by weight to 300 parts by weight relative to 100 parts by weight of charge generating substance. The binder resin may be added to a solvent or a dispersion medium either before or after the charge generating substance is dissolved or dispersed in the solvent or dispersion medium.

As examples of the solvent or dispersion medium for forming the charge generating layer 35, mention may be made of isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, and ligroine. In particular, ketone solvents, ester solvents, and ether solvents are used satisfactorily. They may be used either alone or in a combination of two or more thereof.

Although the charge generating layer 35 contains the charge generating substance, the solvent, and the binder resin as main components, another component (additive) may also be contained therein. Examples of the additive include any of well-known additives for the charge generating layer 35 including a sensitizing agent, a dispersing agent, a surface active agent, and silicone oil.

(Charge Transporting Layer 37)

The charge transporting layer 37 is a layer containing a charge transporting substance as a main component.

The charge transporting layer 37 is formed by dissolving or dispersing a binder resin in a proper solvent or a dispersion medium, coating the resulting solution or fluid dispersion on a specified layer, and drying it.

For the charge transporting layer 37, an additive such as a plasticizer, a leveling agent, an antioxidant, or a lubricant may be added as appropriate. As the additive, any of well-known additives for the charge transporting layer may be used.

The charge transporting substance can be subdivided into a hole transporting material and an electron transporting material.

Examples of the electron transporting material include chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno [1,2-b] thiophene-4-one, 1,3,7-trinitrodibenzothiophene-5,5-dioxide, and benzoquinone derivatives.

Examples of the hole transporting material include poly-N-vinylcarbazole and derivatives thereof, poly-$\gamma$-carbazole ethylglutamate and derivatives thereof, pyrene-formaldehyde condensation product and derivatives thereof, polyvinyl pyrene, polyvinyl phenanthrene, polysilane, oxazole derivatives, oxadiazole derivatives, imidazole derivatives, monoarylamine derivative, diarylamine derivatives, triarylamine derivatives, stilbene derivatives, $\alpha$-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bis-stilbene derivatives, enamine derivatives, and other well-known materials. These charge transporting substances may be either alone or in a mixture of two or more thereof. In the image forming apparatus according to each of the third and fourth aspects, these materials can be used as appropriate.

In each of the image forming apparatus according to the first and second aspects, a material imparting a carrier mobility of $1\times10^{-5}$ $cm^2\cdot V^{-1}\cdot sec^{-1}$ or more to the charge transporting layer 37 under an electric field of $3\times10^5$ $V\cdot cm^{-1}$ is used as the charge transporting substance. The carrier mobility was calculated by a time-of-flight method from a transition current waveform, an applied voltage, and the thickness of a measurement sample (charge transporting layer).

Subject matters to be solved by the present invention can be solved by regulating the carrier mobility of the charge transporting layer 37 as described above. The following is the assumed reason for this.

The multilayer organic photoconductor having at least the charge generating layer 35 and the charge transporting layer 37 on the conductive support 31 is provided such that the charge generating layer 35 is closer to the conductive support (base) 31 than the charge transporting layer 37. As a result, the principle problem (lateral diffusion of carriers) is encountered that carriers optically generated through the exposure of the charge generating layer 35 are diffused by an electric field generated within the photoconductor, while they are moving toward the surface of the photoconductor, so as to cause the deterioration of a latent image.

It may be considered that, in addition to the electric field generated within the photoconductor, a temporal factor also plays an important roll in the lateral diffusion of carriers. As the carrier mobility is lower, the time required by a carrier to reach the surface of the photoconductor is longer so that the carriers are presumably diffused extensively in a direction (lateral direction) other than a direction toward the surface.

In a photoconductor having properties as described above, by contrast, it may be considered that the influence of the lateral diffusion of carriers is reduced significantly.

This is because, if the charge transporting layer has a carrier mobility as described above, generated carriers reach the surface of the photoconductor at a sufficiently high speed so that the degree of lateral diffusion is assumedly reduced significantly.

The present inventors produced a photoconductor satisfying the aforementioned conditions and visually found that, even if the film thickness of the photoconductive layers was adjusted to such a value (30 $\mu$m or more) as to provide sufficient durability, a high-quality image was obtainable even when the resolution for an optical write operation was 1200 dpi or more provided that the charge transporting layer had the aforementioned properties and that the laser beam from the optical writing means had a diameter or 35 $\mu$m or less. In other words, the aforementioned problems (degradation of an image) observed in the conventional image forming apparatus could not visually be observed.

Likewise, it was visually found that a high-quality image was obtainable also from image data processed with a halftoning operation using the number of lines of 200 lpi or more.

As the charge transporting substance, such a material as to impart the aforementioned properties to the charge transporting layer 37 is selected from among well-known charge transporting substances. It was found that, as such a material, a compound having a triarylamine structure in which a potential relative to the carrier mobility of the compound is high may be used appropriately. It was also found that, of compounds containing triarylamine structures, those expressed by the structural formulae (A-I) to (A-VI) are used particularly preferably in terms of miscibility with the binder resin, resistance to oxidizing gas, optical stability, and the like. These charge transporting substances may be used either alone or in a mixture of two or more thereof.

The following is specific examples of the compounds expressed by the structural formulae (A-I) to (A-VI). It will easily be appreciated that the present invention is not limited thereto.

(Structural Formula (A-I): Aminobiphenyl Compound)

TABLE 1

| Compund No. | $R_1$ | $R_2$ | $R_3$ | $R_4$ |
|---|---|---|---|---|
| (I)-1 | H | H | 4-$C_6H_4CH_3$(P) | H |
| (I)-2 | H | H | 4-$CH_3$ | 4-$CH_3$ |
| (I)-3 | H | H | 3-$CH_3$ | 3-$CH_3$ |
| (I)-4 | H | H | 2-$CH_3$ | 2-$CH_3$ |
| (I)-5 | H | H | 4-$CH_3$ | H |
| (I)-6 | H | H | 4-$C_2H_5$ | 4-$C_2H_5$ |
| (I)-7 | H | H | 4-$C_2H_5$ | H |
| (I)-8 | H | H | 4-$OCH_3$ | 4-$OCH_3$ |

TABLE 2

| Compund No. | $R_1$ | $R_2$ | $R_3$ | $R_4$ |
|---|---|---|---|---|
| (I)-9 | H | H | 3-$OCH_3$ | 3-$OCH_3$ |
| (I)-10 | H | H | 2-$OCH_3$ | 2-$OCH_3$ |
| (I)-11 | H | H | 4-$OCH_3$ | H |
| (I)-12 | H | H | 4-$OCH_3$ | 4-$CH_3$ |
| (I)-13 | H | H | 4-$OC_2H_5$ | H |
| (I)-14 | H | H | 4-$iC_3H_7$ | 4-$iC_3H_7$ |
| (I)-15 | H | H | 4-$NEt_2$ | H |
| (I)-16 | H | H | 4-$C_2H_5$ | H |
| (I)-17 | H | H | 4-$C_2H_5$ | 4-$C_2H_5$ |
| (I)-18 | H | H | 4-$nC_3H_7$ | H |
| (I)-19 | H | H | 4-Cl | H |
| (I)-20 | 4-$CH_3$ | H | H | H |

TABLE 3

| Compund No. | $R_1$ | $R_2$ | $R_3$ | $R_4$ |
|---|---|---|---|---|
| (I)-21 | H | H | 4-$CH_3$ | 4-$CH_3$ |
| (I)-22 | H | H | 3-$CH_3$ | 3-$CH_3$ |
| (I)-23 | H | H | 2-$CH_3$ | 2-$CH_3$ |
| (I)-24 | H | H | 4-$CH_3$ | H |
| (I)-25 | H | H | 4-$C_2H_5$ | H |
| (I)-26 | H | H | 4-$C_2H_5$ | 4-$C_2H_5$ |
| (I)-27 | 4-$CH_3$ | H | 4-$OCH_3$ | 4-$OCH_3$ |
| (I)-28 | 4-$CH_3$ | H | 3-$OCH_3$ | 3-$OCH_3$ |
| (I)-29 | 4-$CH_3$ | H | 4-$OCH_3$ | H |
| (I)-30 | 4-$CH_3$ | H | 4-$OC_2H_5$ | H |
| (I)-31 | 4-$CH_3$ | H | 4-$NEt_2$ | H |
| (I)-31 | 4-$CH_3$ | H | 4-$C_2H_5$ | 4-$C_2H_5$ |

TABLE 4

| Compund No. | $R_1$ | $R_2$ | $R_3$ | $R_4$ |
|---|---|---|---|---|
| (I)-33 | 4-$CH_3$ | H | 4-$C_2H_5$ | H |
| (I)-34 | 4-$CH_3$ | H | 3-Cl | H |
| (I)-35 | 4-$C_2H_5$ | H | 4-$CH_3$ | 4-$CH_3$ |
| (I)-36 | 4-$C_2H_5$ | H | 4-$OCH_3$ | 4-$OCH_3$ |
| (I)-37 | 4-$C_2H_5$ | H | 3-$CH_3$ | H |
| (I)-38 | 4-$C_2H_5$ | H | 3-$CH_3$ | 3-$CH_3$ |
| (I)-39 | 3-$CH_3$ | H | 4-$CH_3$ | 4-$CH_3$ |
| (I)-40 | 3-$CH_3$ | H | 3-$CH_3$ | 3-$CH_3$ |
| (I)-41 | 3-$CH_3$ | H | 2-$CH_3$ | 2-$CH_3$ |
| (I)-42 | 3-$CH_3$ | H | H | H |
| (I)-43 | H | 3-$CH_3$ | 4-$CH_3$ | 4-$CH_3$ |
| (I)-44 | H | 3-$CH_3$ | 3-$CH_3$ | 3-$CH_3$ |

TABLE 5

| Compund No. | $R_1$ | $R_2$ | $R_3$ | $R_4$ |
|---|---|---|---|---|
| (I)-45 | H | 2-$CH_3$ | 4-$CH_3$ | 4-$CH_3$ |
| (I)-46 | 4-$C_2H_5$ | H | H | H |
| (I)-47 | 3-$CH_3$ | H | H | H |
| (I)-48 | 2-$CH_3$ | H | H | H |
| (I)-49 | 2-$CH_3$ | H | 4-$CH_3$ | 4-$CH_3$ |
| (I)-50 | 2-$CH_3$ | H | 3-$CH_3$ | 3-$CH_3$ |
| (I)-51 | H | H | 2,4-$(CH_3)_2$ | H |
| (I)-52 | H | H | 3,4-$(CH_3)_2$ | H |
| (I)-53 | H | H | 4-$C_6H_5$ | 4-$C_6H_5$ |
| (I)-54 | 4-$OCH_3$ | H | H | H |
| (I)-55 | 4-$OCH_3$ | H | 4-$CH_3$ | H |
| (I)-56 | 4-$OCH_3$ | H | 3-$CH_3$ | H |

TABLE 6

| Compund No. | $R_1$ | $R_2$ | $R_3$ | $R_4$ |
|---|---|---|---|---|
| (I)-57 | 4-$OCH_3$ | H | 4-$CH_3$ | 4-$CH_3$ |
| (I)-58 | 4-$OCH_3$ | H | 4-$OCH_3$ | 3-$CH_3$ |
| (I)-59 | 4-$OCH_3$ | H | 4-$OCH_3$ | H |
| (I)-60 | 4-$OCH_3$ | H | 4-$OCH_3$ | 4-$CH_3$ |
| (I)-61 | 4-$OC_6H_5$ | H | H | H |
| (I)-62 | 4-$OC_6H_5$ | H | 4-$CH_3$ | 4-$CH_3$ |
| (I)-63 | 4-$OC_6H_5$ | H | 3-$CH_3$ | 3-$CH_3$ |
| (I)-64 | 4-$OC_6H_5$ | H | 4-$CH_3$ | H |
| (I)-65 | 3-Cl | H | 4-$CH_3$ | 4-$CH_3$ |
| (I)-66 | 3-Cl | H | 4-$OCH_3$ | 4-$OCH_3$ |
| (I)-67 | 3-$OC_2H_5$ | H | H | H |
| (I)-68 | 3-$OC_2H_5$ | H | 4-$CH_3$ | 4-$CH_3$ |

TABLE 7

| Compund No. | $R_1$ | $R_2$ | $R_3$ | $R_4$ |
|---|---|---|---|---|
| (I)-69 | 3-$OC_2H_5$ | H | 3-$CH_3$ | 3-$CH_3$ |
| (I)-70 | H | H | 4-n$C_3H_7$ | H |
| (I)-71 | 4-n$C_3H_7$ | H | H | H |
| (I)-72 | 4-n$C_3H_7$ | H | 4-$CH_3$ | 4-$CH_3$ |
| (I)-73 | 4-$C_6H_5$ | H | 4-n$C_3H_7$ | 4-n$C_3H_7$ |
| (I)-74 | 4-$SCH_3$ | H | H | H |
| (I)-75 | 4-$SCH_3$ | H | 4-$CH_3$ | 4-$CH_3$ |
| (I)-76 | H | H | 4-$SCH_3$ | 4-$SCH_3$ |
| (I)-77 | H | H | 4-$SCH_3$ | H |
| (I)-78 | H | H | 4-t$C_4H_9$ | 4-t$C_4H_9$ |
| (I)-79 | H | H | 4-n$C_4H_9$ | 4-n$C_4H_9$ |
| (I)-80 | 4-$CH_2C_6H_5$ | H | H | H |

TABLE 8

| Compund No. | $R_1$ | $R_2$ | $R_3$ | $R_4$ |
|---|---|---|---|---|
| (I)-81 | 4-$CH_2C_6H_5$ | H | 4-$CH_3$ | 4-$CH_3$ |
| (I)-82 | 4-$CH_2C_6H_5$ | H | 4-$OCH_3$ | H |
| (I)-83 | 4-$CH_2C_6H_5$ | H | 3-$CH_3$ | 3-$CH_3$ |
| (I)-84 | 4-$CH_2C_6H_5$ | H | 2-$CH_3$ | 2-$CH_3$ |
| (I)-85 | 4-$CH_2C_6H_5$ | H | 4-$OCH_3$ | 4-$OCH_3$ |
| (I)-86 | 4-$CH_2C_6H_5$ | H | 3-$OCH_3$ | 3-$OCH_3$ |
| (I)-87 | 4-$CH_3$ | H | 4-$C_6H_4CH_3$(P) | H |
| (I)-88 | 4-$CH_3$ | H | 4-t$C_4H_9$ | 4-t$C_4H_9$ |
| (I)-89 | 4-$CH_3$ | H | 4-i$C_3H_7$ | 4-i$C_3H_7$ |
| (I)-90 | 4-$C_2H_5$ | H | 4-$C_6H_4CH_3$(P) | H |
| (I)-91 | 4-$C_2H_5$ | H | 4-t$C_4H_9$ | 4-t$C_4H_9$ |
| (I)-92 | 4-$C_2H_5$ | H | 4-i$C_3H_7$ | 4-i$C_3H_7$ |

TABLE 9

| Compund No. | $R_1$ | $R_2$ | $R_3$ | $R_4$ |
|---|---|---|---|---|
| (I)-93 | 4-$OCH_3$ | H | 4-$C_6H_4CH_3$(P) | H |
| (I)-94 | 4-$OCH_3$ | H | 4-t$C_4H_9$ | 4-t$C_4H_9$ |
| (I)-95 | 4-$OCH_3$ | H | 4-i$C_3H_7$ | 4-i$C_3H_7$ |
| (I)-96 | 4-t$C_4H_9$ | H | H | H |
| (I)-97 | 4-t$C_4H_9$ | H | 4-$CH_3$ | 4-$CH_3$ |
| (I)-98 | 4-t$C_4H_9$ | H | 3-$CH_3$ | 3-$CH_3$ |
| (I)-99 | 4-t$C_4H_9$ | H | 2-$CH_3$ | 2-$CH_3$ |
| (I)-100 | 4-t$C_4H_9$ | H | 4-$OCH_3$ | 4-$OCH_3$ |
| (I)-101 | 4-t$C_4H_9$ | H | 4-$OCH_3$ | H |
| (I)-102 | 4-t$C_4H_9$ | H | 4-t$C_4H_9$ | 4-t$C_4H_9$ |
| (I)-103 | 4-t$C_4H_9$ | H | 4-i$C_3H_7$ | 4-i$C_3H_7$ |
| (I)-104 | 4-t$C_4H_9$ | H | 4-$C_6H_4CH_3$(P) | H |

TABLE 10

| Compund No. | $R_1$ | $R_2$ | $R_3$ | $R_4$ |
|---|---|---|---|---|
| (I)-105 | 4-$OC_2H_5$ | H | 4-$CH_3$ | 4-$CH_3$ |
| (I)-106 | 4-$OC_2H_5$ | H | 3-$CH_3$ | 3-$CH_3$ |
| (I)-107 | 4-$OC_2H_5$ | H | 2-$CH_3$ | 2-$CH_3$ |
| (I)-108 | 4-$OC_2H_5$ | H | 4-$OCH_3$ | 4-$OCH_3$ |
| (I)-109 | 4-$OC_2H_5$ | H | 4-$OCH_3$ | H |
| (I)-110 | 4-$OC_2H_5$ | H | 4-t$C_4H_9$ | 4-t$C_4H_9$ |
| (I)-111 | 4-$OC_2H_5$ | H | 4-i$C_3H_7$ | 4-i$C_3H_7$ |
| (I)-112 | 4-$OC_2H_5$ | H | 4-$C_6H_4CH_3$(P) | H |
| (I)-113 | H | 3-$CH_3$ | 4-t$C_4H_9$ | 4-t$C_4H_9$ |
| (I)-114 | H | 3-$CH_3$ | 4-$C_6H_4CH_3$(P) | H |
| (I)-115 | H | 3-$OCH_3$ | 4-$CH_3$ | 4-$CH_3$ |
| (I)-116 | H | 3-$OCH_3$ | 3-$CH_3$ | 3-$CH_3$ |

TABLE 11

| Compund No. | $R_1$ | $R_2$ | $R_3$ | $R_4$ |
|---|---|---|---|---|
| (I)-117 | H | 3-$OCH_3$ | 4-$OCH_3$ | 4-$OCH_3$ |
| (I)-118 | H | 3-$OCH_3$ | 4-t$C_4H_9$ | 4-t$C_4H_9$ |
| (I)-119 | H | 3-$OCH_3$ | 4-$C_6H_4CH_3$(P) | H |
| (I)-120 | 4-$NH_2$ | H | 4-$CH_3$ | 4-$CH_3$ |
| (I)-121 | 3-$CH_3$ | 3-$CH_3$ | 4-$CH_3$ | 4-$CH_3$ |
| (I)-122 | 3-$CH_3$ | 3-$CH_3$ | 3-$CH_3$ | 3-$CH_3$ |
| (I)-123 | 3-$CH_3$ | 3-$CH_3$ | 2-$CH_3$ | 2-$CH_3$ |
| (I)-124 | 3-$CH_3$ | 3-$CH_3$ | 4-$OCH_3$ | 4-$OCH_3$ |
| (I)-125 | H | 3-$CH_3$ | 4-$OCH_3$ | 4-$OCH_3$ |

The following is specific examples of the aminobiphenyl compound expressed by the structural formula (A-I) where $R_1$ and $R_2$ are combined to form a ring.

(I)-126

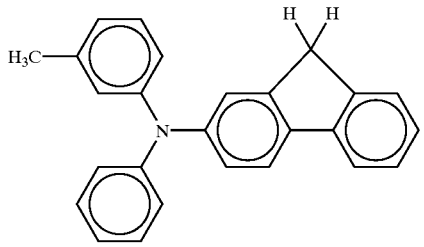

(I)-127

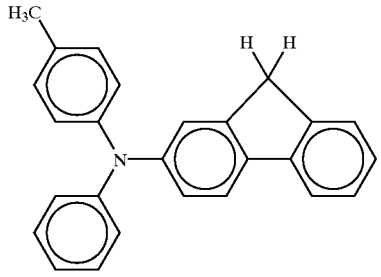

-continued
(I)-128
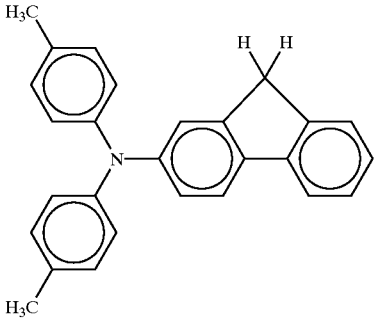
(I)-129
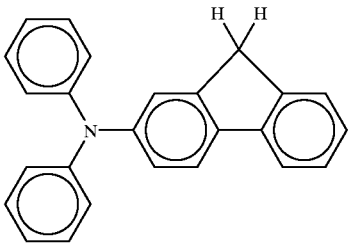
(I)-130
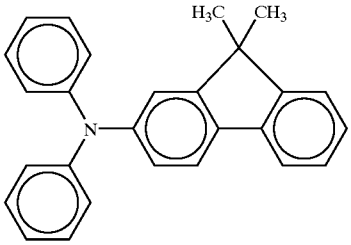
-continued
(I)-131
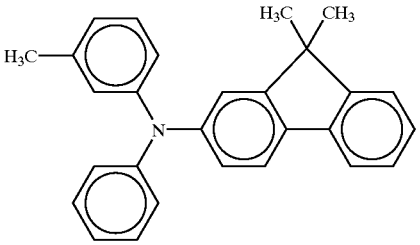
(I)-132
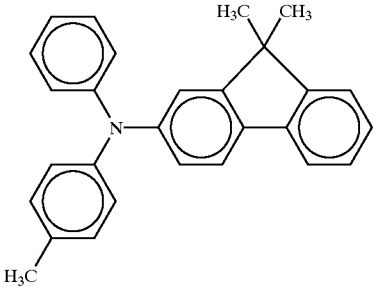
(I)-133
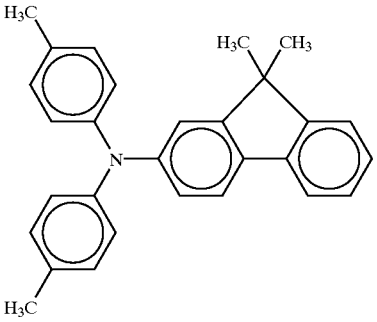
(Structural Formula (A-II): Stilbene CTM)
TABLE 12
| Specific Ex. No. | $Ar_1$ | $Ar_2$ | $Ar_3$ | $R_5$ | $R_6$ | $R_7$ |
|---|---|---|---|---|---|---|
| 1 | 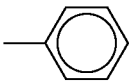 | 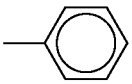 | 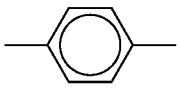 | —H | —H | 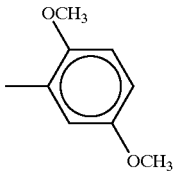 |
| 2 | 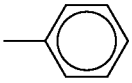 | 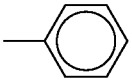 | 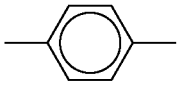 | —H | —H | 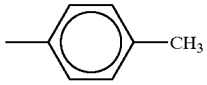 |

TABLE 12-continued

| Specific Ex. No. | $Ar_1$ | $Ar_2$ | $Ar_3$ | $R_5$ | $R_6$ | $R_7$ |
|---|---|---|---|---|---|---|
| 3 | | | | —H | —H | $OCH_3$ |
| 4 | | | | —H | —H | $N(C_2H_5)_2$ |
| 5 | | | | —H | | |
| 6 | $CH_3$ | $CH_3$ | | —H | | |
| 7 | $C_2H_5$ | $C_2H_5$ | | —H | | |
| 8 | $C_3H_7(n)$ | $C_3H_7(n)$ | | —H | | |
| 9 | $C_4H_9(t)$ | $C_4H_9(t)$ | | —H | | |
| 10 | $CH_3$ | | | —H | | |
| 11 | $C_2H_5$ | | | —H | | |
| 12 | $CH_3$ | $CH_3$ | | —H | | |

TABLE 13

| Specific Ex. No. | $Ar_1$ | $Ar_2$ | $Ar_3$ | $R_5$ | $R_6$ | $R_7$ |
|---|---|---|---|---|---|---|
| 13 | $CH_3$ | $CH_3$ | | —H | | |
| 14 | $CH_3$ | | | —H | | |

TABLE 13-continued

| Specific Ex. No. | $Ar_1$ | $Ar_2$ | $Ar_3$ | $R_5$ | $R_6$ | $R_7$ |
|---|---|---|---|---|---|---|
| 15 | —$OCH_3$ | —$OCH_3$ | | —H | | |
| 16 | $OCH_3$ | $OCH_3$ | | —H | | |
| 17 | $OCH_3$ | $OCH_3$ | | —H | | |
| 18 | —$OCH_3$ | | | —H | | |
| 19 | —$OC_2H_5$ | | | —H | | |
| 20 | —$CH_3$ | —$OCH_3$ | | —H | | |
| 21 | —$CH_3$ | Cl | | —H | | |
| 22 | —Cl | —Cl | | —H | | |
| 23 | —$N(CH_3)_2$ | —$N(CH_3)_2$ | | —H | | |

TABLE 14

| Specific Ex. No. | $Ar_1$ | $Ar_2$ | $Ar_3$ | $R_5$ | $R_6$ | $R_7$ |
|---|---|---|---|---|---|---|
| 24 | —$N(C_2H_5)_2$ | —$N(C_2H_5)_2$ | | —H | | |
| 25 | —$N(CH_3)_2$ | | | —H | | |
| 26 | —$N(C_2H_5)_2$ | | | —H | | |
| 27 | | | | —H | —H | —$CH_3$ |

TABLE 14-continued

| Specific Ex. No. | $Ar_1$ | $Ar_2$ | $Ar_3$ | $R_5$ | $R_6$ | $R_7$ |
|---|---|---|---|---|---|---|
| 28 | —$C_6H_4$—$OCH_3$ | —$C_6H_4$— | —$C_6H_4$— | —H | —H | —$C_6H_4$— |
| 29 | —$C_6H_4$—$OCH_3$ | —$C_6H_4$— | —$C_6H_4$— | —H | —H | —$C_6H_4$—$OCH_3$ |
| 30 | —$C_6H_4$—$OCH_3$ | —$C_6H_4$— | —$C_6H_4$— | —H | —H | —$C_6H_4$—$CH_3$ |
| 31 | —$C_6H_4$—$OCH_3$ (ortho) | —$C_6H_4$— | —$C_6H_4$— | —H | —$C_6H_2(CH_3)_3$ (2,4,6-trimethyl) | —$C_6H_4$— |
| 32 | —$C_6H_4$— | —$C_6H_4$— | —$C_6H_4$— | —H | —H | —$C_6H_4$—N—$(C_6H_4)_2$ |
| 33 | —$C_6H_4$— | —$C_6H_4$— | —$C_6H_4$— | —H | —H | —$C_6H_4$—$CH_3$ |
| 34 | —$C_6H_4$—$CH_3$ | —$C_6H_4$—$CH_3$ | —$C_6H_4$— | —H | —H | —$C_6H_4$— |
| 35 | —$C_6H_4$—$CH_3$ | —$C_6H_4$—$CH_3$ | —$C_6H_4$— | —H | —H | —$C_6H_4$—$CH_3$ |

TABLE 15

| Specific Ex. No. | $Ar_1$ | $Ar_2$ | $Ar_3$ | $R_5$ | $R_6$ | $R_7$ |
|---|---|---|---|---|---|---|
| 36 | —$C_6H_4$—$CH_3$ | —$C_6H_4$—$CH_3$ | —$C_6H_4$— | —H | —H | —$C_6H_4$—$OCH_3$ |
| 37 | —$C_6H_4$—$CH_3$ | —$C_6H_4$—$CH_3$ | —$C_6H_4$—Cl | —H | —H | —$C_6H_4$— |
| 38 | —$C_6H_4$—$CH_3$ | —$C_6H_4$—$CH_3$ | —$C_6H_4$—$N(C_2H_5)_2$ | —H | —H | —$C_6H_4$—$CH_3$ |
| 39 | —$C_6H_4$—$OCH_3$ | —$C_6H_4$—$OCH_3$ | —$C_6H_4$— | —H | —H | —$C_6H_4$— |
| 40 | —$C_6H_4$—$OCH_3$ | —$C_6H_4$—$OCH_3$ | —$C_6H_4$— | —H | —H | —$C_6H_4$—$CH_3$ |

TABLE 15-continued
| Specific Ex. No. | $Ar_1$ | $Ar_2$ | $Ar_3$ | $R_5$ | $R_6$ | $R_7$ |
|---|---|---|---|---|---|---|
| 41 | 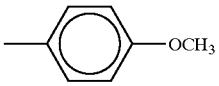 | 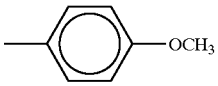 | 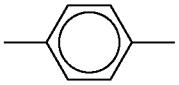 | —H | —H | 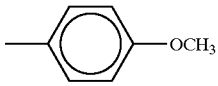 |
| 42 | 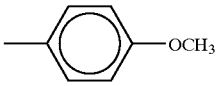 | 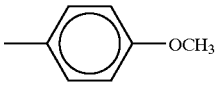 | 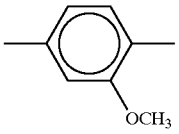 | —H | —H | 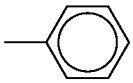 |
| 43 | 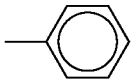 | 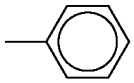 | 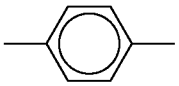 | —H | —H | 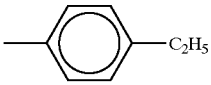 |
| 44 | 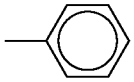 | 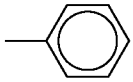 | 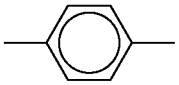 | —H | —H | 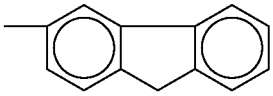 |
| 45 | 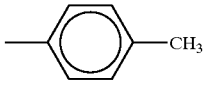 | 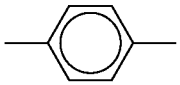 | 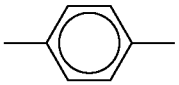 | —H | —H | 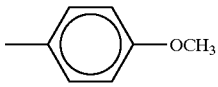 |
| 46 | 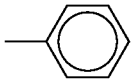 | 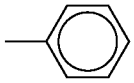 | 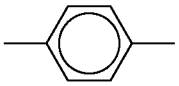 | —H | —H | 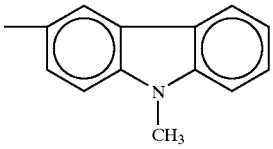 |
TABLE 16
| Specific Ex. No. | $Ar_1$ | $Ar_2$ | $Ar_3$ | $R_5$ | $R_6$ | $R_7$ |
|---|---|---|---|---|---|---|
| 47 | 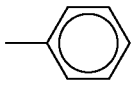 | 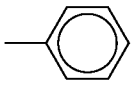 | 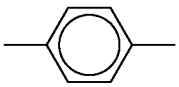 | —H | —H | 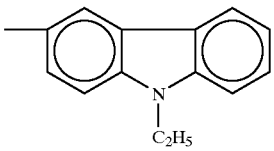 |
| 48 | 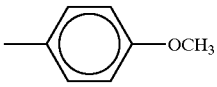 | 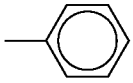 | 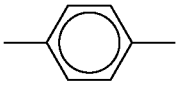 | —H | —H | 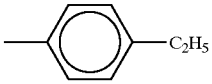 |
| 49 | 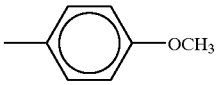 | 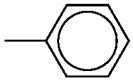 | 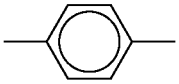 | —H | —H | 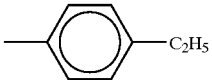 |
| 50 | 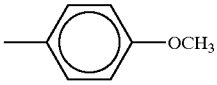 | 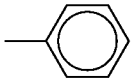 | 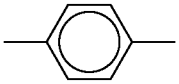 | —H | —H | 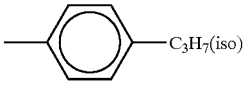 |
| 51 | 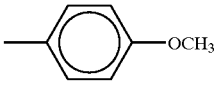 | 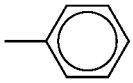 | 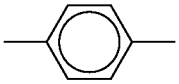 | —H | —H | 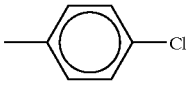 |

TABLE 16-continued
| Specific Ex. No. | $Ar_1$ | $Ar_2$ | $Ar_3$ | $R_5$ | $R_6$ | $R_7$ |
|---|---|---|---|---|---|---|
| 52 | 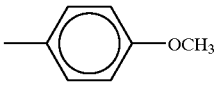 | 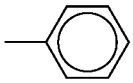 | 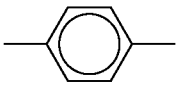 | —H | —H | 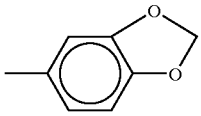 |
| 53 | 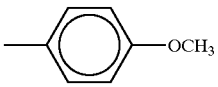 | 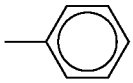 | 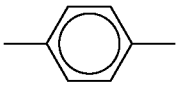 | —H | —H | 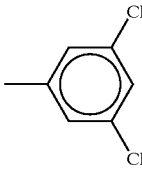 |
| 54 | 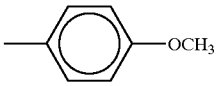 | 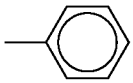 | 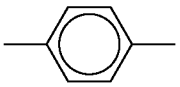 | —H | —H | 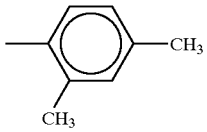 |
TABLE 17
| Specific Ex. No. | $Ar_1$ | $Ar_2$ | $Ar_3$ | $R_5$ | $R_6$ | $R_7$ |
|---|---|---|---|---|---|---|
| 55 | 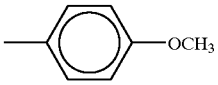 | 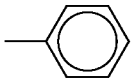 | 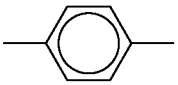 | —H | —H | 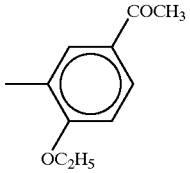 |
| 56 | 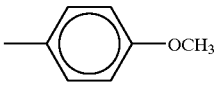 | 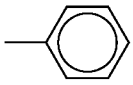 | 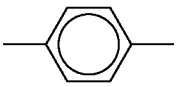 | —H | —H | 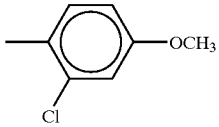 |
| 57 | 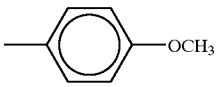 | 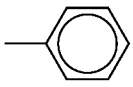 | 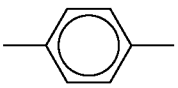 | —H | —H | 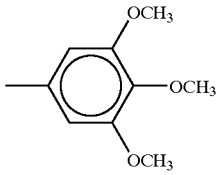 |
| 58 | 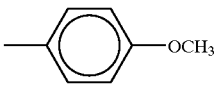 | 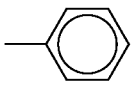 | 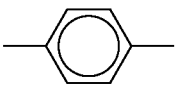 | —H | —H | 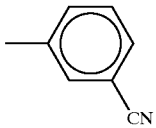 |
| 59 | 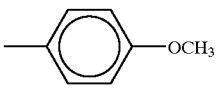 | 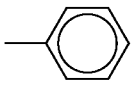 | 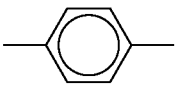 | —H | —H | 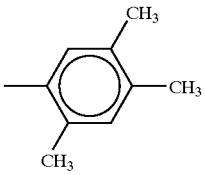 |
| 60 | 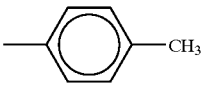 | 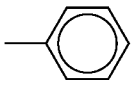 | 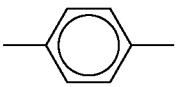 | —H | —H | 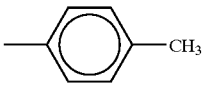 |

TABLE 17-continued
| Specific Ex. No. | $Ar_1$ | $Ar_2$ | $Ar_3$ | $R_5$ | $R_6$ | $R_7$ |
|---|---|---|---|---|---|---|
| 61 | 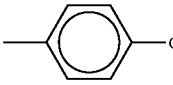 | 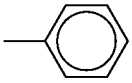 | 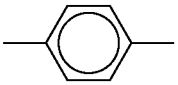 | —H | —H | 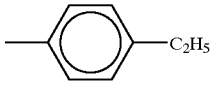 |
| 62 | 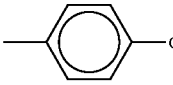 | 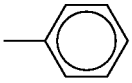 | 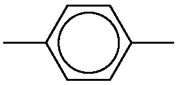 | —H | —H | 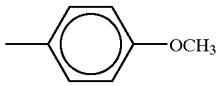 |
| 63 | 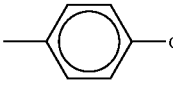 | 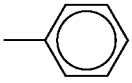 | 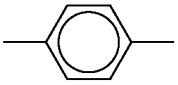 | —H | —H | 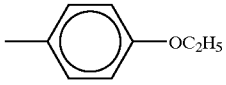 |
| 64 | 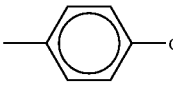 | 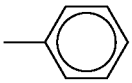 | 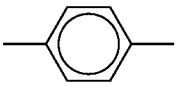 | —H | —H | 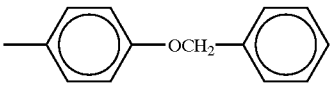 |
TABLE 18
| Specific Ex. No. | $Ar_1$ | $Ar_2$ | $Ar_3$ | $R_5$ | $R_6$ | $R_7$ |
|---|---|---|---|---|---|---|
| 65 | 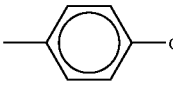 | 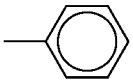 | 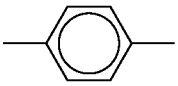 | —H | —H | 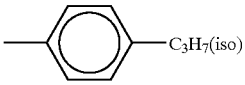 |
| 66 | 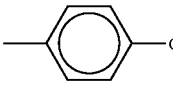 | 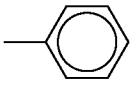 | 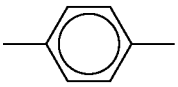 | —H | —H | 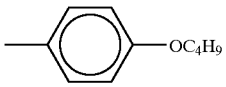 |
| 67 | 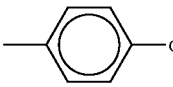 | 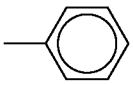 | 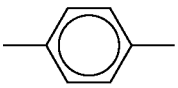 | —H | —H | 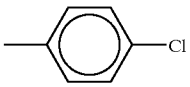 |
| 68 | 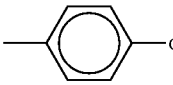 | 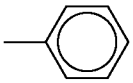 | 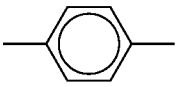 | —H | —H | 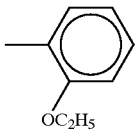 |
| 69 | 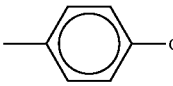 | 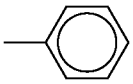 | 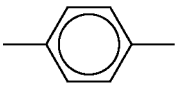 | —H | —H | 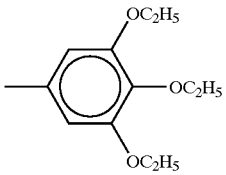 |
| 70 | 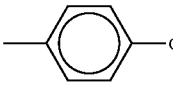 | 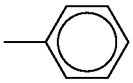 | 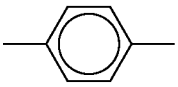 | —H | —H | 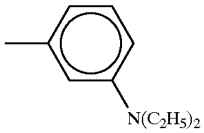 |
| 71 | 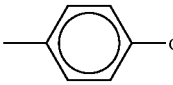 | 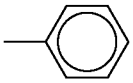 | 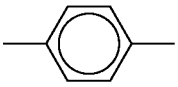 | —H | —H | 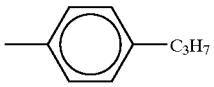 |

TABLE 18-continued
| Specific Ex. No. | $Ar_1$ | $Ar_2$ | $Ar_3$ | $R_5$ | $R_6$ | $R_7$ |
|---|---|---|---|---|---|---|
| 72 | 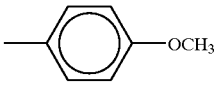 | 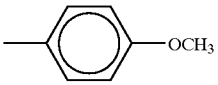 | 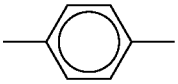 | —H | —H | 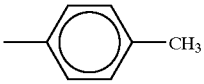 |
| 73 | 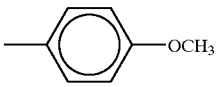 | 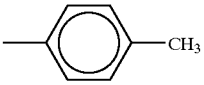 | 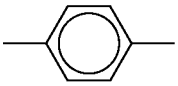 | —H | —H | 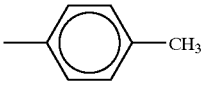 |
| 74 | 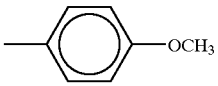 | 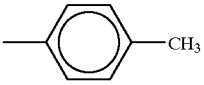 | 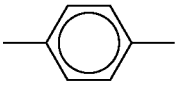 | —H | —H | 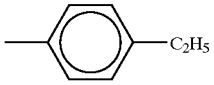 |
| 75 | 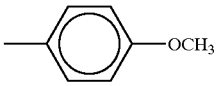 | 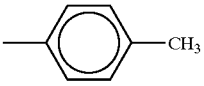 | 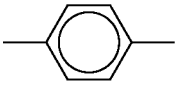 | —H | —H | 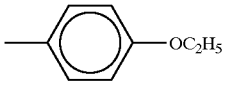 |
TABLE 19
| Specific Ex. No. | $Ar_1$ | $Ar_2$ | $Ar_3$ | $R_5$ | $R_6$ | $R_7$ |
|---|---|---|---|---|---|---|
| 76 | 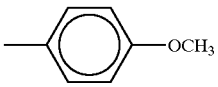 | 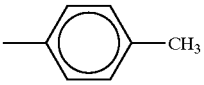 | 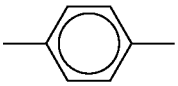 | —H | —H | 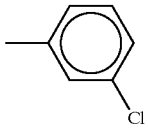 |
| 77 | 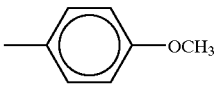 | 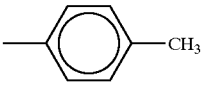 | 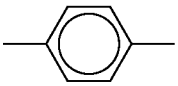 | —H | —H | 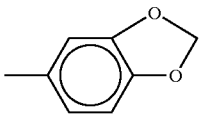 |
| 78 | 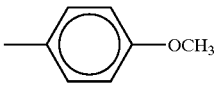 | 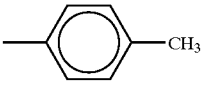 | 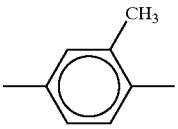 | —H | —H | 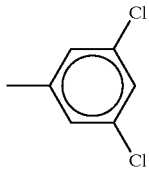 |
| 79 | 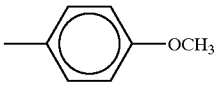 | 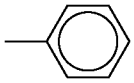 | 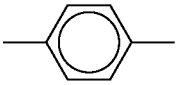 | —H | —H | 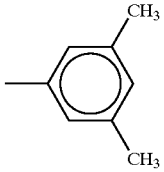 |
| 80 | 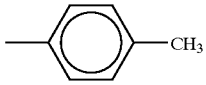 | 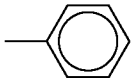 | 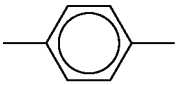 | —H | —H | 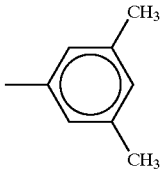 |

TABLE 19-continued
| Specific Ex. No. | $Ar_1$ | $Ar_2$ | $Ar_3$ | $R_5$ | $R_6$ | $R_7$ |
|---|---|---|---|---|---|---|
| 81 | 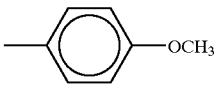 | 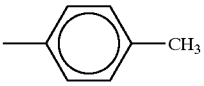 | 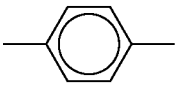 | —H | —H | 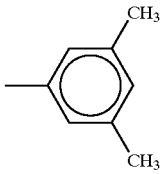 |
| 82 | 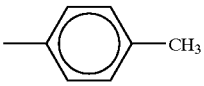 | 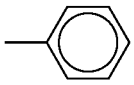 | 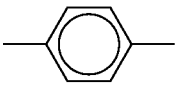 | —H | —H | 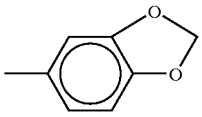 |
| 83 | 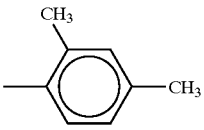 | 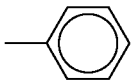 | 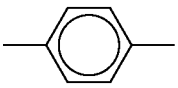 | $—CH_3$ | —H | 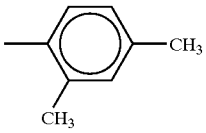 |
| 84 | 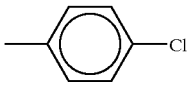 | 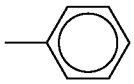 | 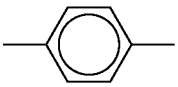 | $—CH_3$ | —H | 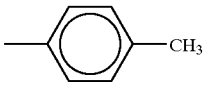 |
| 85 | 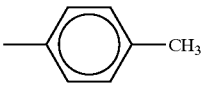 | 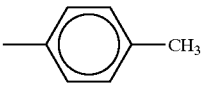 | 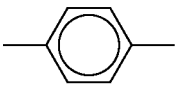 | —H | $—CH_3$ | 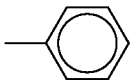 |
| 86 | 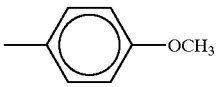 | 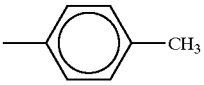 | 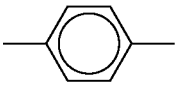 | —H | $—CH_3$ | 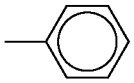 |
TABLE 20
| Specific Ex. No. | $Ar_1$ | $Ar_2$ | $Ar_3$ | $R_5$ | $R_6$ | $R_7$ |
|---|---|---|---|---|---|---|
| 87 | 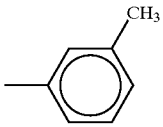 | 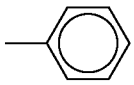 | 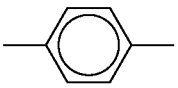 | —H | 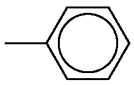 | 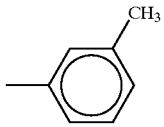 |
| 88 | 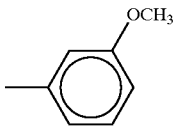 | 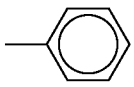 | 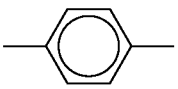 | —H | 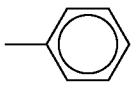 | 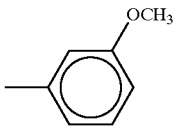 |
| 89 | 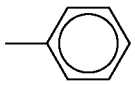 | 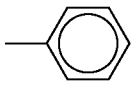 | 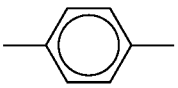 | —H | 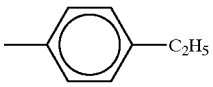 | 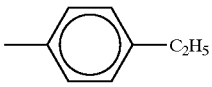 |
| 90 | 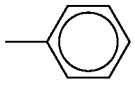 | 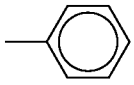 | 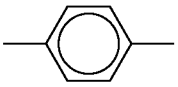 | —H | —H | 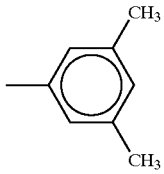 |

TABLE 20-continued
| Specific Ex. No. | $Ar_1$ | $Ar_2$ | $Ar_3$ | $R_5$ | $R_6$ | $R_7$ |
|---|---|---|---|---|---|---|
| 91 | 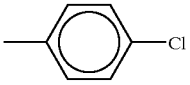 | 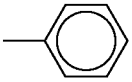 | 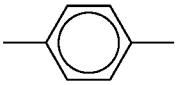 | —H | —H | 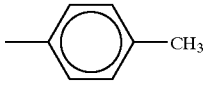 |
| 92 | 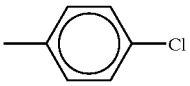 | 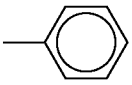 | 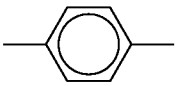 | —H | 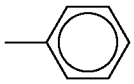 | 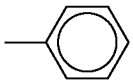 |
| 93 | 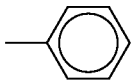 | 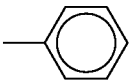 | 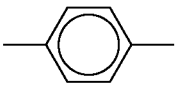 | —H | 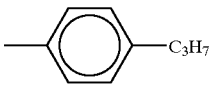 | 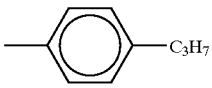 |
| 94 | 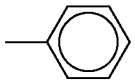 | 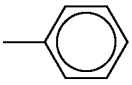 | 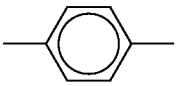 | —H | —H | 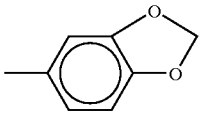 |
| 95 | 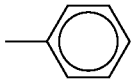 | 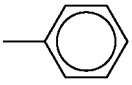 | 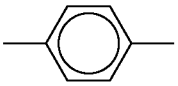 | —H | 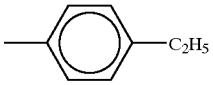 | 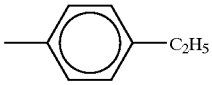 |
| 96 | 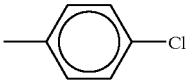 | 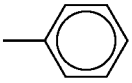 | 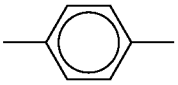 | —H | —H | 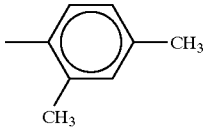 |
| 97 | 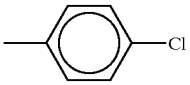 | 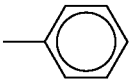 | 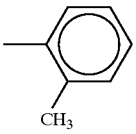 | —H | 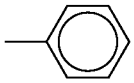 | 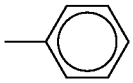 |
TABLE 21
| Specific Ex. No. | $Ar_1$ | $Ar_2$ | $Ar_3$ | $R_5$ | $R_6$ | $R_7$ |
|---|---|---|---|---|---|---|
| 98 | 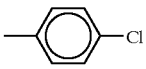 | 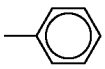 | 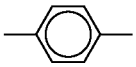 | —H | —H | 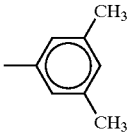 |
| 99 | 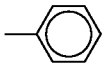 | 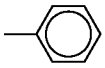 | 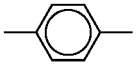 | —H | —H | 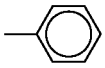 |
| 100 | 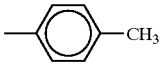 | 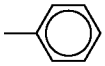 | 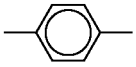 | —H | —H | 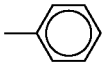 |
| 101 | 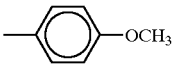 | 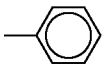 | 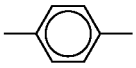 | —H | 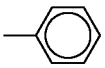 | 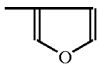 |
| 102 | 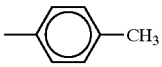 | 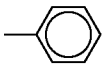 | 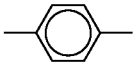 | —H | —H | 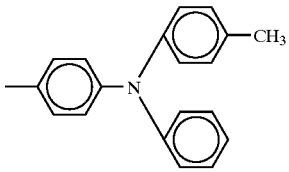 |

TABLE 21-continued
| Specific Ex. No. | $Ar_1$ | $Ar_2$ | $Ar_3$ | $R_5$ | $R_6$ | $R_7$ |
|---|---|---|---|---|---|---|
| 103 | 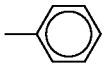 | 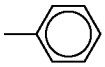 | 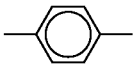 | —H | 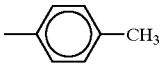 | 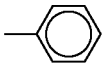 |
| 104 | 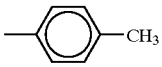 | 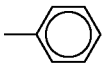 | 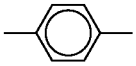 | —H | 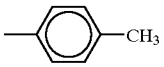 | 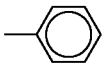 |
| 105 | 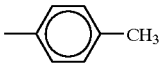 | 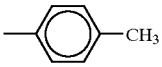 | 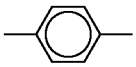 | —H | 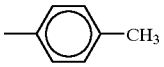 | 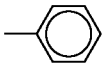 |
| 106 | 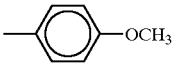 | 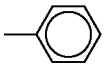 | 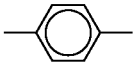 | —H | 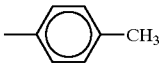 | 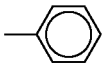 |
| 107 | 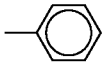 | 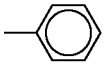 | 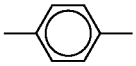 | —H | 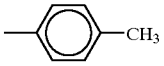 | 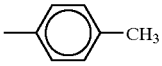 |
TABLE 22
| Specific Ex. No. | $Ar_1$ | $Ar_2$ | $Ar_3$ | $R_5$ | $R_6$ | $R_7$ |
|---|---|---|---|---|---|---|
| 108 | 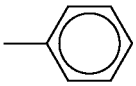 | 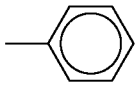 | 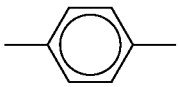 | —H | 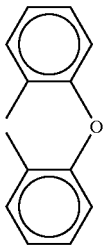 | |
| 109 | 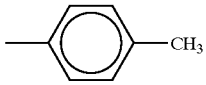 | 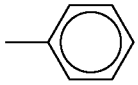 | 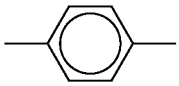 | —H | 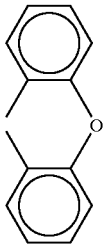 | |
| 110 | 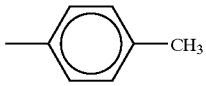 | 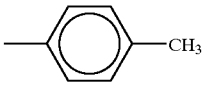 | 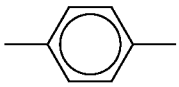 | —H | 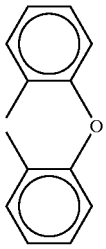 | |

TABLE 22-continued
| Specific Ex. No. | $Ar_1$ | $Ar_2$ | $Ar_3$ | $R_5$ | $R_6$ | $R_7$ |
|---|---|---|---|---|---|---|
| 111 | 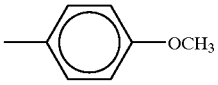 | 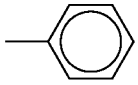 | 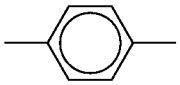 | —H | 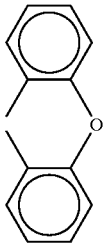 | |
| 112 | 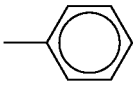 | 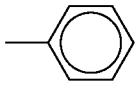 | 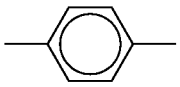 | —H | 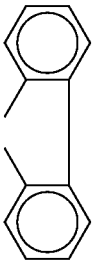 | |
| 113 | 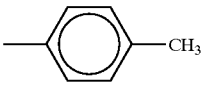 | 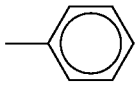 | 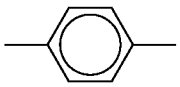 | —H | 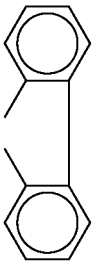 | |
| 114 | 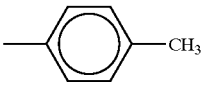 | 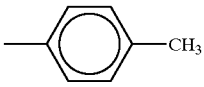 | 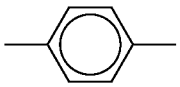 | —H | 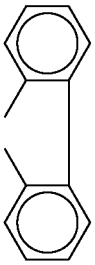 | |
TABLE 23
| Specific Ex. No. | $Ar_1$ | $Ar_2$ | $Ar_3$ | $R_5$ | $R_6$ | $R_7$ |
|---|---|---|---|---|---|---|
| 115 | 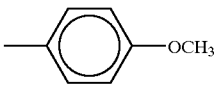 | 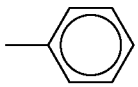 | 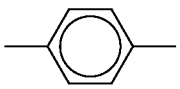 | —H | 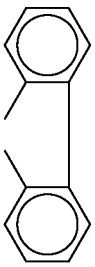 | |

TABLE 23-continued
| Specific Ex. No. | $Ar_1$ | $Ar_2$ | $Ar_3$ | $R_5$ | $R_6$ | $R_7$ |
|---|---|---|---|---|---|---|
| 116 | | | | —H | | |
| 117 | $CH_3$ | | | —H | | |
| 118 | $CH_3$ | $CH_3$ | | —H | | |
| 119 | $OCH_3$ | | | —H | | |
The following is specific examples of a diarylaminostyrene compound in the structural formula (A-II).
(II)-120
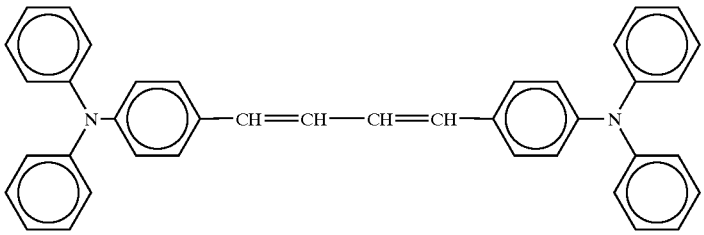

-continued
(II)-121
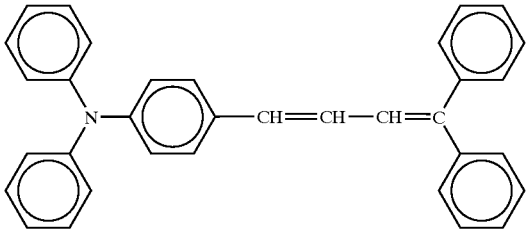
(II)-122
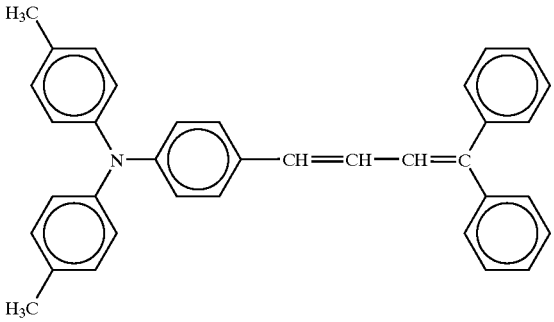
(II)-123
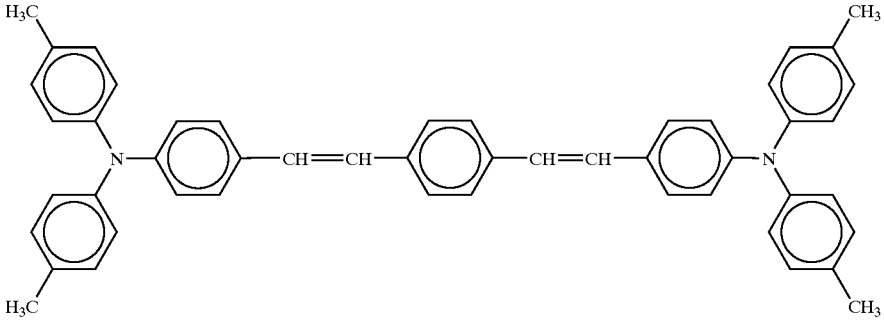
(II)-124
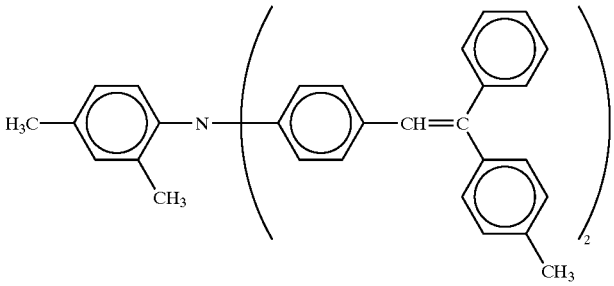
(Structural Formula (A-III): Pr Stilbenzene)
TABLE 24
| Compound No. | $(R_{10})_j$ | $(R_{12})_f$ | $R_9$ | $R_8$ | $(R_{11})_i$ | g | h | W |
|---|---|---|---|---|---|---|---|---|
| (III)-1 | 4-$CH_3$ | H | H | — | H | 0 | 1 | 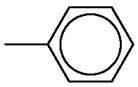 |
| (III)-2 | 4-$CH_3$ | H | 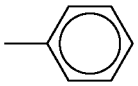 | — | H | 0 | 1 | 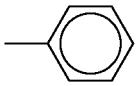 |

TABLE 24-continued
| Compound No. | $(R_{10})_j$ | $(R_{12})_f$ | $R_9$ | $R_8$ | $(R_{11})_i$ | g | h | W |
|---|---|---|---|---|---|---|---|---|
| (III)-3 | 4-$CH_3$ | H | H | H | H | 1 | 1 | 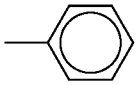 |
| (III)-4 | 4-$CH_3$ | H | H | — | H | 0 | 1 | 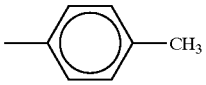 |
| (III)-5 | 4-$CH_3$ | H | H | — | H | 0 | 1 | 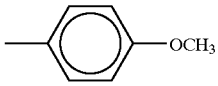 |
| (III)-6 | 4-$CH_3$ | H | $CH_3$ | — | H | 0 | 1 | 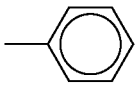 |
| (III)-7 | 4-$CH_3$ | H | H | — | H | 0 | 1 | 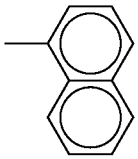 |
| (III)-8 | 4-$CH_3$ | H | H | — | H | 0 | 1 | 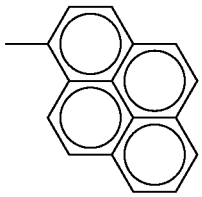 |
| (III)-9 | 4-$CH_3$ | H | H | — | H | 0 | 1 | 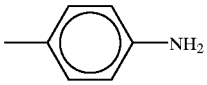 |
| (III)-10 | 4-$CH_3$ | H | H | — | H | 0 | 1 | 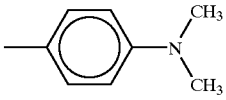 |
| (III)-11 | 4-$CH_3$ | H | H | — | H | 0 | 1 | 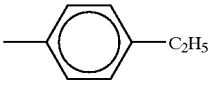 |
TABLE 25
| Compound No. | (R10)j | (R12)f | R9 | R8 | (R11)i | g | h | W |
|---|---|---|---|---|---|---|---|---|
| (III)-12 | 4-$CH_3$ | H | H | — | H | 0 | 1 | 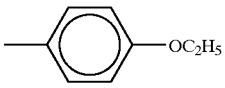 |
| (III)-13 | 2,4,6-tri $CH_3$ | 3,5-di $CH_3$ | 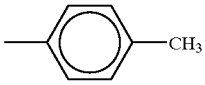 | 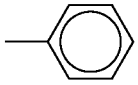 | 3,6,8-tri $CH_3$ | 1 | 1 | 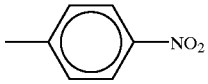 |
| (III)-14 | 3,5-di $CH_3$ | 2,6-di $CH_3$ | 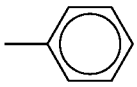 | —$CH_3$ | 7-$C(CH_3)_3$ | 1 | 1 | 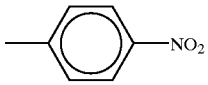 |

TABLE 25-continued
| Compound No. | (R10)j | (R12)f | R9 | R8 | (R11)i | g | h | W |
|---|---|---|---|---|---|---|---|---|
| (III)-15 | 4-$CH_3$ | H | H | — | H | 0 | 1 | 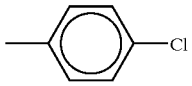 |
| (III)-16 | 4-$CH_3$ | H | H | — | H | 0 | 1 | —CN |
| (III)-17 | 4-$CH_3$ | H | H | — | H | 0 | 1 | 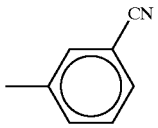 |
| (III)-18 | 4-$CH_3$ | H | H | — | H | 0 | 1 | 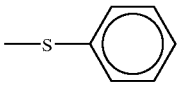 |
| (III)-19 | 4-$CH_3$ | H | H | — | H | 0 | 1 | —$COOC_2H_5$ |
| (III)-20 | 4-$CH_3$ | H | H | — | H | 0 | 1 | 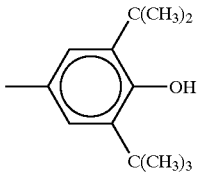 |
| (III)-21 | 4-$CH_3$ | H | H | — | H | 0 | 1 | 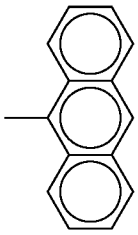 |
| (III)-22 | 4-$CH_3$ | H | H | — | H | 0 | 1 | —C≡CH |
TABLE 26
| Compound No. | $(R_{10})_j$ | $(R_{12})_f$ | $R_9$ | $R_8$ | $(R_{11})_i$ | g | h | W |
|---|---|---|---|---|---|---|---|---|
| (III)-23 | 4-$CH_3$ | H | H | | H | 0 | 1 | —CHO |
| (III)-24 | 4-$CH_3$ | H | H | — | H | 0 | 2 | 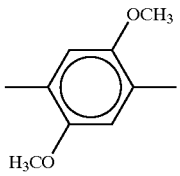 |
| (III)-25 | 4-$CH_3$ | H | H | — | H | 0 | 2 | 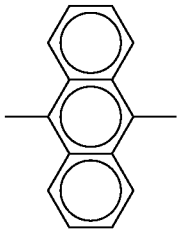 |
| (III)-26 | 4-$CH_3$ | H | H | — | H | 0 | 2 | —CH=CH— |

TABLE 26-continued

| Compound No. | $(R_{10})_j$ | $(R_{12})_f$ | $R_9$ | $R_8$ | $(R_{11})_i$ | g | h | W |
|---|---|---|---|---|---|---|---|---|
| (III)-27 | 4-$CH_3$ | H | H | — | H | 0 | 2 | |
| (III)-28 | 4-$CH_3$ | H | H | — | H | 0 | 2 | CH═CH |
| (III)-29 | 4-$CH_3$ | H | H | — | H | 0 | 2 | N—N O |
| (III)-30 | 4-$CH_3$ | H | H | — | H | 0 | 2 | |
| (III)-31 | H | H | H | — | H | 0 | 1 | |
| (III)-32 | H | H | | — | H | 0 | 1 | |

TABLE 27

| Compound No. | $(R_{10})_j$ | $(R_{12})_f$ | $R_9$ | $R_8$ | $(R_{11})_i$ | g | h | W |
|---|---|---|---|---|---|---|---|---|
| (III)-33 | H | H | H | H | H | 1 | 1 | |
| (III)-34 | H | H | H | — | H | 0 | 1 | $CH_3$ |
| (III)-35 | H | H | H | — | H | 0 | 1 | $OCH_3$ |
| (III)-36 | H | H | —$CH_3$ | — | H | 0 | 1 | |
| (III)-37 | H | H | H | — | H | 0 | 1 | |

TABLE 27-continued

| Compound No. | $(R_{10})_j$ | $(R_{12})_f$ | $R_9$ | $R_8$ | $(R_{11})_i$ | g | h | W |
|---|---|---|---|---|---|---|---|---|
| (III)-38 | H | H | H | — | H | 0 | 1 | |
| (III)-39 | H | H | H | — | H | 0 | 1 | $NH_2$ |
| (III)-40 | H | H | H | — | H | 0 | 1 | $N(CH_3)_2$ |
| (III)-41 | 4-$OCH_3$ | H | H | — | H | 0 | 1 | |
| (III)-42 | 4-$OCH_3$ | H | | — | H | 0 | 1 | |

TABLE 28

| Compound No. | $(R_{10})_j$ | $(R_{12})_f$ | $R_9$ | $R_8$ | $(R_{11})_i$ | g | h | W |
|---|---|---|---|---|---|---|---|---|
| (III)-43 | 4-$OCH_3$ | H | H | H | H | 1 | 1 | |
| (III)-44 | 4-$OCH_3$ | H | H | — | H | 0 | 1 | $CH_3$ |
| (III)-45 | 4-$OCH_3$ | H | H | — | H | 0 | 1 | $OCH_3$ |
| (III)-46 | 4-$OCH_3$ | H | —$CH_3$ | — | H | 0 | 1 | |
| (III)-47 | 4-$OCH_3$ | H | H | — | H | 0 | 1 | |

TABLE 28-continued

| Compound No. | $(R_{10})_j$ | $(R_{12})_f$ | $R_9$ | $R_8$ | $(R_{11})_i$ | g | h | W |
|---|---|---|---|---|---|---|---|---|
| (III)-48 | 4-$OCH_3$ | H | H | — | H | 0 | 1 | |
| (III)-49 | 4-$OCH_3$ | H | H | — | H | 0 | 1 | $NH_2$ |
| (III)-50 | 4-$OCH_3$ | H | H | — | H | 0 | 1 | $N(CH_3)_2$ |
| (III)-51 | 4-$CH_3$ | H | H | — | H | 0 | 1 | |
| (III)-52 | 4-$CH_3$ | H | | — | H | 0 | 1 | |

TABLE 29

| Compound No. | $(R_{10})_j$ | $(R_{12})_f$ | $R_9$ | $R_8$ | $(R_{11})_i$ | g | h | W |
|---|---|---|---|---|---|---|---|---|
| (III)-53 | 4-$CH_3$ | H | H | H | H | 1 | 1 | |
| (III)-54 | 4-$CH_3$ | H | H | — | H | 0 | 1 | $CH_3$ |
| (III)-55 | 4-$CH_3$ | H | H | — | H | 0 | 1 | $OCH_3$ |
| (III)-56 | 4- | H | —$CH_3$ | — | H | 0 | 1 | |
| (III)-57 | 4- | H | H | — | H | 0 | 1 | |

TABLE 29-continued

| Compound No. | $(R_{10})_j$ | $(R_{12})_f$ | $R_9$ | $R_8$ | $(R_{11})_i$ | g | h | W |
|---|---|---|---|---|---|---|---|---|
| (III)-58 | 4-$CH_3$ | H | H | — | H | 0 | 1 | |
| (III)-59 | 4-$CH_3$ | H | H | — | H | 0 | 1 | $NH_2$ |
| (III)-60 | 4-$CH_3$ | H | H | — | H | 0 | 1 | $N(CH_3)_2$ |
| (III)-61 | 3-$CH_3$ | 3-$CH_3$ | | | 7-$C(CH_3)_3$ | 1 | 1 | |
| (III)-62 | 4-$CH_3$ | 2-$CH_3$ | —$CH_3$ | — | 3,6,8-tri $CH_3$ | 0 | 1 | |

TABLE 30

| Compound No. | $(R_{10})_j$ | $(R_{12})_f$ | $R_9$ | $R_8$ | $(R_{11})_i$ | g | h | W |
|---|---|---|---|---|---|---|---|---|
| (III)-63 | 3-$CH_3$ | 3-$CH_3$ | H | — | H | 0 | 1 | |
| (III)-64 | 3-$CH_3$ | 3-$CH_3$ | | — | H | 0 | 1 | |
| (III)-65 | 4-CN | H | H | — | H | 0 | 1 | $CH_3$ |
| (III)-66 | 4-$CH_3$ | H | H | — | 6-$OCH_3$ | 0 | 1 | |
| (III)-67 | 3-$NO_2$ | H | | — | H | 0 | 1 | |
| (III)-68 | 4-$CH_3$ | H | | — | H | 0 | 1 | $CH_3$ |
| (III)-69 | H | H | | — | H | 0 | 1 | $CH_3$ |

TABLE 30-continued
| Compound No. | $(R_{10})_j$ | $(R_{12})_f$ | $R_9$ | $R_8$ | $(R_{11})_i$ | g | h | W |
|---|---|---|---|---|---|---|---|---|
| (III)-70 | 4- 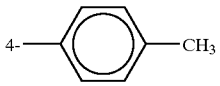 | H | 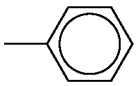 | — | H | 0 | 1 | 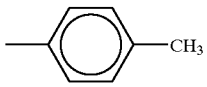 |
| (III)-71 | 4-$CH_3$ | H | H | — | H | 0 | 2 | 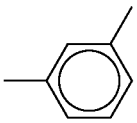 |
| (III)-72 | H | H | H | — | H | 0 | 2 | 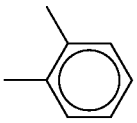 |
TABLE 31
| Compound No. | $(R_{10})_j$ | $(R_{12})_f$ | $R_9$ | $R_8$ | $(R_{11})_i$ | g | h | W |
|---|---|---|---|---|---|---|---|---|
| (III)-73 | 4-$OC_2H_5$ | H | H | — | H | 0 | 1 | 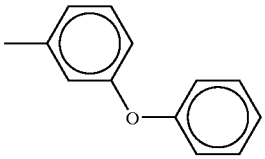 |
| (III)-74 | 4-$CH_3$ | H | H | — | H | 0 | 1 | H |
| (III)-75 | H | H | H | — | H | 0 | 1 | H |
| (III)-76 | 4-$CH_3$ | H | H | — | H | 0 | 1 | 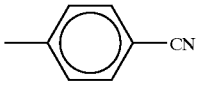 |
| (III)-77 | 4-$CH_3$ | H | H | — | H | 0 | 1 | 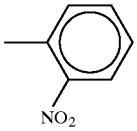 |
| (III)-78 | 4-$CH_3$ | H | H | — | H | 0 | 1 | 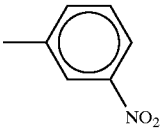 |

(Structural Formula (A-IV): Aminopyrene)
(IV)-1
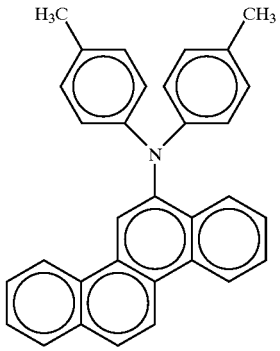
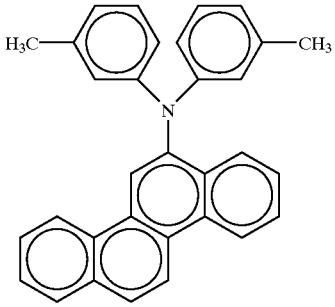
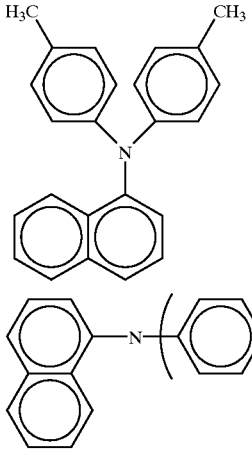
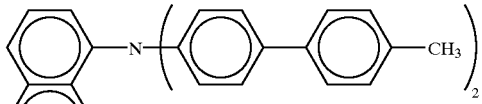
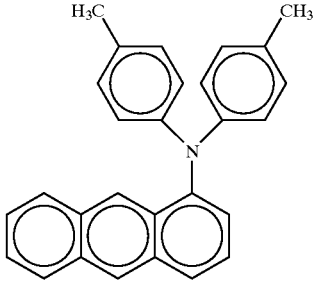
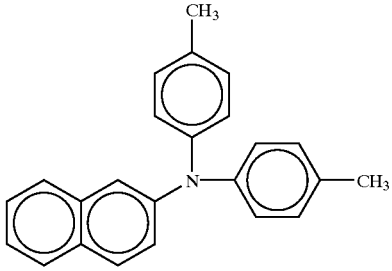
-continued
(IV)-2
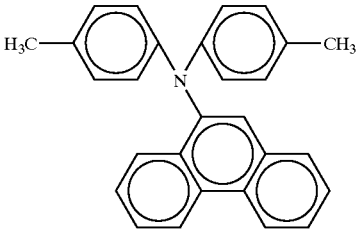
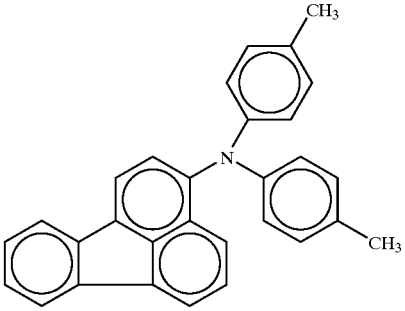
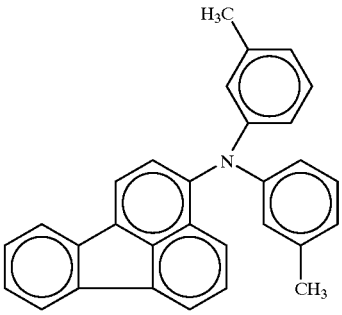
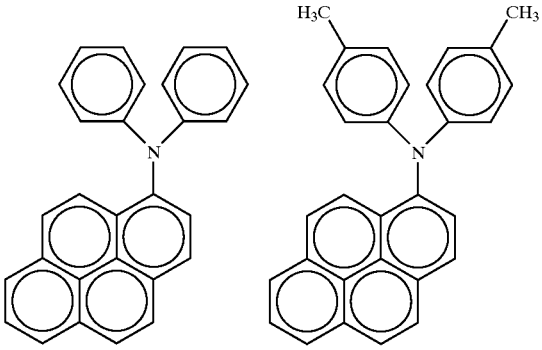
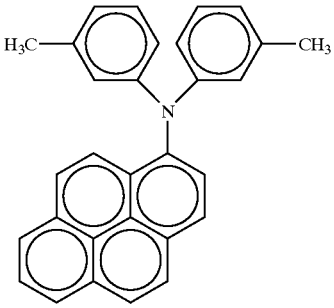

-continued
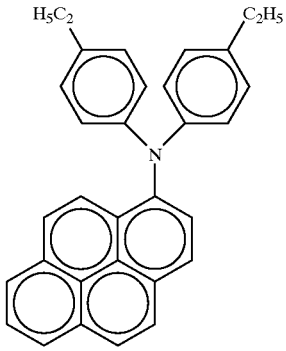
(Structural Formula (A-V): Benzidine)
(V)-1
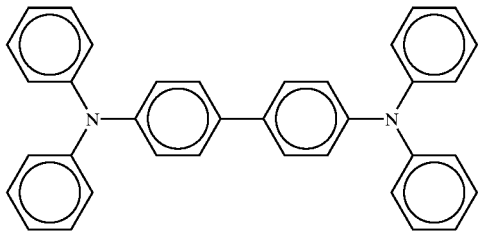
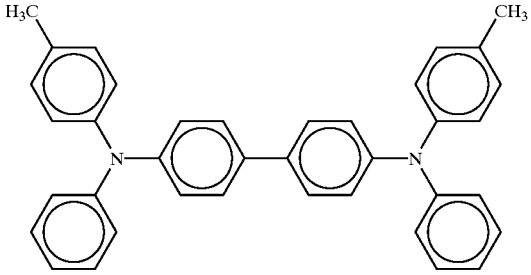
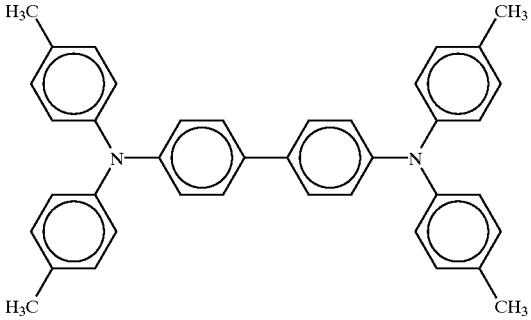
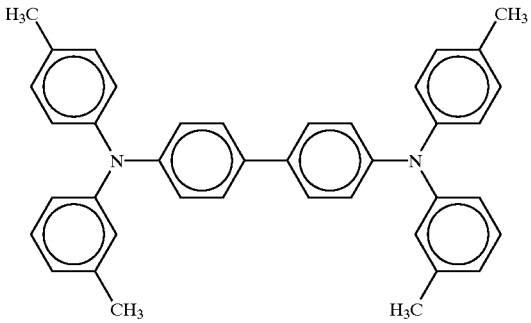
-continued
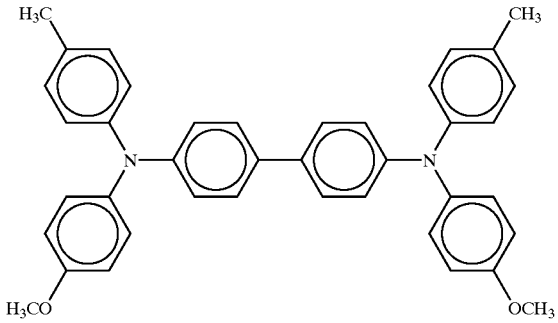
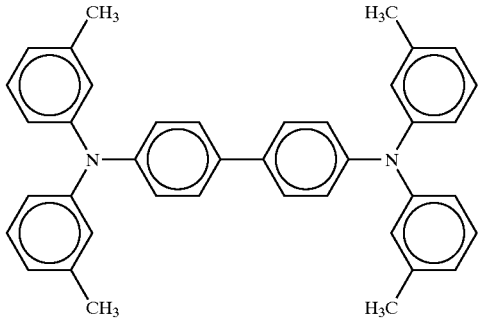
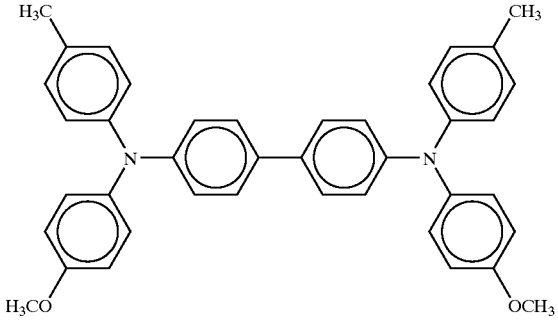
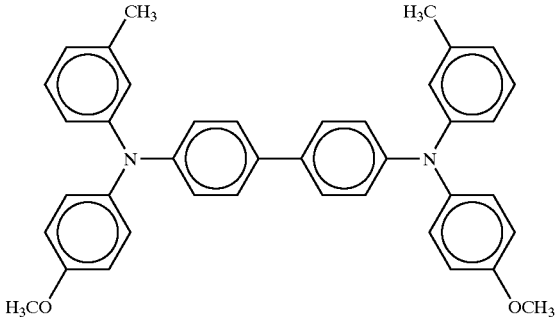
(V)-2
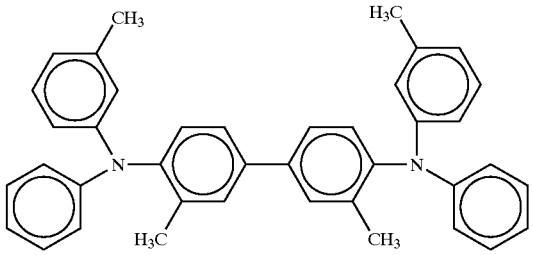

-continued

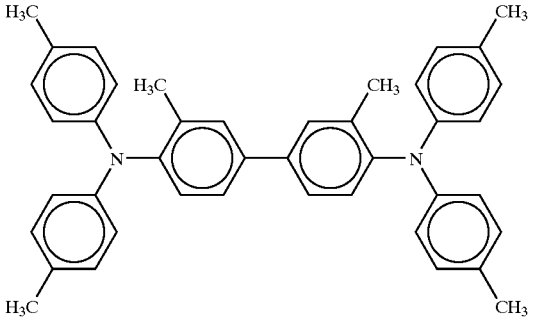

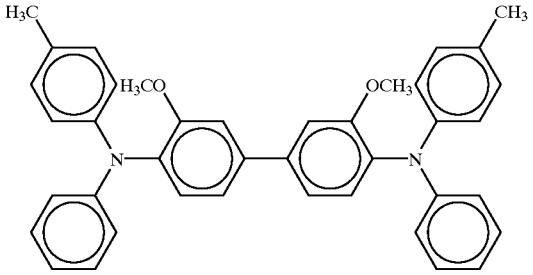

-continued

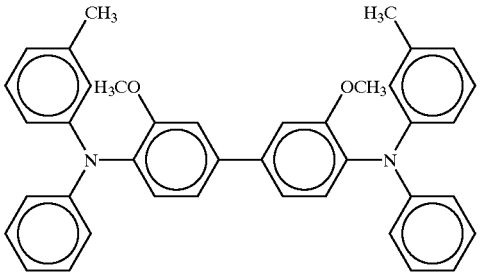

(Structural Formula (A-VI): m Phenylenediamine)

TABLE 32

| $R_{19}$ | $R_{21}$ | $R_{20}$ | $R_{22}$ | $R_{23}$ | $R_{24}$ |
|---|---|---|---|---|---|
| $OC_2H_5$ | $CH_3$ | $CH_3$ | $OC_2H_5$ | $CH_3$ | $CH_3$ |
| $C_2H_5$ | $C_2H_5$ | $C_2H_5$ | $C_2H_5$ | $CH_2CH{=}CH_2$ | $CH_2CH{=}CH_2$ |
| $C_3H_7$ | $C_3H_7$ | $C_3H_7$ | $C_3H_7$ | $NH_2$ | $NH_2$ |
| $C(CH_3)_3$ | $C(CH_3)_3$ | $C(CH_3)_3$ | $C(CH_3)_3$ | $NHCH_3$ | $NHCH_3$ |
| $OCH_3$ | $OCH_3$ | $OCH_3$ | $OCH_3$ | $OCH_3$ | $OCH_3$ |
| $OC_2H_5$ | $OC_2H_5$ | $OC_2H_5$ | $OC_2H_5$ | $CH_3$ | $CH_3$ |
| H | $CH_3$ | $CH_3$ | H | $NH_2$ | $NH_2$ |
| $C_2H_5$ | $CH_3$ | $CH_3$ | $C_2H_5$ | $CH_2CH{=}CH_2$ | $CH_2CH{=}CH_2$ |
| $C(CH_3)_3$ | $CH_3$ | $CH_3$ | $C(CH_3)_3$ | $NHCH_3$ | $NHCH_3$ |
| $OCH_3$ | $CH_3$ | $CH_3$ | $OCH_3$ | $OCH_3$ | $OCH_3$ |
| H | H | H | H | $NH_2$ | $NH_2$ |
| $CH_3$ | $CH_3$ | $CH_3$ | $CH_3$ | $C_6H_5$ | $C_6H_5$ |
| $CH_3$ | $CH_3$ | $CH_3$ | $CH_3$ | $NH_2$ | $NH_2$ |
| $CH_3$ | $CH_3$ | $CH_3$ | $CH_3$ | $NH_2$ | $NH_2$ |
| $CH_3$ | $CH_3$ | $CH_3$ | $CH_3$ | $NHCH_3$ | $NHCH_3$ |
| $CH_3$ | $CH_3$ | $CH_3$ | $CH_3$ | $OCH_3$ | $OCH_3$ |
| $CH_3$ | $CH_3$ | $CH_3$ | $CH_3$ | $CH_3$ | $CH_3$ |
| $CH_3$ | H | H | $CH_3$ | $C_6H_5$ | $C_6H_5$ |
| $CH_3$ | $C_2H_5$ | $C_2H_5$ | $CH_3$ | $C_6H_5$ | $C_6H_5$ |
| $CH_3$ | $C_3H_7$ | $C_3H_7$ | $CH_3$ | $C_6H_5$ | $C_6H_5$ |
| $CH_3$ | $C(CH_3)_3$ | $C(CH_3)_3$ | $CH_3$ | $C_6H_5$ | $C_6H_5$ |
| $CH_3$ | $OCH_3$ | $OCH_3$ | $CH_3$ | $C_6H_5$ | $C_6H_5$ |

TABLE 33

| $R_{19}$ | $R_{21}$ | $R_{20}$ | $R_{22}$ | $R_{23}$ | $R_{24}$ |
|---|---|---|---|---|---|
| $CH_3$ | $OC_2H_5$ | $OC_2H_5$ | $CH_3$ | $C_6H_5$ | $C_6H_5$ |
| H | $CH_3$ | $CH_3$ | H | $C_6H_5$ | $C_6H_5$ |
| $C_2H_5$ | $CH_3$ | $CH_3$ | $C_2H_5$ | $C_6H_5$ | $C_6H_5$ |
| $C_3H_7$ | $CH_3$ | $CH_3$ | $C_3H_7$ | $CH_3C_6H_4$ | $CH_3C_6H_4$ |
| $C(CH_3)_3$ | $CH_3$ | $CH_3$ | $C(CH_3)_3$ | $CH_3C_6H_4$ | $CH_3C_6H_4$ |
| $OCH_3$ | $CH_3$ | $CH_3$ | $OCH_3$ | $CH_3C_6H_4$ | $CH_3C_6H_4$ |
| $OC_2H_5$ | $CH_3$ | $CH_3$ | $OC_2H_5$ | $C_2H_5$ | $CH_2CH{=}CH_2$ |
| $CH_3$ | H | H | $CH_3$ | $CH_2CH{=}CH_2$ | $C_6H_5$ |
| $CH_3$ | $C_2H_5$ | $C_2H_5$ | $CH_3$ | $CH_2CH{=}CH_2$ | $CH_2CH{=}CH_2$ |
| $CH_3$ | $C_3H_7$ | $C_3H_7$ | $CH_3$ | $CH_2CH{=}CH_2$ | $CH_2CH{=}CH_2$ |
| $CH_3$ | $C(CH_3)_3$ | $C(CH_3)_3$ | $CH_3$ | $CH_2CH{=}CH_2$ | $CH_2CH{=}CH_2$ |
| $CH_3$ | $OCH_3$ | $OCH_3$ | $CH_3$ | $CH_2CH{=}CH_2$ | $CH_2CH{=}CH_2$ |
| $CH_3$ | $OC_2H_5$ | $OC_2H_5$ | $CH_3$ | $CH_2CH{=}CH_2$ | $NH_2$ |
| H | $CH_3$ | $CH_3$ | H | $CH_2CH{=}CH_2$ | $NH_2$ |

TABLE 33-continued

| $R_{19}$ | $R_{21}$ | $R_{20}$ | $R_{22}$ | $R_{23}$ | $R_{24}$ |
|---|---|---|---|---|---|
| $C_2H_5$ | $CH_3$ | $CH_3$ | $C_2H_5$ | $CH_2CH{=}CH_2$ | $NH_2$ |
| $C_3H_7$ | $CH_3$ | $CH_3$ | $C_3H_7$ | $CH_2CH{=}CH_2$ | $NH_2$ |
| $C(CH_3)_3$ | $CH_3$ | $CH_3$ | $C(CH_3)_3$ | $CH_2CH{=}CH_2$ | $NH_2$ |
| $OCH_3$ | $CH_3$ | $CH_3$ | $OCH_3$ | $CH_2CH{=}CH_2$ | $NH_2$ |
| $OC_2H_5$ | $CH_3$ | $CH_3$ | $OC_2H_5$ | $CH_2CH{=}CH_2$ | $NH_2$ |
| $CH_3$ | H | H | $CH_3$ | $NH_2$ | $CH_2CH{=}CH_2$ |
| $CH_3$ | $C_2H_5$ | $C_2H_5$ | $CH_3$ | $NH_2$ | $CH_2CH{=}CH_2$ |
| $CH_3$ | $C_3H_7$ | $C_3H_7$ | $CH_3$ | $NH_2$ | $CH_2CH{=}CH_2$ |
| $CH_3$ | $C(CH_3)_3$ | $C(CH_3)_3$ | $CH_3$ | $NH_2$ | $CH_2CH{=}CH_2$ |
| $CH_3$ | $OCH_3$ | $OCH_3$ | $CH_3$ | $NH_2$ | $CH_2CH{=}CH_2$ |
| $CH_3$ | $OC_2H_5$ | $OC_2H_5$ | $CH_3$ | $NH_2$ | $NHCH_3$ |
| H | $CH_3$ | $CH_3$ | H | $NH_2$ | $NHCH_3$ |
| $C_2H_5$ | $CH_3$ | $CH_3$ | $C_2H_5$ | $NH_2$ | $NHCH_3$ |
| $C_3H_7$ | $CH_3$ | $CH_3$ | $C_3H_7$ | $NH_2$ | $NHCH_3$ |
| $C(CH_3)_3$ | $CH_3$ | $CH_3$ | $C(CH_3)_3$ | $NH_2$ | $NHCH_3$ |
| $OCH_3$ | $CH_3$ | $CH_3$ | $OCH_3$ | $NH_2$ | $NHCH_3$ |
| $OC_2H_5$ | $CH_3$ | $CH_3$ | $OC_2H_5$ | $NH_2$ | $NHCH_3$ |
| $CH_3$ | H | H | $CH_3$ | $NHCH_3$ | $NH_2$ |
| $CH_3$ | $C_2H_5$ | $C_2H_5$ | $CH_3$ | $NHCH_3$ | $NH_2$ |
| $CH_3$ | $C(CH_3)_3$ | $C(CH_3)_3$ | $CH_3$ | $NHCH_3$ | $NH_2$ |
| $CH_3$ | $OCH_3$ | $OCH_3$ | $CH_3$ | $NHCH_3$ | $NH_2$ |
| $CH_3$ | $OC_2H_5$ | $OC_2H_5$ | $CH_3$ | $NHCH_3$ | $NH_2$ |
| H | $CH_3$ | $CH_3$ | H | $NHCH_3$ | $NH_2$ |
| $C_2H_5$ | $CH_3$ | $CH_3$ | $C_2H_5$ | $NHCH_3$ | H |

TABLE 34

| $R_{19}$ | $R_{21}$ | $R_{20}$ | $R_{22}$ | $R_{23}$ | $R_{24}$ |
|---|---|---|---|---|---|
| $C(CH_3)_3$ | $CH_3$ | $CH_3$ | $C(CH_3)_3$ | $NHCH_3$ | H |
| $OCH_3$ | $CH_3$ | $CH_3$ | $OCH_3$ | $NHCH_3$ | H |
| $OC_2H_5$ | $CH_3$ | $CH_3$ | $OC_2H_5$ | $NHCH_3$ | H |
| $CH_3$ | H | H | $CH_3$ | $OCH_3$ | H |
| $CH_3$ | $C_2H_5$ | $C_2H_5$ | $CH_3$ | $OCH_3$ | H |
| $CH_3$ | $C(CH_3)_3$ | $C(CH_3)_3$ | $CH_3$ | $OCH_3$ | H |
| $CH_3$ | $OCH_3$ | $OCH_3$ | $CH_3$ | $OCH_3$ | H |
| $CH_3$ | $OC_2H_5$ | $OC_2H_5$ | $CH_3$ | $OCH_3$ | H |
| H | $CH_3$ | $CH_3$ | H | $OCH_3$ | $CH_3$ |
| $C_2H_5$ | $CH_3$ | $CH_3$ | $C_2H_5$ | $OCH_3$ | $CH_3$ |
| $C(CH_3)_3$ | $CH_3$ | $CH_3$ | $C(CH_3)_3$ | $OCH_3$ | $CH_3$ |
| $OCH_3$ | $CH_3$ | $CH_3$ | $OCH_3$ | $OCH_3$ | $CH_3$ |
| $OC_2H_5$ | $CH_3$ | $CH_3$ | $OC_2H_5$ | $OCH_3$ | $CH_3$ |
| $CH_3$ | H | H | $CH_3$ | $CH_3$ | $CH_3$ |
| $CH_3$ | $C_2H_5$ | $C_2H_5$ | $CH_3$ | $CH_3$ | $NH_2$ |
| $CH_3$ | $C(CH_3)_3$ | $C(CH_3)_3$ | $CH_3$ | $CH_3$ | $NH_2$ |
| $CH_3$ | $OCH_3$ | $OCH_3$ | $CH_3$ | $CH_3$ | $NH_2$ |
| $CH_3$ | $OC_2H_5$ | $OC_2H_5$ | $CH_3$ | $CH_3$ | $NH_2$ |
| Cl | Cl | Cl | Cl | Cl | Cl |
| $NH_2$ | $NH_2$ | $NH_2$ | $NH_2$ | $NH_2$ | $NH_2$ |
| $NHCH_2$ | $NHCH_3$ | $NHCH_3$ | $NHCH_3$ | $NHCH_3$ | $NHCH_3$ |
| $NH_2$ | Cl | $NH_2$ | Cl | $CH_3$ | $CH_3$ |
| $NH_2$ | Cl | $NH_2$ | Cl | $CH_2CH{=}CH_2$ | $CH_2CH{=}CH_2$ |
| $NH_2$ | Cl | $NH_2$ | Cl | $NH_2$ | $NH_2$ |
| $NH_2$ | Cl | $NH_2$ | Cl | $NHCH_3$ | $NHCH_3$ |
| $NH_2$ | Cl | $NH_2$ | Cl | $OCH_3$ | $OCH_3$ |
| $NH_2$ | Cl | $NH_2$ | Cl | $C_6H_5$ | $C_6H_5$ |
| $NH_2$ | Cl | $NH_2$ | Cl | $CH_3C_6H_4$ | $CH_3C_6H_4$ |
| $NH_2$ | $NHCH_3$ | $NH_2$ | $NHCH_3$ | $CH_3$ | $CH_3$ |
| $NH_2$ | $NHCH_3$ | $NH_2$ | $NHCH_3$ | $CH_2CH{=}CH_2$ | $CH_2CH{=}CH_2$ |
| $NH_2$ | $NHCH_3$ | $NH_2$ | $NHCH_3$ | $NH_2$ | $NH_2$ |
| $NH_2$ | $NHCH_3$ | $NH_2$ | $NHCH_3$ | $NHCH_3$ | $NHCH_3$ |
| $NH_2$ | $NHCH_3$ | $NH_2$ | $NHCH_3$ | $OCH_3$ | $OCH_3$ |
| $NH_2$ | $NHCH_3$ | $NH_2$ | $NHCH_3$ | $C_6H_5$ | $C_6H_5$ |
| Br | $NHCH_3$ | Br | $NHCH_3$ | $CH_3$ | $CH_3$ |
| Br | $NHCH_3$ | Br | $NHCH_3$ | $CH_2CH{=}CH_2$ | $CH_2CH{=}CH_2$ |
| Br | $NHCH_3$ | Br | $NHCH_3$ | $NH_2$ | $NH_2$ |
| Br | $NHCH_3$ | Br | $NHCH_3$ | $NHCH_3$ | $NHCH_3$ |

TABLE 35

| $R_{19}$ | $R_{21}$ | $R_{20}$ | $R_{22}$ | $R_{23}$ | $R_{24}$ |
|---|---|---|---|---|---|
| Br | $NHCH_3$ | Br | $NHCH_3$ | $OCH_3$ | $OCH_3$ |
| Br | $NHCH_3$ | Br | $NHCH_3$ | $C_6H_5$ | $C_6H_5$ |
| Br | $NHCH_3$ | Br | $NHCH_3$ | $CH_3C_6H_4$ | $CH_3C_6H_4$ |
| Br | $NHCH_3$ | Br | $NHCH_3$ | $C_2H_5$ | $C_2H_5$ |
| $NH_2$ | $CH_3$ | $NH_2$ | $CH_3$ | $CH_3$ | $CH_3$ |
| $NH_2$ | $CH_3$ | $NH_2$ | $CH_3$ | $CH_2CH{=}CH_2$ | $CH_2CH{=}CH_2$ |
| $NH_2$ | $CH_3$ | $NH_2$ | $CH_3$ | $NH_2$ | $NH_2$ |
| $NH_2$ | $CH_3$ | $NH_2$ | $CH_3$ | $NHCH_3$ | $NHCH_3$ |
| $NH_2$ | $CH_3$ | $NH_2$ | $CH_3$ | $OCH_3$ | $OCH_3$ |
| $NH_2$ | $CH_3$ | $NH_2$ | $CH_3$ | $C_6H_5$ | $C_6H_5$ |
| $NH_2$ | $CH_3$ | $NH_2$ | $CH_3$ | $CH_3C_6H_4$ | $CH_3C_6H_4$ |
| $NH_2$ | $CH_3$ | $NH_2$ | $CH_3$ | $C_2H_5$ | $C_2H_5$ |
| Cl | $NH_2$ | Cl | $NH_2$ | $CH_3$ | $CH_3$ |
| Cl | $NH_2$ | Cl | $NH_2$ | $CH_2CH{=}CH_2$ | $CH_2CH{=}CH_2$ |
| Cl | $NH_2$ | Cl | $NH_2$ | $NH_2$ | $NH_2$ |
| Cl | $NH_2$ | Cl | $NH_2$ | $NHCH_3$ | $NHCH_3$ |
| $OC_2H_5$ | $CH_3$ | $CH_2$ | $OC_2H_5$ | H | $NH_2$ |
| $OC_2H_5$ | $OC_2H_5$ | $OC_2H_5$ | $OC_2H_5$ | H | $NHCH_3$ |
| $CH_3$ | $CH_3$ | $CH_3$ | $CH_3$ | H | $OCH_3$ |
| $CH_3$ | $C_2H_5$ | $C_2H_5$ | $CH_3$ | H | $C_6H_5$ |
| $CH_3$ | $C(CH_3)_3$ | $C(CH_3)_3$ | $CH_3$ | H | $CH_4C_6H_4$ |
| $CH_3$ | $OCH_3$ | $OCH_3$ | $CH_3$ | H | $C_2H_5$ |
| $CH_3$ | $OC_2H_5$ | $OC_2H_5$ | $CH_3$ | H | $CH_3$ |
| $NH_2$ | Cl | $NH_2$ | Cl | H | $CH_2CH{=}CH_2$ |
| $NH_2$ | $NHCH_3$ | $NH_2$ | $NHCH_3$ | H | $NH_2$ |
| Br | $NHCH_3$ | Br | $NHCH_3$ | H | $NHCH_3$ |
| $NH_2$ | $CH_3$ | $NH_2$ | $CH_3$ | H | $OCH_3$ |
| Cl | $NH_2$ | Cl | $NH_2$ | H | $C_6H_5$ |
| $C_2H_5$ | $NH_2$ | $C_2H_5$ | $NH_2$ | H | $CH_4C_6H_4$ |
| $NH_2$ | $C_2H_5$ | $NH_2$ | $C_2H_5$ | H | $C_2H_5$ |
| $C_2H_5$ | $C_2H_5$ | $C_2H_5$ | $C_2H_5$ | H | $CH_3$ |
| $NH_2$ | $NH_2$ | $NH_2$ | $NH_2$ | H | $CH_2CH{=}CH_2$ |
| Cl | Cl | Cl | Cl | H | $NH_2$ |
| $OCH_3$ | $OCH_3$ | $OCH_3$ | $OCH_3$ | H | $NHCH_3$ |

Examples of the binder resin for forming the charge transporting layer 37 include thermoplastic resins and thermosetting resins such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral, polyvinyl formal, polyvinyl toluene, poly-N-vinylcarbazole, acrylic resins, silicone resins, epoxy resins, melamine resins, urethane resins, phenol resins, and alkyd resins. These resins may be used either alone or in a mixture of two or more thereof.

The charge transporting substance is contained in the charge transporting layer 37 in an amount of 20 to 300 parts by weight relative to 100 parts by weight of binding material, preferably in an amount of 40% by weight or more with respect to a total amount of the charge transporting layer, and more preferably in an amount of 50% by weight or more. If the content of the charge transporting substance in 100 parts of binding material by weight is 20 to 300 parts by weight, an excellent image is obtainable even if sufficient durability is imparted to the photoconductor. If the charge transporting substance is contained in the charge transporting layer in an amount of 40% by weight or more with respect to a total amount of the charge transporting layer, the carrier mobility is increased and excellent image qualities are achieved, while the deterioration of image qualities by environments (low-temperature/low-humidity or high-temperature/high-humidity environments) is minimized. If the charge transporting substance is contained in an amount of 50% by weight or more, the dependence of the mobility on the intensity of the electric field and the temperature dependence are minimized so that particularly excellent image qualities are obtainable.

The charge transporting layer 37 can be formed by dissolving or dispersing a material for forming the charge transporting layer containing the charge transporting substance in a solvent or a dispersion medium, coating the resulting solution or fluid dispersion on the charge generating layer 35, and drying it. If another layer is provided on the charge generating layer 35, the solution or fluid dispersion is coated on the other layer.

In each of the photoconductors according to the first and second aspects of the present invention, the film thickness of the charge transporting layer 37 is preferably adjusted to 35 μm or less for the retention of the uniformity of the coated film. By adjusting the film thickness to 20 μm or less, the aforementioned effect becomes more prominent. As for the lower-limit value, it differs depending on a system in use (particularly charging potential or the like), but it is preferably adjusted to 5 μm or more.

In each of the photoconductors according to the third and fourth aspects of the present invention, the combined film thickness of the charge transporting layer 37 and the protection layer 39 is adjusted to 20 μm or less in terms of resolution. As for the lower-limit value, it differs depending on a system in use (particularly charging potential or the like), but it is preferably adjusted to 5 μm or more. Moreover, the photoconductor is preferably constructed such that the total film thickness of the charge transporting layer 37 and all layers provided to overlie the charge transporting layer 37 is 20 μm or less.

Examples of the solvent/dispersion medium used to form the charge transporting layer 37 include tetrahydrofuran, dioxane, toluene, dichloromethane, monochlorobenzene, dichloroethane, cyclohexanone, methyl ethyl ketone, and acetone, which may be used either alone or in a mixture of two or more thereof.

(Protection Layer 39)

In the photoconductor of each of the image forming apparatus according to the first and second aspects of the present invention, the protection layer 39 is formed as required to improve the durability of the charge transporting layer 37. In the photoconductor of each of the image forming apparatus according to the third and fourth aspects of the present invention, on the other hand, the protection layer 39 is an essential component.

The protection layer 39 is provided to overlie the charge transporting layer 37. A filler or binder resin is contained as appropriate in the protection layer 39 to improve the durability of the photoconductor. Preferably, the charge transporting layer is contained therein.

The transmittance of the protection layer with respect to the beam (writing beam) from the optical writing means is adjusted to 90% or more. The present inventors found that, if the transmittance was less than 90%, the reproducibility of written dots at a latent image was lowered so that image qualities were lowered. The transmittance was calculated by measuring the transmittance by means of a spectrophotometer using an integrating sphere. If the protection layer 39 was releasable, a film that had been released was used for the measurement. If the protection layer 39 was not releasable, a coated film composed of a protection layer coated on a highly transparent film, such as PET, was used for the measurement.

(Filler)

Preferably, a filler material is contained in the protection layer 39 to improve the wear-resistance of the photoconductor 39.

Preferably, a filler having a refractive index of 1.0 to 2.0 is used. If the refractive index is less than 1.0 or more than 2.0, the transmittance of the protection layer 39 with respect to the beam is lowered so that the reproducibility of written dots at the latent image is lowered and image qualities are lowered. The refractive index of the filler was calculated by immersing filler particles in a liquid the refractive index of which can be changed stepwise and obtaining the refractive index of the liquid in which the interface of the particles becomes indefinite. The refractive index of the liquid was obtained by means of an Abbe refractometer.

The filler can be subdivided into an organic filler and an inorganic filler.

Examples of the organic filler material include fine particles of a fluororesin such as polytetrafluoroethylene, fine particles of a silicone resin, and a power of a-carbon, which may be used either alone or in a mixture of two or more thereof.

Examples of the inorganic filler material include powders of metals such as copper, tin, aluminum, and indium, metal oxides such as silica, tin oxide, zinc oxide, titanium oxide, alumina, zirconium oxide, indium oxide, antimony oxide, bismuth oxide, calcium oxide, tin oxide doped with antimony, and indium oxide doped with tin, metal fluorides such as tin fluoride, calcium fluoride, and aluminum fluoride, and inorganic materials such as potassium titanate and boron nitride, which may be used either alone or in a mixture of two or more thereof.

Preferably, an inorganic filler having a hardness contributing to improved wear-resistance of the photoconductor is used.

A filler with a high electric insulating property is used preferably in terms of a low probability of an image blur. If a filler is dispersed in water and the water dispersion has a pH of 5 or more, the use of such a filler is particularly effective. Preferably, titanium oxide, alumina, zinc oxide, zirconium oxide, or the like is used. The measurement of the pH is performed by dispersing a filler in water and measuring the pH of the water dispersion. Specifically, the measurement was performed in accordance with JIS K 5101/24.

Because $\alpha$-alumina with an hcp structure has an insulating property highest among all the fillers listed above, a high heat stability, and a high wear-resistance, it minimizes the occurrence of an image blur and imparts an extremely high wear-resistance to the photoconductor, so that the use thereof is particularly preferred.

A filler having an average primary particle diameter of 0.01 to 0.5 $\mu$m, which is a size imparting a sufficiently high transmittance to the protection layer 39 and imparting an excellent wear-resistance to the photoconductor, is used preferably. If the average primary particle diameter of the filler is 0.01 $\mu$m or less, coagulation, a reduced dispersibility, and the like cause a reduction in wear-resistance. If the average primary particle diameter of the filler is 0.5 $\mu$m or more, the precipitating property of the filler is promoted or, if image formation is performed by using a photoconductor using the filler having an average primary particle diameter of 0.5 $\mu$m or more, an abnormal image may occur.

A filler processed with a surface treatment using at least one surface treatment agent for the improved dispersibility thereof is used preferably. A filler low in dispersibility increases a residual potential at the photoconductor, reduces the transparency of a coated film, causes a defect in the coated film, reduces the wear-resistance, and increases localized abrasion. Such a filler becomes a detriment to higher durability of the image forming apparatus and higher image qualities.

As the surface treatment agents, any of surface treatment agents that have been used conventionally may be used but, preferably, a surface treatment agent which allows the filler to retain the insulating property is preferred. For example, a titanate coupling agent, an aluminum coupling agent, a zircoaluminate coupling agent, a higher fatty acid, a metal salt such as aluminum stearate, an agent mixture thereof, $Al_2O_3$, $TiO_2$, $ZrO_2$, silicone, aluminum stearate, or an agent mixture thereof is used preferably in terms of the dispersibility of the filler and prevention of an image blur. Although a treatment using only a silane coupling agent causes an image blur particularly under high-temperature and high-humidity conditions, the occurrence of an image blur can be suppressed effectively by performing a treatment using the aforementioned surface treatment agent and silane coupling agent in combination. Although the amount of the surface treatment agent used differs depending on the average primary particle diameter of the filler, an amount of 2 to 30% by weight relative to the filler is generally preferred and, more preferably, 3 to 20% by weight. If the amount of the surface treatment agent is smaller than the aforementioned range, the dispersing effect of the filler is not achievable. If the amount of the surface treatment agent is excessively large, the residual potential is increased disadvantageously. Even if the filler has only a poor insulating property and an image blur is likely to occur, the insulating property is enhanced by performing a surface treatment to the filler so that the influence of the image blur is reduced.

Although the filler contained in the protection layer 39 enhances the durability and suppresses an image blur under high-temperature and high-humidity conditions, it may increase the residual potential disadvantageously.

To suppress the increased residual potential, an organic compound having a carboxyl group in a structure thereof may be used appropriately as a dispersion medium. Such a dispersion medium improves the dispersibility of the filler and reduces charge trapping sites.

To reduce the residual potential, a dispersion medium having an acid value of 10 to 400 (mgKOH/g) is used preferably. In particular, a polycarboxylic acid derivative is used most preferably. The acid value is the number of milligrams of potassium hydroxide needed to neutralize a free fatty acid contained in one gram.

Even if the acid value of the dispersing agent does not fall within the range of 10 to 400 (mgKOH/g), a dispersing agent mixed with a resin, an additive, or the like having an acid value of 10 to 400 (mgKOH/g) may also be used. Examples of such a resin or additive that can be used include an organic fatty acid and a high-acid-value resin.

As the dispersing agent (dispersion medium) used to form the protection layer 39, any of well-known dispersing agents may be used appropriately but an organic compound having a structure containing at least one carboxyl group in a polymer or copolymer thereof is used preferably. In particular, a polycarboxylic acid derivative which improves the dispersibility is used more preferably.

The carboxylic acid site in the dispersing agent plays an important role of imparting an acid value and enhancing the dispersibility. A hydrophilic inorganic filler has a poor affinity with an organic solvent or a binder resin so that, without modification, it is not dispersed successfully by using any dispersing means. By contrast, the dispersing agent mentioned above has an excellent affinity with the inorganic filler at the carboxylic acid site and has an excellent affinity with the binder resin and the organic solvent at the other polymer sites so that the affinity with the organic solvent, the binder resin, and the like is increased via the dispersing agent. This allows the dispersibility of the filler to be increased significantly.

Although the aforementioned dispersing agent achieves an observable effect if it has one carboxyl group, a polycarboxylic acid derivative having a larger number of carboxyl groups is more effective in increasing the dispersibility of the filler, reducing the residual potential, and the like. This is because the dispersing agent having a larger number of carboxyl groups not only has a higher affinity with the filler but also has an affinity between itself and another dispersing agent. This increases the dispersibility of the filler, allows the effect to be sustained, and thereby achieves the effect of suppressing the precipitating property of the filler.

The acid value of the dispersing agent is preferably 10 to 400 mgKOH/g and more preferably 30 to 200 mgKOH/g. If the acid value is higher than necessary, it causes the effect of an image blur to become evident. If the acid value is excessively low, a larger amount of dispersing agent should be added, while the effect of reducing the residual potential is reduced. The acid value of the dispersing agent should be determined by considering the proportion between itself and the amount of the dispersing agent to be added. The acid value of the dispersing agent does not have a direct influence on the effect of reducing the residual potential and it is affected by the structure and molecular weight of the dispersing agent or by the type and dispersibility of the filler. In some cases, the effect of reducing the residual potential may be enhanced by mixing these materials with an organic fatty acid or the like.

Since a region in the vicinity of the interface between the protection layer 39 and the charge transporting layer 37 greatly affects the residual potential, a material having a higher acid value is contained preferably in the region of the protection layer 39 closer to the interface between the protection layer 39 and the photoconductive layer (charge transporting layer 37) than in the region thereof closer to the surface of the photoconductor such that an increase in residual potential is suppressed.

The amount of the dispersing agent added preferably satisfies the following relational expression:

$$0.1 \leqq (\text{Amount of Added Dispersing Agent} \times \text{Acid Value of Dispersing Agent})/(\text{Amount of Added Filler}) \leqq 20.$$

In particular, a minimum required amount is set preferably in the aforementioned relational expression.

If the dispersing agent is added in an amount more than necessary, the effect of an image blur may be observed. If the dispersing agent is added in an excessively small amount, the effect of increasing the dispersibility and reducing the residual potential is not achieved sufficiently, which induces an abnormal image.

(Binder Resin)

A binder resin may be contained in the protection layer 39. As the binder resin, any of binder resins usable in the charge transporting layer 37 may be used but, preferably, a binder resin which does not adversely affect the dispersibility of the filler is used selectively and appropriately.

A binder resin having an acid value is also useful in reducing the residual potential. Such a binder resin may be used either alone or in a mixture with another binder resin.

Examples of the binder resin used properly in the protection layer 39 include resins and copolymers such as polyesters, polycarbonates, acrylic resins, polyethylene terephthalate, polybutylene terephthalate, various copolymers using acrylic acid and methacrylic acid, styrene-acryl copolymers, polyarylates, polyacrylate, polystyrene, epoxy resins, ABS resins, ACS resins, olefin-vinyl monomer copolymers, chlorinated polyethers, aryl resins, phenol resins, polyacetal, polyamides, polyamideimide, polyallylsulfone, polybutylene, polyethersulfone, polyethylene, polyimide, polymethylpentene, polypropylene, polyphenylene oxide, polysulfone, AS resins, butadiene-styrene copolymers, polyurethane, polyvinyl chloride, and polyvinylidene chloride. These materials may be used in a combination of two or more thereof.

The binder resin greatly affects an image blur. Since a binder resin having a high $NO_x$ resistance or a high ozone resistance effectively suppresses an image blur and also increases the wear-resistance of the photoconductor, a high-quality image can be provided over a long period of time. As such a binder resin, a polymer alloy is particularly effective. A polymer alloy with at least polyethylene terephthalate has a high effect of suppressing an image blur and is therefore highly useful.

(Charge Transporting Layer)

A charge transporting substance is preferably contained in the protection layer 39 since it reduces the residual potential at the photoconductor. As the charge transporting substance contained in the protection layer 39, any of charge transporting substance usable in the charge transporting layer 37 can be used.

It is also possible to use a material different from the charge transporting substance contained in the charge transporting layer 37. If a material having an ionization potential lower than that of the charge transporting substance contained in the charge transporting layer 37 is used, the property of charge injection at the interface between the charge transporting layer 37 and the protection layer 39 can be improved so that it is extremely effective in reducing the residual potential. An ionization potential can be measured by using various methods including a spectroscopic measurement method and an electrochemical measurement method.

If the concentration distribution of the charge transporting substance is controlled to be lowest in the uppermost surface region of the protection layer 39, the image degrading effect of $NO_x$ or ozone gas can be reduced without greatly affecting the residual potential. If the concentration of the charge transporting substance is set to progressively lower with distance from the interface between the protection layer 39 and the photoconductive layer (charge transporting layer 37) toward the outermost surface of the protection layer 39, an increase in residual potential can be suppressed extremely effectively. The decomposition or degeneration of the charge transporting substance is considered to be one factor which causes image degradation. By lowering the concentration of the charge transporting substance contained in the protection layer, the influence of the decomposition or degeneration can be reduced.

As the charge transporting substance, a polymer charge transporting substance functioning also as a binder resin is used appropriately. The protection layer 39 containing a polymer charge transporting substance is extremely excellent in wear-resistance.

As the polymer charge transporting substance, any one of well-known materials or a plurality thereof can be used. In particular, polycarbonates each containing a triarylamine structure in a main chain and/or a side chain thereof are used preferably. Among them, polymer charge transporting substances expressed by the following structural formulae (B-I) to (B-X) are used preferably. A polymer charge transporting substance may also be used in the charge transporting layer 37.

[Structural formula (B-I)]

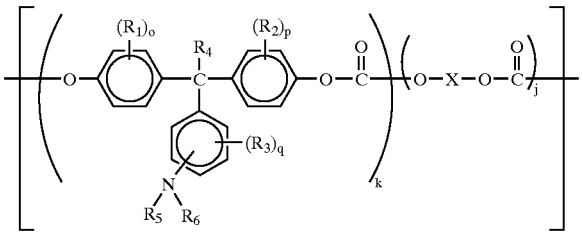

In the aforementioned structural formula (B-I), $R_1$, $R_2$, and $R_3$ may be the same or different and are each independently a substituted or unsubstituted alkyl group or a halogen atom; $R_4$ is a hydrogen atom or a substituted or unsubstituted alkyl group; $R_5$ and $R_6$ may be the same or different and are each independently a substituted or unsubstituted aryl group; o, p, q may be different and are each independently an integer of 0 to 4; k and j represent a composition and satisfy $0.1 \leqq k \leqq 1$ and $0 \leqq j \leqq 0.9$: n represents the number of repetition units and is an integer of 5 to 5000; and X represents a divalent aliphatic group, an alicyclic compound, or a compound expressed by the following structural formula (B-XV).

[Structural formula (B-XV)]

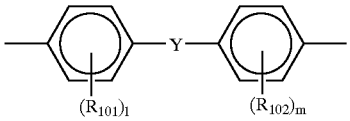

In the aforementioned structural formula (B-XV), R101 and R102 may be the same or different and each independently represents a substituted or unsubstituted alkyl groups, an aryl group, or a halogen atom; l and m each independently represents an integer of 0 to 4; and Y represents a single bond, a straight-chain, branched, or cyclic alkylene group having 1 to 12 carbon atoms, —O—, —S—, —SO—, —$SO_2$—, —CO—, —CO—O—Z—O—CO— (where Z represents a divalent aliphatic group), or a structure expressed by the following structural formula (B-XVI).

[Structural formula (B-XVI)]

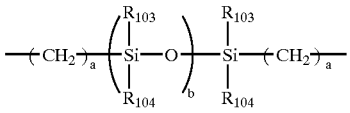

In the aforementioned structural formula (B-XYI), a is an integer of 1 to 20; b is an integer of 1 to 2000; $R_{103}$ and $R_{104}$ are each independently a substituted or unsubstituted alkyl group or an aryl group; and $R_{101}$, $R_{102}$, $R_{103}$, and $R_{104}$ may be the same or different.

[Structural formula (B-II)]

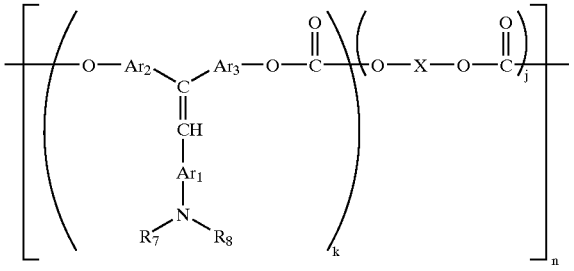

In the aforementioned structural formula (B-II), $R_7$ and $R_8$ may be the same or different and are each independently a substituted or unsubstituted aryl group; $Ar_1$, $Ar_2$, and $Ar_3$ may be the same or different and each independently represents an allylene group; and X, k, j, and n are the same as in the structural formula (B-I).

[Structural Formula (B-III)]

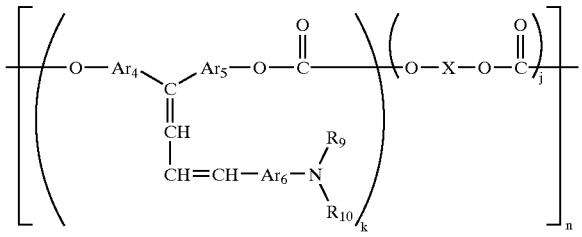

In the aforementioned structural formula (B-III), $R_9$ and $R_{10}$ may be the same or different and are each independently a substituted or unsubstituted aryl group; $Ar_4$, $Ar_5$, and $Ar_6$ may be the same or different and each independently represents an allylene group; and X, k, j, and n are the same as in the structural formula (B-I).

[Structural formula (B-IV)]

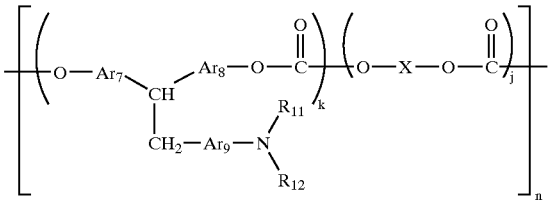

In the aforementioned structural formula (B-IV), $R_{11}$ and $R_{12}$ may be the same or different and are each independently a substituted or unsubstituted aryl group; $Ar_7$, $Ar_8$, and $Ar_9$ may be the same or different and are each independently an allylene group; p represents an integer of 1 to 5; and X, k, j, and n are the same as in the structural formula (B-I).

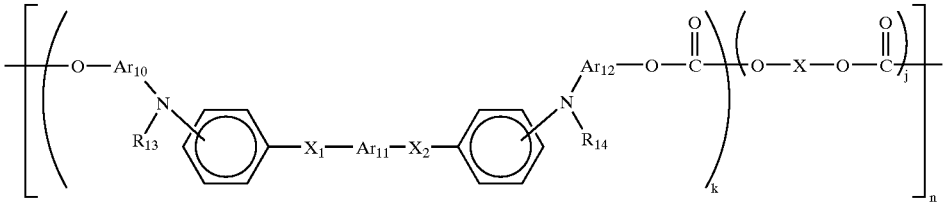

In the aforementioned structural formula (B-V), $R_{13}$ and $R_{14}$ may be the same or different and are each independently a substituted or unsubstituted aryl group; $Ar_{10}$, $Ar_{11}$, and $Ar_{12}$ may be the same or different and are each independently an allylene group; $X_1$ and $X_2$ may be the same or different and each independently represents a substituted or unsubstituted ethylene group or a substituted or unsubstituted vinylene group; and X, k, j, and n are the same as in the structural formula (B-I).

[Structural formula (B-VI)]

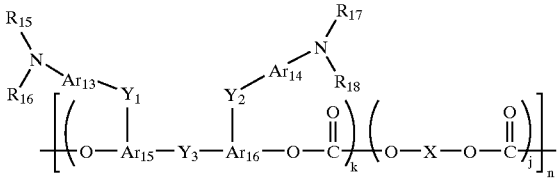

In the aforementioned structural formula (B-VI), $R_{15}$, $R_{16}$, $R_{17}$, and $R_{18}$ may be the same or different and are each independently a substituted or unsubstituted aryl group; $Ar_{13}$, $Ar_{14}$, $Ar_{15}$, and $Ar_{16}$ may be the same or different and are each independently an allylene group; $Y_1$, $Y_2$, and $Y_3$ may be the same or different and each independently represents a single bond, a substituted or unsubstituted alkylene group, a substituted or unsubstituted cycloalkylene group, a substituted or unsubstituted alkylene ether group, an oxygen atom, a sulfur atom, or a vinylene group; and X, k, j, and n are the same as in the structural formula (B-I).

[Structural formula (B-VII)]

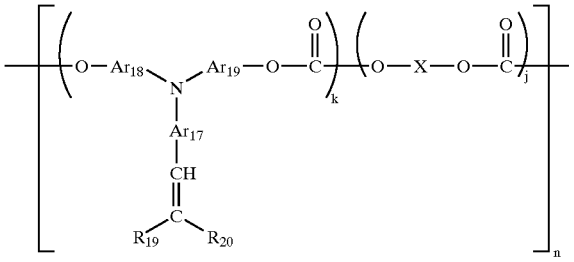

In the aforementioned structural formula (B-VII), $R_{19}$ and $R_{20}$ may be the same or different, may form a ring, and each independently represents a hydrogen atom or a substituted or unsubstituted aryl group; $Ar_{18}$, $Ar_{19}$, and $Ar_{20}$ may be the same or different and each independently represents an allylene group; and X, k, j, and n are the same as in the structural formula (B-I).

[Structural formula (B-V)]

[Structural Formula (B-VIII)]

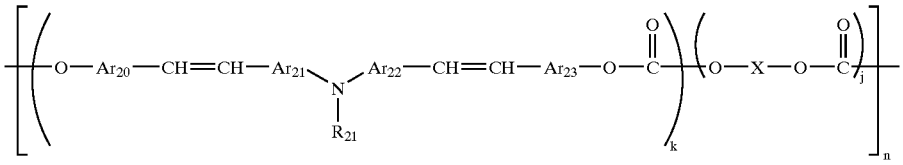

In the aforementioned structural formula (B-VIII), $R_{20}$ represents a substituted or unsubstituted aryl group; $Ar_{20}$, $Ar_{21}$, $Ar_{22}$, and $Ar_{23}$ may be the same or different and each independently represents an allylene group; and X, k, j, and n are the same as in the structural formula (B-I).

[Structural formula (B-IX)]

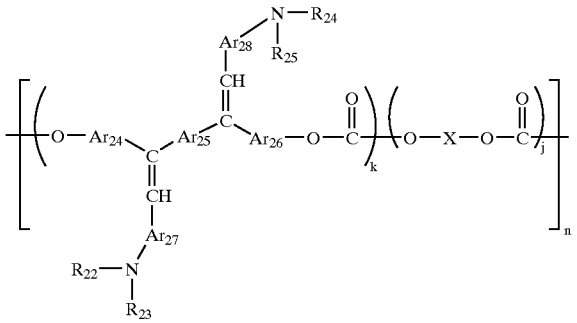

In the aforementioned structural formula (B-IX), $R_{22}$, $R_{23}$, $R_{24}$, and $R_{25}$ may be the same or different and each independently represents a substituted or unsubstituted aryl group; $Ar_{24}$, $Ar_{25}$, $Ar_{26}$, $Ar_{27}$, and $Ar_{28}$ may be the same or different and each independently represents an allylene group; and X, k, j, and n are the same as in the structural formula (B-I).

[Structural formula (B-X)]

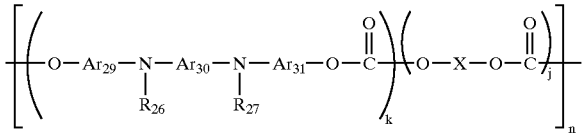

In the aforementioned structural formula (B-X): $R_{26}$ and $R_{27}$ may be the same or different and are each independently a substituted or unsubstituted aryl group; $Ar_{29}$, $Ar_{30}$, and $Ar_{31}$ may be the same or different and each independently represents an allylene group; and X, k, j, and n are the same as in the structural formula (B-I).

The protection layer 39 can be formed by dissolving or dispersing a material for forming the protection layer in a solvent or a dispersion medium, coating the resultant solution or fluid dispersion on the charge transporting layer 37, and drying it. If another layer is provided on the charge transporting layer 37, coating is performed on the other layer.

The aforementioned filler material can be dispersed together with at least an organic solvent and, if necessary, with a dispersing agent in accordance with a conventional method using a ball mill, an attritor, a sand mill, or an ultrasonic wave. As the material of the medium in use, any of media used conventionally including zirconia, alumina, and agate can be used. In terms of the dispersibility of the filler and the effect of reducing the residual potential, however, alumina is used more preferably. In particular, α-alumina having excellent wear-resistance is used more preferably. If zirconia is used, an amount of abrasion of the medium is large during dispersion and the residual potential is increased significantly by the medium mixed in the filler. Moreover, a powder resulting from abrasion mixed in the filler lowers the dispersibility and significantly reduces the precipitating property of the filler. If alumina is used as the medium, the amount of abrasion of the medium during dispersion is reduced and a powder resulting from abrasion and mixed in the filler has an extremely small influence on the residual potential. Even if the powder resulting from abrasion is mixed in the filler, it has only a small influence on the dispersibility compared with the case where another medium is used.

Since the dispersing agent suppresses the coagulation of the filler as well as the precipitating property thereof and thereby significantly improves the dispersibility of the filler, it is added preferably before dispersion together with the filler and the organic solvent.

As for the binder resin and the charge transporting substance, they may be added prior to dispersion. If the binder resin or the charge transporting substance is added prior to dispersion, however, there are cases where the dispersibility slightly lowers. For this reason, the binder resin and the charge transporting substance are added preferably after dispersion in the state where they are dissolved in the organic solvent.

As a method for coating the fluid dispersion or the solution, a conventional coating method such as dip coating, spray coating, bead coating, nozzle coating, spinner coating, or ring coating may be used. To uniformly form a relatively thin film with excellent filler dispersibility, however, spray coating is used most appropriately.

A proper film thickness of the entire protection layer 39 is 1 to 10 μm, preferably 2 to 6 μm. In the photoconductor of each of the image forming apparatus according to the third and fourth aspects of the present invention, in particular, a combined film thickness of the protection layer 39 and the charge transporting layer 37 is preferably adjusted to 20 μm or less.

If the film thickness of the protection layer 39 is extremely small, there are cases where the uniformity of the film is reduced or sufficient wear-resistance cannot be obtained. If the film thickness is extremely large, there are cases where an increased residual potential exerts a greater influence or a reduced light transmittance causes a reduction in resolution or dot reproducibility.

(Undercoat Layer 33)

The undercoat layer 33 may be provided appropriately between the conductive support 31 and the photoconductive layers (the charge generating layer 35 and the charge transporting layer 37). In general, the undercoat layer 33 contains a resin as a main component. Since the photoconductive layers are coated on the undercoat layer 33 by using an organic solvent, a resin having a high resistance to a typical organic solvent is used desirably. Examples of such a resin include water-soluble resins such as polyvinyl alcohol, casein, and polyacrylic sodium, alcohol-soluble resins such as copolymer nylon and methoxymethyl nylon, and curable resins forming three-dimensional networks such as polyurethane, melamine resins, phenol resins, alkyd-melamine resins, and epoxy resins.

To prevent moire, reduce the residual potential, and the like, a fine-particle pigment of a metal oxide such as titanium oxide, silica, alumina, zirconium oxide, tin oxide, or indium oxide may also be added to the undercoat layer.

The undercoat layer can be formed by dissolving/dispersing any of the aforementioned resins in a proper solvent/dispersion medium, the apparatus using a proper coating layer, similarly to the photoconductive layers. In addition, a silane coupling agent, a titanium coupling agent, a chrome coupling agent, or the like can also be used. It is also possible to add various dispersing agents.

A proper film thickness of the undercoat layer is more than 0 $\mu$m and not more than 5 $\mu$m.

As the undercoat layer 33, a layer of $Al_2O_3$ may also be provided on the conductive support 31 by anodization. Alternatively, a layer of an organic material such as poly-para-xylylene (parylene) or of an inorganic material such as $SiO_2$, $SnO_2$, $TiO_2$, ITO, or $CeO_2$ may also be provided as the undercoat layer 33 on the conductive support 31 by vacuum thin-film formation. Besides, an undercoat layer 33 used in a conventional method can also be used.

(Intermediate Layer)

An intermediate layer may be provided appropriately between the photoconductive layers and the protection layer. In general, the intermediate layer contains a binder resin as a main component. Examples of such a resin include polyamide, alcohol-soluble nylon, water-soluble polyvinyl butyral, polyvinyl butyral, and polyvinyl alcohol.

The intermediate layer can be formed by a method similar to the methods for forming the other layers described above.

A proper thickness of the intermediate layer is about 0.05 to 2 $\mu$m.

For improved environmental resistance, especially for the prevention of a lower sensitivity and a higher residual potential, an anti-oxidant, a plasticizer, a lubricant, a UV absorber, a monomeric charge transporting substance, and a leveling agent, which have been well known conventionally, can be added appropriately to at least one of the charge generating layer 35, the charge transporting layer 37, the undercoat layer 33, the protection layer 39, and the intermediate layer.

(Components Other Than Photoconductor)

As the components other than the photoconductor, any of conventionally well-known components can be used except for the optical writing means (exposing means) which has been adapted to perform a write operation with respect to the photoconductor by using a laser beam with a diameter of 35 $\mu$m.

(Optical Writing Means)

Figure 6:
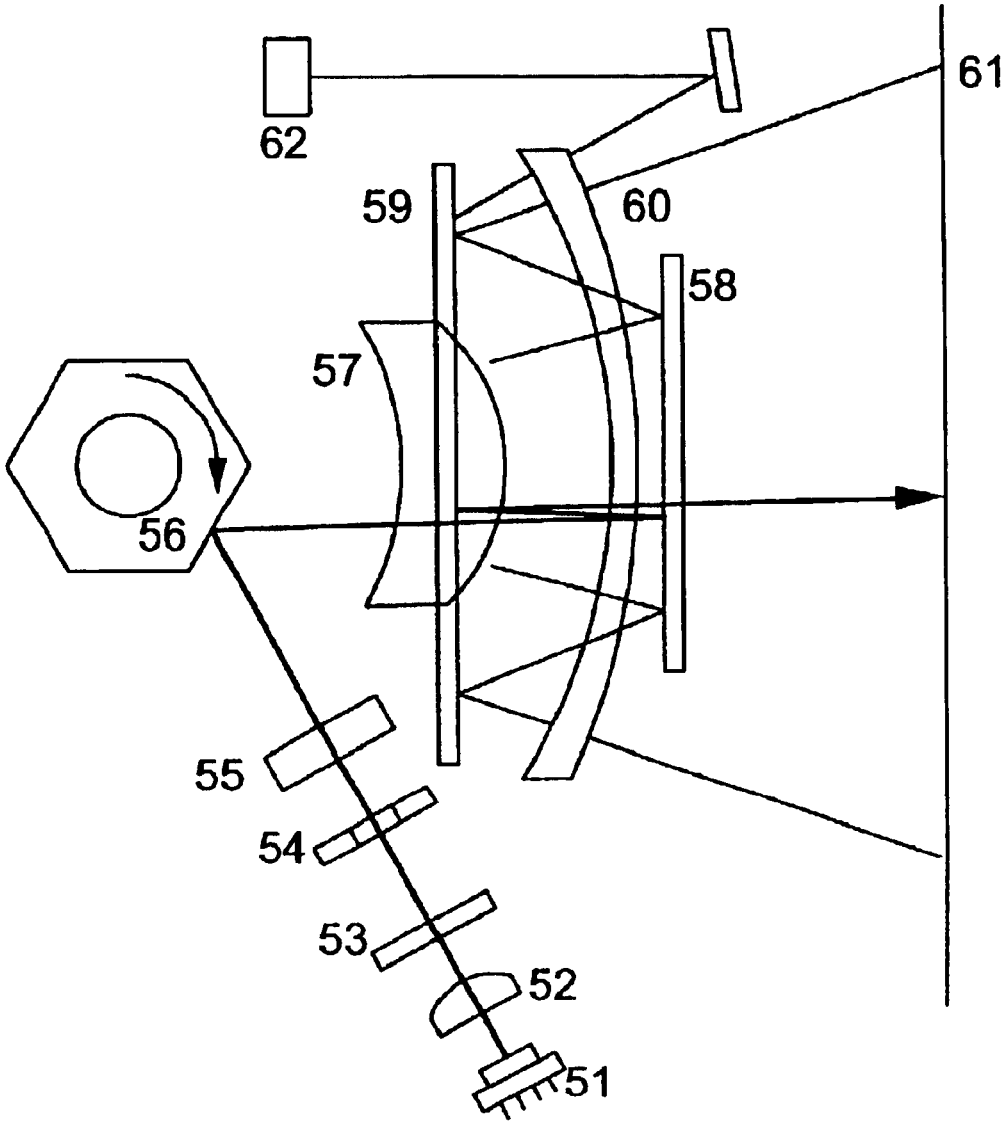
FIG. 6 shows an example of a structure of an optical writing means in the image forming apparatus of FIG. 1.

An example of a structure of the optical writing means (optical unit) is shown in FIG. 6. As shown in FIG. 6, exposing means in an image forming apparatus using an electrophotographic process performs optical modulation by corresponding a so-called LD (laser diode) 51 to an output image. A laser beam emitted from the LD travels through a collimate lens 52, an aperture 54, a cylindrical lens 55, a polygon mirror 56, and f-θ lenses 57 and 60 to form an image on a photoconductor 61. The polygon mirror, which is a rotating polyhedral mirror, is designed such that the laser beam scans the surface of the photoconductor with the rotation thereof. By exposing the photoconductor to the beam, the optical writing means can form a latent electrostatic image corresponding to a desired image on the photoconductor.

The optical writing means according to the present embodiment is designed such that the diameter of the laser beam for forming an image on the photoconductor is 35 $\mu$m or less. This can be implemented by properly using a conventional method/technique/unit (member).

(Other Means)

As stated previously, well-known means (unit) can be used selectively and appropriately as means other than the photoconductor and the optical writing means. For example, a well-known unit such as a corona charger or a contact charger may be used as the charging means (charger) 2.

Figure 7:
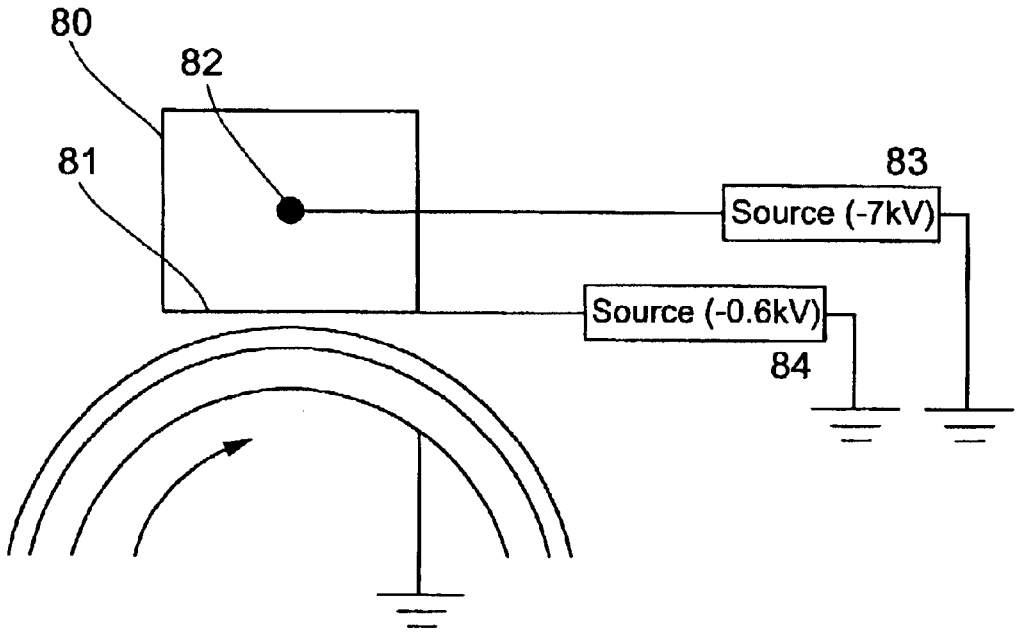
FIG. 7 shows a first example of a structure of a corona charger used in the image forming apparatus shown in FIG. 1.

As the charging means 2, a corona charger which charges a photoconductor by utilizing corona discharging is used normally. FIG. 7 schematically shows an example of the corona charger.

A corona charger as shown in FIG. 7 normally uses a wire 82 made of tungsten or the like and having a diameter of about 60 $\mu$m. The wire 82 is provided in stretched relation at the center of a charging case 80 to extend in an axial direction of the photoconductive drum 1. A voltage of about −7 kV (high voltage) is applied to the wire 82. The charging case 80 is formed from a stainless steel or the like resistant to oxidation. A grid 81 is provided in stretched relation between the wire 82 and the photoconductive drum 1. A voltage of about −0.6 kV is applied to the grid 81. The grid 81 is composed of a stainless steel plate with a thickness of about 0.1 mm which has been cut into a meshed configuration.

The corona charger charges the photoconductor as follows.

Because of a voltage applied to the wire 82, an intense electric field is formed in the vicinity of the wire 82 to cause dielectric breakdown of an atmosphere so that ions are generated. Some of the ions move toward the photoconductor in the presence of the electric field between the wire and the photoconductor so that the surface of the photoconductor is charged. The phenomenon continues till the surface potential of the photoconductor becomes nearly equal to the potential applied to the grid 81.

Hence, the surface potential of the photoconductor is controllable with the potential applied to the grid.

Figure 8A:
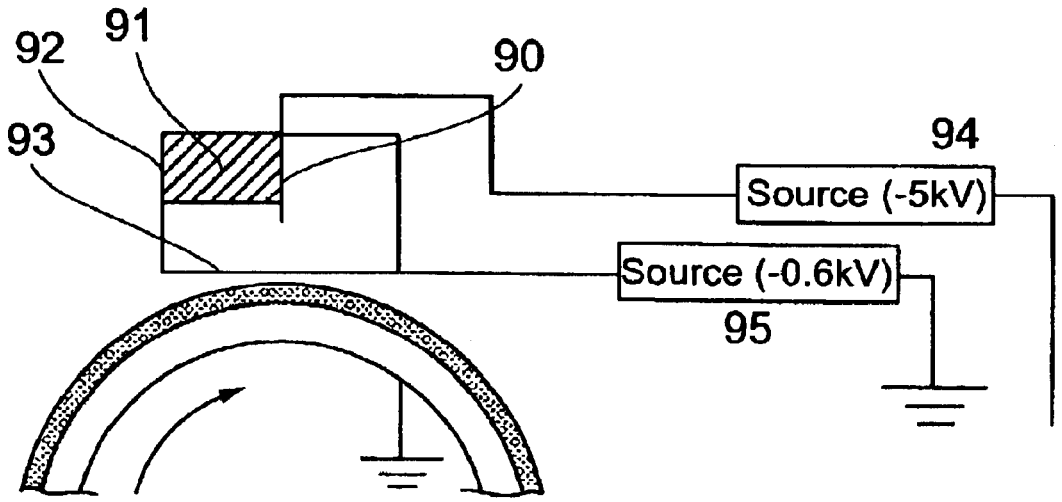
FIG. 8A is a view showing a second example of the structure of the corona charger used in the image forming apparatus shown in FIG. 1
Figure 8B:
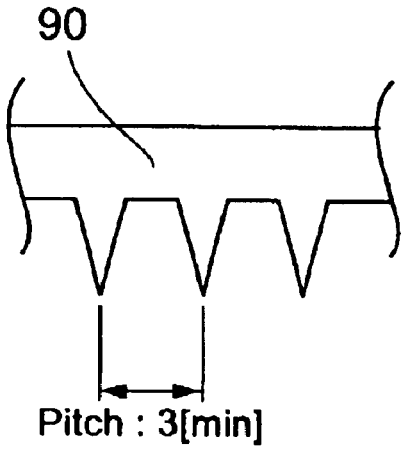
FIG. 8B is a schematic view of a sawtooth electrode in the corona charger.

As another example of the corona charger; a corona charger using a sawtooth electrode as a discharge electrode is known (e.g., Japanese Patent Application Laid-Open Nos.08-20210, 06-301286, and the like). FIG. 8A and FIG. 8B schematically show an example of the corona charger using the sawtooth electrode.

The sawtooth electrode 90 has a configuration as shown in FIG. 8B and is normally formed from a stainless steel plate with a thickness of about 0.1 mm [mm]. The point pitch is set to about 3 mm. As shown in FIG. 8A, the sawtooth electrode is fastened to a support member 91 and a voltage of about −5 kV (high voltage) is applied thereto from a power supply.

The corona charger is also covered with the charging case 92 made of stainless steel or the like and the grid 93 is disposed between the sawtooth electrode 90 and the photoconductive drum 1, similarly to the corona charger shown in FIG. 7. Corona discharging occurs in the vicinity of the points of the sawtooth electrode 90 in the same manner as in the corona charger shown in FIG. 7 so that the photoconductor is charged.

There has also been proposed a needle-like (pin-like) discharge electrode.

The corona charger using the sawtooth electrode is advantageous over the corona discharger using the wire in that it can be scaled down and only a smaller amount of ozone is generated.

If the sawtooth electrode is used, it can impart directionality to corona discharging so that the charger is reduced in width. Specifically, ions flowing toward the grid (photoconductor) are larger in number than ions flowing toward the charging case so that the aperture of the charging case is reduced in width at a position closer to the photoconductor. This scales down not only the charger but also the image forming apparatus.

Since corona discharging has directionality, the photoconductor is charged with extremely high efficiency and a current flowing in the corona charger can be reduced. This achieves a reduction in the amount of ozone generated.

Besides the corona charger, a so-called contact charger is also known for the charger 2. Since the problem of a large amount of generated ozone and a high applied voltage of 5 to 7 kV, which is inherent in the corona charger, can be solved to an extent by the contact charger, the contact charger is used widely in low- and moderate-speed electrophotographic image forming apparatus.

Figure 9:
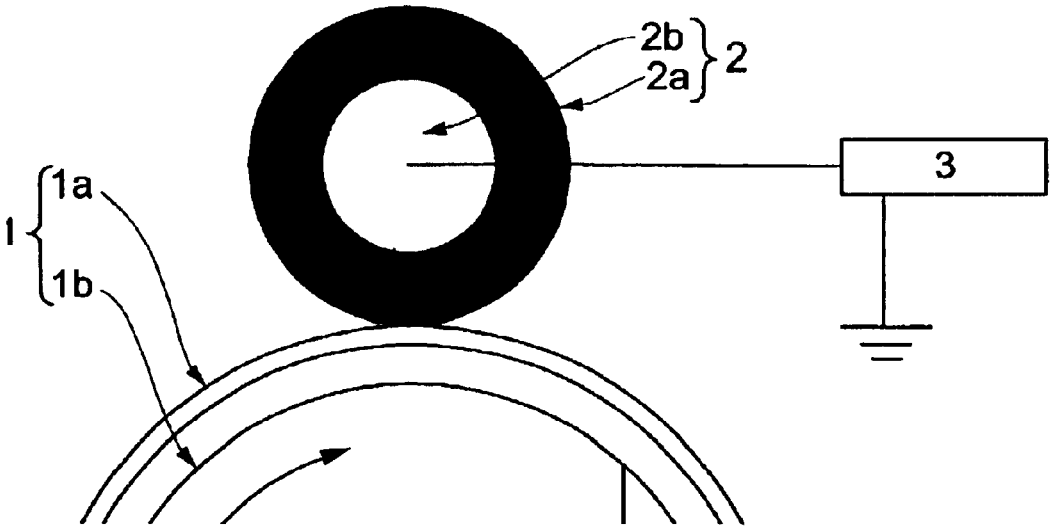
FIG. 9 shows a third example of the structure of the corona charger used in the image forming apparatus shown in FIG. 1.

An example of a structure of the contact charger is shown in FIG. 9. As shown in FIG. 9, the contact charger charges the photoconductor 1*a* by bringing a charging member 2 into contact with a photoconductive drum 1 as a member to be charged and applying a voltage to the charging member 2.

The charging member 2 is configured as a roller having a diameter of 5 to 20 mm and a length of about 300 mm and composed of an elastic layer 2*b* formed on a conductor 2*a*. The charging member 2 is brought into contact with the rotated photoconductive drum 1 to rotate as a follower. The elastic layer 2*b* is normally composed of a material having a resistivity of $10^7$ to $10^9$ Ωcm. In some cases, a surface protection layer with a thickness of about 10 to 20 μm is formed on the surface (surface of the elastic layer 2*b*) of the charging member 2.

The photoconductive drum 1 is typically configured as a roller having a diameter of 30 to 80 mm and a length of about 300 mm and composed of a photoconductor 1*b* formed on a conductor 1*a*.

The contact charger applies a voltage from a power supply 3 to the charging member 2 to charge the photoconductor 1*a*. A dc voltage of −1.5 to −2.0 kV is normally used as the applied voltage.

By using such a structure, the contact charger uniformly charges the photoconductor 1 to −500 to −800 V.

EXAMPLES A

The image forming apparatus according to the first and second of the present invention will be described herein below in greater detail by using examples. However, the construction of the present invention is not limited to the examples.

EXAMPLE A-I

In Example A-I, the image forming apparatus shown in FIG. 1 was used. In FIG. 1, the image forming apparatus has the photoconductive drum 1, the charging means 2, the exposing means 3, the developing means 4, the transferring means 5, the clearing means 7, and the fixing means 8.

In FIG. 1, the photoconductive drum 1 having the charge transporting layer 37, the charge generating layer 35, and the undercoat layer 33 provided on a surface of the conductor was rotated in the direction indicated by the arrow. The diameter of the photoconductive drum was set to 60 mm and the circumferential speed thereof was set to 230 mm/sec.

As the charging means 2, a contact roller charger was used. The charger has a charging roller composed of an elastic layer (with a thickness of 3 mm) with so-called moderate-resistance conductivity formed on a cored bar. A dc voltage (−1.21 kV) was applied from the power supply to uniformly charge the photoconductor (−550 V).

As the exposing means 3, there was used exposing means which irradiates a surface of the photoconductor charged uniformly by the charging means 2 with light corresponding to an objective image and thereby forms a latent electrostatic image thereon.

As the developing means 4, a so-called two-component development unit was used. The development vessel of the development unit was filled with a developer prepared by mixing a toner (with a volume average particle diameter of 6.8 μm) with a carrier (with a particle diameter of 50 μm) such that a toner concentration of 5.0% was achieved.

The developing means 4 carries the developer to the portion of the photoconductor opposing a development sleeve by means of the development sleeve. The distance (a so-called development gap) between the photoconductor and the development sleeve was adjusted to 0.3 mm. A dc voltage (−400 V) was applied from the power supply to the development sleeve. As a result, the toner adhered to the photoconductor in correspondence with the latent electrostatic image (reversal development). The circumferential speed of the development sleeve was set to 460 mm/sec (at a circumferential speed ratio of 2.0).

As the transferring means 5, there was used a unit which transfers a toner image developed by the developing means 4 from paper feeding means not shown to the recording sheet 6 that had been carried. The unit has a transfer belt and a power supply and applies a voltage from the power supply to the transfer belt. The voltage was controlled with a constant current (30 μA).

As the cleaning means 7, a unit composed of a blade made of an elastic material was used. Cleaning of a residual toner image (so-called toner left untransferred) from the surface of the photoconductor was performed.

As the fixing means 8, there was used a unit which fixes the toner image to the recording sheet with the application of heat and pressure to the recording sheet (such as paper) that had been carried.

By using such units, an output image was obtained. A detailed description will be given next to the exposing means 3.

As a light source for the exposing means (optical writing means) 3, a laser diode was used and a unit which operates while irradiating the photoconductor with a beam (laser beam) emitted from the laser diode by means of the polygon mirror was used.

FIG. 6 is a schematic structural view of the exposing means (optical writing means 3) used in Examples A.

In FIG. 6, the exposing means 3 has an LD array 51 of 4-ch (4-channel) type having four LDs (laser diodes) at a wavelength of 780 nm mounted thereon. The laser beam from the LD 51 is applied to the polygon mirror 56 via the collimator lens 52, the ND filter 53, the aperture 54, and the cylindrical lens 55. As the polygon mirror 56, a hexahedral type which rotates at the number of revolutions of 2716.5 rpm was used.

The laser beam is reflected by the polygon mirror 56 to form an image on the photoconductor via return mirrors 58 and 59 and the f-θ lenses 57 and 60.

In Example A, the diameter of the laser beam was adjusted to 35 μm (in a main scanning direction)×35 μm (in a subordinate scanning direction) on the photoconductor.

As the f-θ lens 57, a plastic lens formed from a molded plastic was used and the configuration of the lens was designed with a so-called A-C plane, whereby a beam diameter extremely small as described above was implemented. The laser beam scanned the surface of the photoconductor, while the polygon mirror 56 was rotated.

The beam diameter was measured by using Beamscan manufactured by PHOTON, Inc.

In Example A-1, the laser beam was applied to the photoconductor, while it was moved at a rate of 16.9 nsec per pixel in the image forming apparatus with a resolution of 1200 dpi. The dimensions of one pixel were set to 21.3 μm×21.3 μm. A so-called pixel clock was adjusted to 59.2 MHz. In other words, the LD was optically modulated at a frequency of 59.2 MHz.

In FIG. 6, a synchronous detection plate 62 was constructed such that the laser beam was incident thereon when the laser beam was located in a non-image region. The synchronous detection plate 62 has such a mechanism as to generate a reference signal in response to the incidence of the laser beam and reset a clock signal forming a timing (pixel clock) for a position at which an image is written based on the reference signal. This allowed the laser beam that had been optically modulated to be incident on a specified position on the photoconductor.

In Example A-1, the pulse width of the LD was changed in four levels such that four-tone reproduction (quaternary writing) was performed for each pixel.

A detailed description will be given next to the photoconductor 1.

Specifications for Photoconductor

A coating liquid for the undercoat layer, a coating liquid for the charge generating layer, and a coating liquid for the charge transporting layer having the following compositions were coated successively by dip coating on an aluminum cylinder having a diameter of ϕ60 and dried so that the undercoat layer with a film thickness of 3.5 μm, the charge generating layer with a film thickness of 0.2 μm, and the charge transporting layer with a thickness of 24 μm were formed.

The film thicknesses were measured by using FISHERSCOPE, which is a thickness gage manufactured by Fisher Technology, Inc.

Coating Liquid for Undercoat Layer

Titanium Dioxide Powder: 400 parts

Melamine Resin: 65 parts

Alkyd Resin: 120 parts

2-Buthanone: 400 parts

Coating Liquid for Charge Generating Layer

Chlorogallium Phthalocyanine: 2 parts

Polyvinyl Butyral: (S-LEC BM-1: Manufactured by Sekisui Chemical Co., Ltd.):

1.0 part

Cyclohexanone: 30 parts

Methyl Ethyl Ketone: 70 parts

Coating Liquid for Charge Transporting Layer

Polycarbonate (PanliteC-1400, Manufactured by Teijin Chemicals Ltd.): 6 parts

Charge transporting substance Expressed by Following Structural formula (A-1): 4 parts Carrier Mobility: $1\times10^{-5}$ $cm^2\cdot V^{-1}\cdot sec^{-1}$ Tetrahydrofuran: 50 parts

[Structural formula (A-1)]

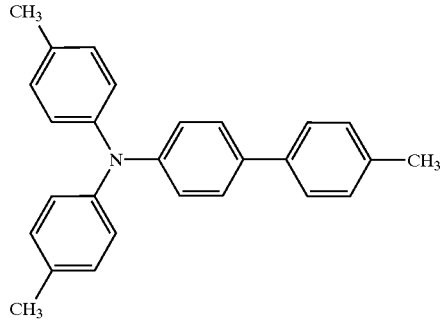

Image-Quality Evaluation Method

For image-quality evaluation, tone which is among important image-quality items was measured.

The evaluation of tone was performed by outputting patches (a set of 17 patches) processed with a halftoning operation while varying the number of lines and measuring the lightnesses (L*) of the patches.

In the halftoning operation, images were outputted while the so-called number of lines was maintained at a level of 200 lpi.

For the measurement of the lightness (L*), a spectro-densito/colori-meter (938 manufactured by X-Rite Ltd.) was used.

Figure 10:
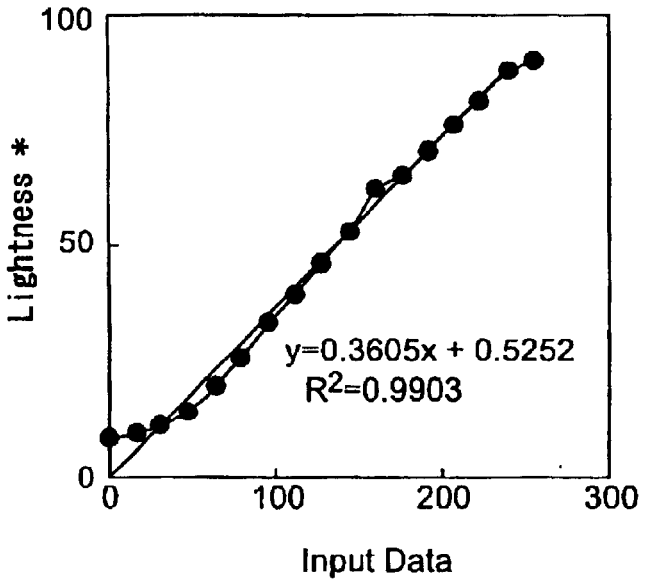
FIG. 10 is a first view illustrating a relationship between input data and lightness L.
Figure 11:
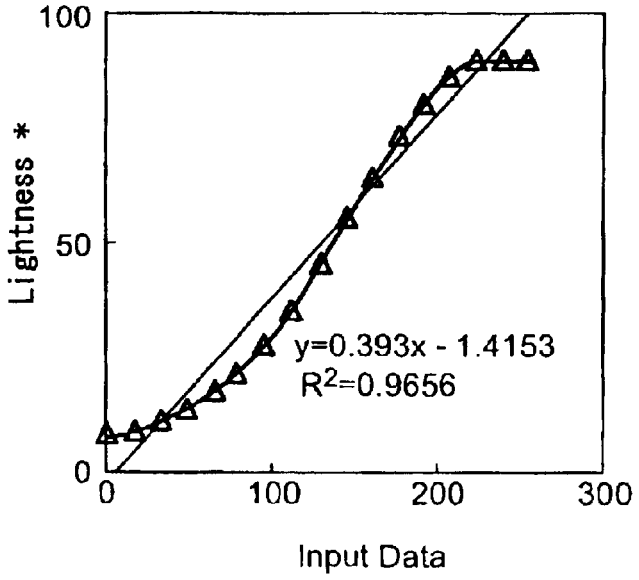
FIG. 11 is a second view illustrating a relationship between input data and lightness L.

For the numerification of tone, a method which calculates a so-called R^2 (the square of an autocorrelation coefficient obtained through the approximation of a linear expression) from the linearity of lightness values obtained by performing colorimetry with respect to the set of 17 patches relative to input (area ratio on data). If the relationship between the aforementioned input data and the lightnesses (L*) is linear, the value of R^2 is close to 1.0, as shown in FIG. 10. As the relationship becomes less linear, the value of R^2 becomes smaller, as shown in FIG. 11.

By evaluating an image for which high tone is required, such as a natural image, from an inventor's point of view, the present inventors have defined a R^2 value 0.98 or more as a criterion for excellent tone.

The value of R^2 tends to be higher on a so-called low-line-number image. If the number of lines is 200 lpi or less, a so-called dither texture becomes recognizable to give an unnatural impression on a natural image or the like and contribute to image degradation. This is why the inventors have defined a tone value R^2 0.98 or more when the number of lines used in a halftoning operation is 200 or more as a criterion for high image qualities.

On the other hand, a recording density is related to the image qualities of a character/line drawing. Control of the recording density is particularly effective in reducing a jaggy property. A recording density of 900 dpi or more is necessary to render the jaggy indistinct. To achieve high image qualities, a recording density of 1200 dpi or more is necessary.

Carrier Mobility Measurement Method

The carrier mobility was measured as follows.

First, an ITO film was formed on a commercially available slide glass by vacuum vapor deposition to provide a base for measuring the mobility of the charge transferring layer (CTL).

Then, the coating liquid for the charge transporting layer having the prescription shown in Example A was coated on the base by dip coating and dried to form the charge transporting layer with a thickness of about 10 μm. Further, Au was vapor deposited to a thickness of about 30 Å to provide an upper electrode.

The mobility of the charge transporting layer of a sample thus prepared was measured at an electric field intensity of $3\times10^5$ V/cm by a time-of-flight method using an $N_2$ laser (337.1 nm) as a light source.

The present inventors mounted the photoconductor described above on an image forming apparatus obtained by modifying MF4570 manufactured by Ricoh Co., Ltd. for a 2-bit and 1200-dpi write operation. The result was shown in Table 39.

EXAMPLE A-2

An image was outputted and the image qualities were evaluated in the same manner as in Example A-I except that the charge transporting substance used for the charge transporting layer in Example A-1 was changed to a charge transporting substance expressed by the following structural formula (A-2).

Carrier Mobility of the following structural formula (A-2): $1.5\times10^{-5}$ $cm^2\cdot V^{-1}\cdot sec^{-1}$.

[Structural formula (A-2)]

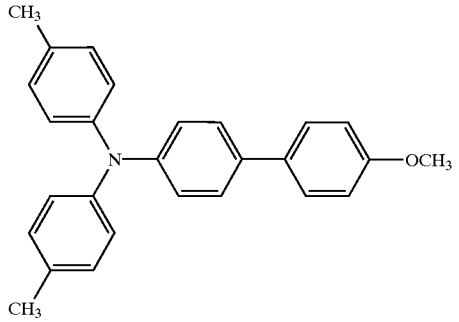

EXAMPLES A-3 TO 17 AND COMPARATIVE EXAMPLES A-1 to 3

A photoconductor was produced and an image was outputted in the same manner as in Example A-I except that the type of the charge transporting substance used for the charge transporting layer in Example A-1 and an amount of the charge transporting substance added were changed as shown in Tables 36 to 38. In Tables 36 to 38, the carrier mobilities ($\mu$) of charge transporting layers produced in Examples A- and Comparative Examples A- are also shown.

TABLE 36

| | Charge Transport Substance | Amount of Addistives (parts by weight) | m ($cm^3 \cdot V^{-1} \cdot sec^{-1}$) |
|---|---|---|---|
| Ex. A-3 | 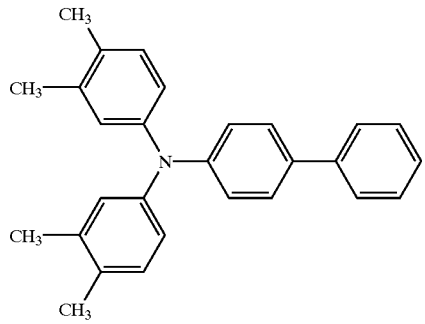 | 6 | $1.4 \times 10^{-5}$ |
| Ex. A-4 | 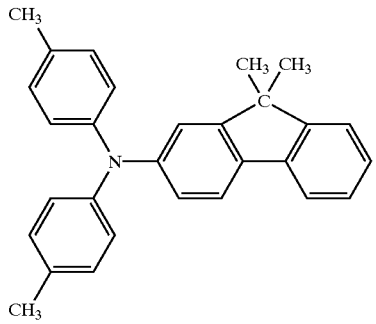 | 6 | $1.1 \times 10^{-5}$ |
| Ex. A-5 | 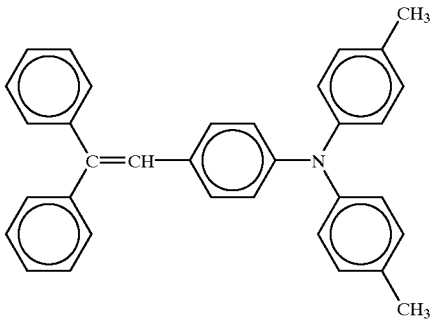 | 4 | $2.1 \times 10^{-5}$ |

TABLE 36-continued
| | Charge Transport Substance | Amount of Addistives (parts by weight) | m ($cm^3 \cdot V^{-1} \cdot sec^{-1}$) |
|---|---|---|---|
| Ex. A-6 | 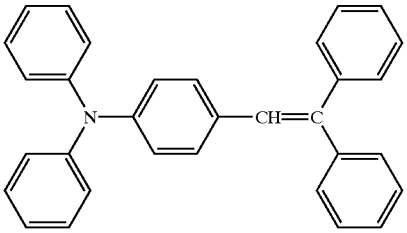 | 4 | $1.1 \times 10^{-5}$ |
| Ex. A-7 | 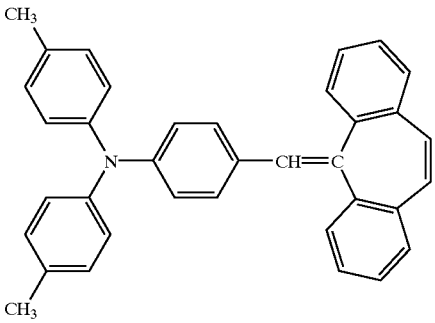 | 5.5 | $2.0 \times 10^{-5}$ |
TABLE 37
| | | | |
|---|---|---|---|
| Ex. A-8 | 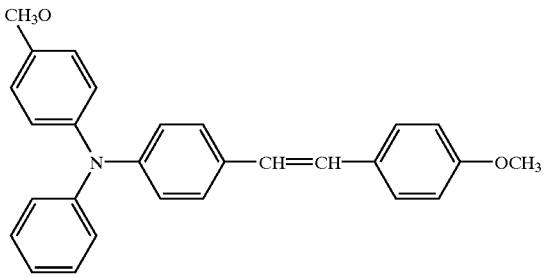 | 4 | $1.9 \times 10^{-5}$ |
| Ex. A-9 | 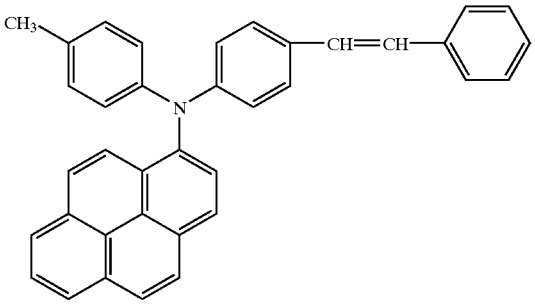 | 4 | $3.5 \times 10^{-5}$ |

TABLE 37-continued
| | | | |
|---|---|---|---|
| Ex. A-10 | 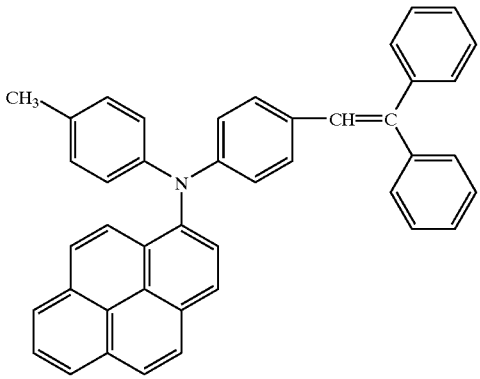 | 4 | $2.8 \times 10^{-5}$ |
| Ex. A-11 | 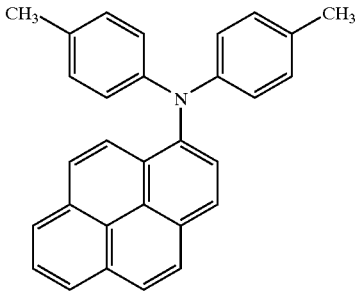 | 4 | $1.5 \times 10^{-5}$ |
| Ex. A-12 | 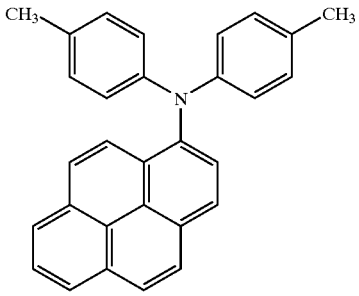 | 4 | $1.1 \times 10^{-5}$ |
| Ex. A-13 | 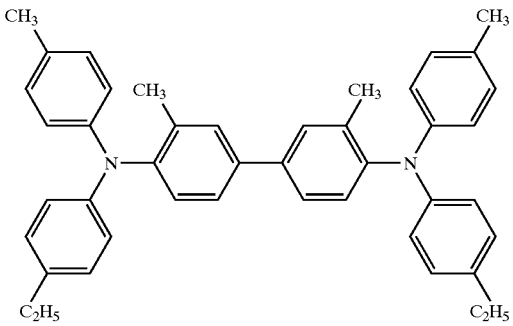 | 4 | $1.1 \times 10^{-5}$ |

TABLE 38
| | | | |
|---|---|---|---|
| Ex. A-14 | 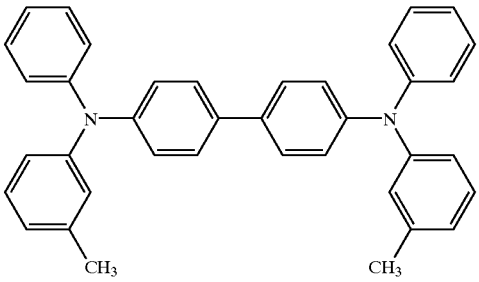 | 6 | $1.7 \times 10^{-5}$ |
| Ex. A-15 | 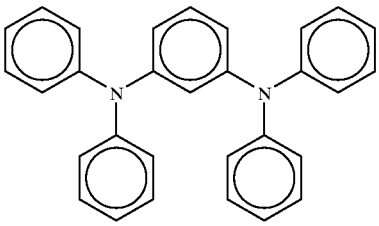 | 4 | $1.1 \times 10^{-5}$ |
| Ex.A-16 | 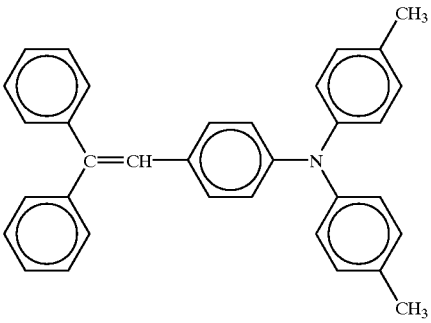 | 6 | $8.0 \times 10^{-5}$ |
| Ex. A-17 | 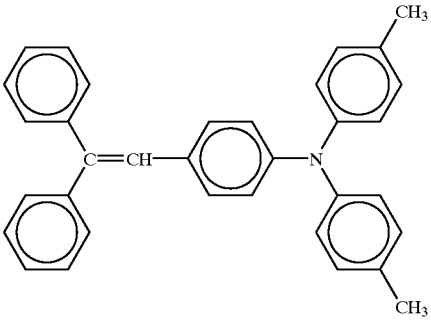 | 8 | $2.0 \times 10^{-5}$ |
| Comp. Ex. A-1 | 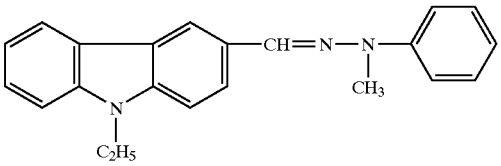 | 4 | $0.07 \times 10^{-5}$ |
| Comp. Ex. A-2 | 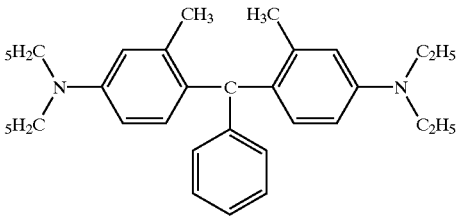 | 4 | $0.4 \times 10^{-5}$ |

TABLE 38-continued

| | | | |
|---|---|---|---|
| Comp. Ex. A-3 | 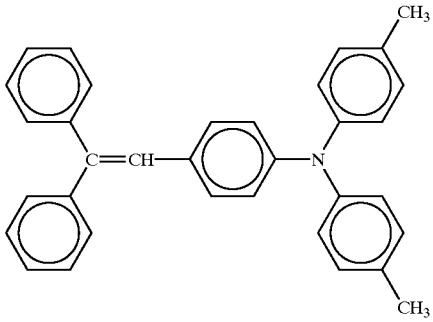 | 3 | $0.42 \times 10^{-5}$ |

Image evaluation was performed for each of the photoconductors thus produced in Examples A-1 to 17 and Comparative Examples A-1 to 3 by using the image forming apparatus obtained by modifying MF4570 manufactured by Ricoh Co., Ltd. for a 2-bit and 1200-dpi write operation. An image was outputted with a beam diameter of 35 $\mu$m, a writing density of 1200 GSL, and a halftoning operation using the number of lines maintained at a level of 200 lpi.

TABLE 39

| | Tone R^2 | | Tone R^2 |
|---|---|---|---|
| Ex. A-1 | 0.983 | Ex. A-11 | 0.985 |
| Ex. A-2 | 0.985 | Ex. A-12 | 0.984 |
| Ex. A-3 | 0.985 | Ex. A-13 | 0.984 |
| Ex. A-4 | 0.984 | Ex. A-14 | 0.985 |
| Ex. A-5 | 0.985 | Ex. A-15 | 0.983 |
| Ex. A-6 | 0.984 | Ex. A-16 | 0.989 |
| Ex. A-7 | 0.986 | Ex. A-17 | 0.990 |
| Ex. A-8 | 0.985 | Comp. Ex. A-1 | 0.965 |
| Ex. A-9 | 0.988 | Comp. Ex. A-2 | 0.974 |
| Ex. A-10 | 0.987 | Comp. Ex. A-3 | 0.975 |

EXAMPLES A-18 to 24 AND COMPARATIVE EXAMPLES A-4 to 7

An image was outputted and the image qualities were evaluated in the same manner as in Example A-2 except that the film thickness of the charge transporting layer of the photoconductor, a system of written dots during exposure, and a writing density used in Example A-2 were changed as shown in Table 40. In a halftoning operation, an image was outputted by maintaining the number of lines not only at a level of 200 lpi but also at a level of 240 lpi and evaluated. The results of image-quality evaluation are shown in Table 41.

TABLE 40

| | writing density (dpi) | Film-Thickness of Charge Transport Layer (mm) | writing beam diameter (mm) |
|---|---|---|---|
| Ex. A-18 | 1200 | 26 | 25 |
| Comp. Ex. A-4 | 1200 | 26 | 45 |
| Ex. A-19 | 1200 | 20 | 25 |
| Ex. A-20 | 1200 | 20 | 35 |
| Comp. Ex. A-5 | 1200 | 20 | 45 |
| Ex. A-21 | 1800 | 26 | 25 |
| Ex. A-22 | 1800 | 26 | 35 |
| Comp. Ex. A-6 | 1800 | 26 | 45 |
| Ex. A-23 | 1800 | 20 | 25 |

TABLE 40-continued

| | writing density (dpi) | Film-Thickness of Charge Transport Layer (mm) | writing beam diameter (mm) |
|---|---|---|---|
| Ex. A-24 | 1800 | 20 | 35 |
| Comp. Ex. A-7 | 1800 | 20 | 45 |

TABLE 41

| | Tone R^2 | | | Tone R^2 | |
|---|---|---|---|---|---|
| | 200 lpi | 240 lpi | | 200 lpi | 240 lpi |
| Ex. A-18 | 0.988 | 0.985 | Ex. A-24 | 0.986 | 0.975 |
| Ex. A-19 | 0.991 | 0.988 | COMP. Ex. A-4 | 0.974 | 0.955 |
| Ex. A-20 | 0.988 | 0.978 | COMP. Ex. A-5 | 0.979 | 0.960 |
| Ex. A-21 | 0.985 | 0.983 | COMP. Ex. A-6 | 0.971 | 0.950 |
| Ex. A-22 | 0.982 | 0.972 | COMP. Ex. A-7 | 0.978 | 0.958 |
| Ex. A-23 | 0.989 | 0.986 | | | |

EXAMPLES A-25 to 31 AND COMPARATIVE EXAMPLES A-8 to 11

An image was outputted and the image qualities were evaluated in the same manner as in Example A-5 except that the film thickness of the charge transporting layer of the photoconductor, a system of written dots during exposure, and a writing density used in Example A-5 were changed as shown in Table 42. In a halftoning operation, an image was outputted by maintaining the number of lines not only at a level of 200 lpi but also at a level of 240 lpi and evaluated. The results of image-quality evaluation are shown in Table 43.

TABLE 42

| | writing density (dpi) | Film-Thickness of Charge Transport Layer (mm) | writing beam diameter (mm) |
|---|---|---|---|
| Ex. A-25 | 1200 | 26 | 25 |
| Comp. Ex. A-8 | 1200 | 26 | 45 |
| Ex. A-26 | 1200 | 20 | 25 |
| Ex. A-27 | 1200 | 20 | 35 |
| Comp. Ex. A-9 | 1200 | 20 | 45 |
| Ex. A-28 | 1800 | 26 | 25 |
| Ex. A-29 | 1800 | 26 | 35 |
| Comp. Ex. A-10 | 1800 | 26 | 45 |
| Ex. A-30 | 1800 | 20 | 25 |

TABLE 42-continued

| | writing density (dpi) | Film-Thickness of Charge Transport Layer (mm) | writing beam diameter (mm) |
|---|---|---|---|
| Ex. A-31 | 1800 | 20 | 35 |
| Comp. Ex. A-11 | 1800 | 20 | 45 |

TABLE 43

| | Tone R^2 | | | Tone R^2 | |
|---|---|---|---|---|---|
| | 200 lpi | 240 lpi | | 200 lpi | 240 lpi |
| Ex. A-25 | 0.988 | 0.985 | Ex. A-31 | 0.985 | 0.976 |
| Ex. A-26 | 0.991 | 0.989 | COMP. Ex. A-8 | 0.974 | 0.956 |
| Ex. A-27 | 0.989 | 0.980 | COMP. Ex. A-9 | 0.979 | 0.960 |
| Ex. A-28 | 0.986 | 0.983 | COMP. Ex. A-10 | 0.973 | 0.951 |
| Ex. A-29 | 0.983 | 0.974 | COMP. Ex. A-11 | 0.978 | 0.959 |
| Ex. A-30 | 0.990 | 0.987 | | | |

EXAMPLES A-32 to 38 AND COMPARATIVE EXAMPLES A-12 to 15

An image was outputted and the image qualities were evaluated in the same manner as in Example A-10 except that the film thickness of the charge transporting layer of the photoconductor, a system of written dots during exposure, and a writing density used in Example A-10 were changed as shown in Table 44. In a halftoning operation, an image was outputted by maintaining the number of lines not only at a level of 200 lpi but also at a level of 240 lpi and evaluated. The results of image-quality evaluation are shown in Table 45.

TABLE 44

| | writing density (dpi) | Film-Thickness of Charge Transport Layer (mm) | writing beam diameter (mm) |
|---|---|---|---|
| Ex. A-32 | 1200 | 26 | 25 |
| Comp. Ex. A-12 | 1200 | 26 | 45 |
| Ex. A-33 | 1200 | 20 | 25 |
| Ex. A-34 | 1200 | 20 | 35 |
| Comp. Ex. A-13 | 1200 | 20 | 45 |
| Ex. A-35 | 1800 | 26 | 25 |
| Ex. A-36 | 1800 | 26 | 35 |
| Comp. Ex. A-14 | 1800 | 26 | 45 |
| Ex. A-37 | 1800 | 20 | 25 |
| Ex. A-38 | 1800 | 20 | 35 |
| Comp. Ex. A-15 | 1800 | 20 | 45 |

TABLE 45

| | Tone R^2 | | | Tone R^2 | |
|---|---|---|---|---|---|
| | 200 lpi | 240 lpi | | 200 lpi | 240 lpi |
| Ex. A-32 | 0.988 | 0.985 | Ex. A-38 | 0.987 | 0.976 |
| Ex. A-33 | 0.992 | 0.989 | COMP. Ex. A-12 | 0.975 | 0.957 |
| Ex. A-34 | 0.989 | 0.982 | COMP. Ex. A-13 | 0.979 | 0.962 |
| Ex. A-35 | 0.986 | 0.983 | COMP. Ex. A-14 | 0.974 | 0.952 |
| Ex. A-36 | 0.983 | 0.974 | COMP. Ex. A-15 | 0.977 | 0.960 |
| Ex. A-37 | 0.990 | 0.987 | | | |

EXAMPLES A-39 to 45 AND COMPARATIVE EXAMPLES A-16 to 19

An image was outputted and the image qualities were evaluated in the same manner as in Example A-11 except that the film thickness of the charge transporting layer of the photoconductor, a system of written dots during exposure, and a writing density used in Example A-11 were changed as shown in Table 46. In a halftoning operation, an image was outputted by maintaining the number of lines not only at a level of 200 lpi but also at a level of 240 lpi and evaluated. The results of image-quality evaluation are shown in Table 47.

TABLE 46

| | writing density (dpi) | Film-Thickness of Charge Transport Layer (mm) | writing beam diameter (mm) |
|---|---|---|---|
| Ex. A-39 | 1200 | 26 | 25 |
| Comp. Ex. A-16 | 1200 | 26 | 45 |
| Ex. A-40 | 1200 | 20 | 25 |
| Ex. A-41 | 1200 | 20 | 35 |
| Comp. Ex. A-17 | 1200 | 20 | 45 |
| Ex. A-42 | 1800 | 26 | 25 |
| Ex. A-43 | 1800 | 26 | 35 |
| Comp. Ex. A-18 | 1800 | 26 | 45 |
| Ex. A-44 | 1800 | 20 | 25 |
| Ex. A-45 | 1800 | 20 | 35 |
| Comp. Ex. A-19 | 1800 | 20 | 45 |

TABLE 47

| | Tone R^2 | | | Tone R^2 | |
|---|---|---|---|---|---|
| | 200 lpi | 240 lpi | | 200 lpi | 240 lpi |
| Ex. A-39 | 0.988 | 0.985 | Ex. A-45 | 0.985 | 0.977 |
| Ex. A-40 | 0.990 | 0.988 | COMP. Ex. A-16 | 0.974 | 0.955 |
| Ex. A-41 | 0.988 | 0.978 | COMP. Ex. A-17 | 0.979 | 0.959 |
| Ex. A-42 | 0.985 | 0.983 | COMP. Ex. A-18 | 0.973 | 0.950 |
| Ex. A-43 | 0.982 | 0.973 | COMP. Ex. A-19 | 0.978 | 0.958 |
| Ex. A-44 | 0.989 | 0.986 | | | |

EXAMPLES A-46 to 52 AND COMPARATIVE EXAMPLES A-20 to 23

An image was outputted and the image qualities were evaluated in the same manner as in Example A-14 except that the film thickness of the charge transporting layer of the photoconductor, a system of written dots during exposure, and a writing density used in Example A-14 were changed as shown in Table 48. In a halftoning operation, an image was outputted by maintaining the number of lines not only at a level of 200 lpi but also at a level of 240 lpi and evaluated. The results of image-quality evaluation are shown in Table 49.

TABLE 48

| | writing density (dpi) | Film-Thickness of Charge Transport Layer (mm) | writing beam diameter (mm) |
|---|---|---|---|
| Ex. A-46 | 1200 | 26 | 25 |
| Comp. Ex. A-20 | 1200 | 26 | 45 |
| Ex. A-47 | 1200 | 20 | 25 |
| Ex. A-48 | 1200 | 20 | 35 |
| Comp. Ex. A-21 | 1200 | 20 | 45 |
| Ex. A-49 | 1800 | 26 | 25 |
| Ex. A-50 | 1800 | 26 | 35 |
| Comp. Ex. A-22 | 1800 | 26 | 45 |
| Ex. A-51 | 1800 | 20 | 25 |
| Ex. A-52 | 1800 | 20 | 35 |
| Comp. Ex. A-23 | 1800 | 20 | 45 |

TABLE 49

| | Tone R^2 | | | Tone R^2 | |
|---|---|---|---|---|---|
| | 200 lpi | 240 lpi | | 200 lpi | 240 lpi |
| Ex. A-46 | 0.987 | 0.985 | Ex. A-52 | 0.985 | 0.975 |
| Ex. A-47 | 0.990 | 0.988 | COMP. Ex. A-20 | 0.974 | 0.955 |
| Ex. A-48 | 0.988 | 0.978 | COMP. Ex. A-21 | 0.979 | 0.960 |
| Ex. A-49 | 0.985 | 0.983 | COMP. Ex. A-22 | 0.972 | 0.950 |
| Ex. A-50 | 0.982 | 0.972 | COMP. Ex. A-23 | 0.978 | 0.958 |
| Ex. A-51 | 0.989 | 0.986 | | | |

EXAMPLES A-53 to 59 AND COMPARATIVE EXAMPLES A-24 to 27

An image was outputted and the image qualities were evaluated in the same manner as in Example A-15 except that the film thickness of the charge transporting layer of the photoconductor, a system written dots during exposure, and a writing density used in Example A-15 were changed as shown in Table 50. In a halftoning operation, an image was outputted by maintaining the number of lines not only at a level of 200 lpi but also at a level of 240 lpi and evaluated. The results of image-quality evaluation are shown in Table 51.

TABLE 50

| | writing density (dpi) | Film-Thickness of Charge Transport Layer (mm) | writing beam diameter (mm) |
|---|---|---|---|
| Ex. A-53 | 1200 | 26 | 25 |
| Comp. Ex. A-24 | 1200 | 26 | 45 |
| Ex. A-54 | 1200 | 20 | 25 |
| Ex. A-55 | 1200 | 20 | 35 |
| Comp. Ex. A-25 | 1200 | 20 | 45 |
| Ex. A-56 | 1800 | 26 | 25 |
| Ex. A-57 | 1800 | 26 | 35 |
| Comp. Ex. A-26 | 1800 | 26 | 45 |
| Ex. A-58 | 1800 | 20 | 25 |
| Ex. A-59 | 1800 | 20 | 35 |
| Comp. Ex. A-27 | 1800 | 20 | 45 |

TABLE 51

| | Tone R^2 | | | Tone R^2 | |
|---|---|---|---|---|---|
| | 200 lpi | 240 lpi | | 200 lpi | 240 lpi |
| Ex. A-53 | 0.986 | 0.983 | Ex. A-59 | 0.984 | 0.974 |
| Ex. A-54 | 0.989 | 0.986 | COMP. Ex. A-24 | 0.972 | 0.953 |
| Ex. A-55 | 0.987 | 0.978 | COMP. Ex. A-25 | 0.978 | 0.958 |
| Ex. A-56 | 0.984 | 0.981 | COMP. Ex. A-26 | 0.971 | 0.949 |
| Ex. A-57 | 0.981 | 0.972 | COMP. Ex. A-27 | 0.977 | 0.956 |
| Ex. A-58 | 0.988 | 0.984 | | | |

From the aforementioned results, the following findings were made.

In Examples A, tonalities (R^2) were measured by using the photoconductors having various carrier nobilities (which are $1\times10^{-5}$ $cm^2\cdot V^{-1}\cdot sec^{-1}$ or more in Examples A) under an electric field of $3\times10^5$ $V\cdot cm^{-1}$. As is apparent from the result, an image with excellent tone can be formed without reducing the film thickness of the charge transporting layer provided that the charge transporting layer 37 has a carrier mobility of $1\times10^{-5}$ $cm^2\cdot V^{-1}\cdot sec^{-1}$ under an electric field of $3\times10^5$ $V\cdot cm^{-1}$.

Figure 12:
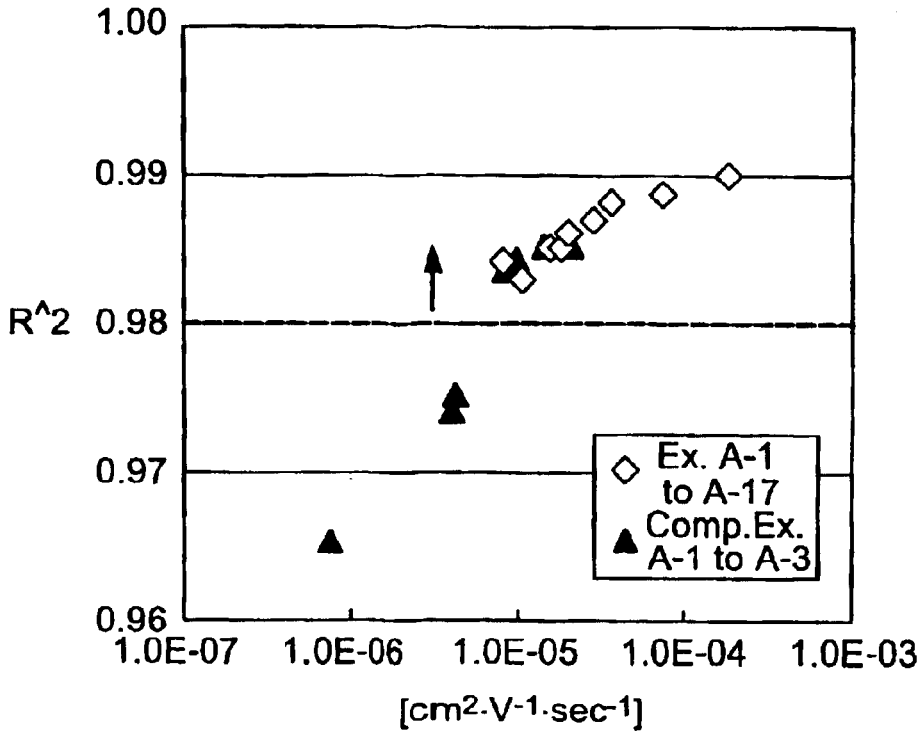
FIG. 12 is a view showing a relationship between the carrier mobility of a charge transporting layer and tone in Examples A-1 to 17 and COMPARATIVE Examples A-1 to 3.

The results of Table 39 are plotted in FIG. 12.

From FIG. 12, it will be understood that the carrier mobility of the charge transporting layer which is $1\times10^{-5}$ $cm^2\cdot V^{-1}\cdot sec^{-1}$ or more is a criterion which satisfies a requirement that a γ-linearity indicative of tone be 0.98 or more.

The following findings were also made as a result of referring to Table 40 to 51.

It was found that a high-quality image was obtainable by reducing the film thickness of the charge transporting layer.

It was also found that the image quality was further improved by adjusting the content of the charge transporting substance in the charge transporting layer to 40% by weight or more and to 50% by weight or more with respect to a total amount of the charge transporting layer.

It was also found that the charge transporting layer 37 having the carrier mobility mentioned above was producible by using a compound having a triarylamine structure, preferably a compound expressed by any of the structural formulae (A-I) to (A-VI). By using such a compound, the charge transporting layer 37 was produced without involving the problem of crystallization or the like.

In short, it was proved that the following conditions should be satisfied to adjust the value of tone R^2 to 0.98 or more and implement a photoconductor with higher durability in each of an electrophotographic image forming apparatus in which the resolution of an optical write operation is 1200 dpi or more and an electrophotographic image forming apparatus in which an optical write operation is performed based on image data obtained by performing a halftoning operation using the number of lines of 200 lpi or more with respect to an input image.

(1) Optical means irradiates the photoconductor with a light beam having a diameter of 35 μm or less.

(2) A photoconductor is composed of at least a charge generating layer containing a charge generating substance and a charge transporting layer containing a charge transporting substance which are provided on a conductive support and the charge transporting layer has a carrier mobility of $1\times10^{-5}$ $cm^2\cdot V^{-1}\cdot sec^{-1}$ or more under an electric field of $3\times10^5$ $V\cdot cm^{-1}$.

In addition to tone evaluation, the present inventors also evaluated the item of stable tone reproduction (hereinafter referred to as tone reproduction stability).

First, a set of 17 patches processed with a halftoning operation are outputted in the same manner as in the image-quality evaluation method. In this case, not one but five images are outputted. Then, the respective lightnesses (L*) of the patches are measured by colorimetry by using a spectro-densito/colori-meter. At that time, colorimetry is performed with respect to the five output images. As a result, five lightness values corresponding to the five output images are determined for each of the patches. If the five lightness values coincide, they indicate that the output images are equal and reproducibility is high.

Figure 13:
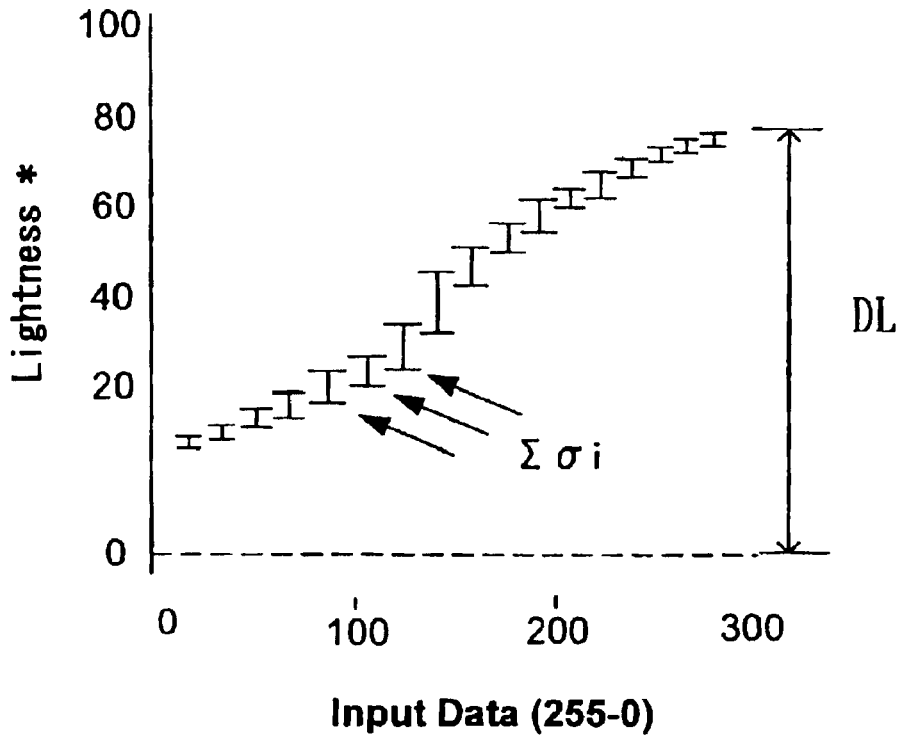
FIG. 13 is a view illustrating an example of the definition of tone reproduction stability.

Then, a standard deviation is calculated from the five lightness values for each of the patches (calculation of 1 to σ17) and the total sum is calculated for all the 17 patches (calculation of a Σσi algebraic sum). Then, the tone reproduction stability (S) is defined by dividing the dynamic range (DL) of the lightness values of the output images by Σσi. The dynamic range (DL) is defined as the difference between a mean lightnesses value of the lightest patch (mean value of the lightnesses of the five output images) and a mean lightnesses value of the darkest patch (mean value of the lightnesses of the five output images) (FIG. 13).

$$S=DL/\Sigma\sigma i$$

$DL$=(Mean Lightnesses Value of Lightest Patch)−(Means Lightness Value of Darkest Patch)

By using an index thus defined by the inventors, i.e., the tone reproduction stability (S), it becomes possible to evaluate the degree of stability with which the tone of an output image is reproduced.

The evaluation of the tone reproduction stability (S) thus defined was tried by performing an image output experiment in each of Examples A-1, A-2, A-10, A-18, and A-22 and Comparative Examples A-2, and A-5. To each of the patches used in the image output experiment, a halftoning operation using 200 lpi had been performed. The results of the experiment was shown in the following table.

TABLE 52

| Ex. and Comp. Ex. No. | Tone Revival Stability (S) |
|---|---|
| Ex. A-1 | 12.7 |
| Ex. A-2 | 14.3 |
| Ex. A-10 | 15.6 |
| Ex. A-18 | 16.2 |
| Ex. A-22 | 12.1 |
| Comp. Ex. A-2 | 8.5 |
| Comp. Ex. A-5 | 9.8 |

As the value of the tone reproduction stability increases, it indicates that a more stable output is producible, as shown by the definition expression (since it indicates an extremely small variation in the lightness value of each of the patches).

It is assumed herein that, if the value of the tone reproduction stability (S) defined above is larger than 10, it indicates excellent tone reproduction (the reason for this is that, when an output image was visually inspected, a difference (difference in tone) between a plurality of output images was hardly recognizable. As a result of the image output experiment performed by the inventors, it was found that excellent tone reproduction stability was achievable in a combination of structures according to Examples A-1, A-2, A-10, A-18, and A-22, while sufficient tone reproduction stability was not achievable with a combination of structures according to Comparative Examples A-2 and A-5, which will be understood from the aforementioned Table.

From the experiment performed by the present inventors, it was proved that banding, which was among abnormal images, was reduced in a combination in which an optical write operation was performed with a laser beam having a diameter of 35 $\mu$m and the charge transporting layer of the photoconductor had a carrier mobility of $1\times10^{-5}$ $cm^2\cdot V^1\cdot sec^{-1}$ or more under an electric field of $3\times10^5$ $V\cdot cm^{-1}$. Banding is a so-called density variation in a main scanning direction (direction of travel of the paper) of an electrophotographic image.

In particular, banding is a phenomenon in which the density varies in stripes in a relatively long cycle (in a cycle of 1 to 20 mm) when an intermediate-density (Lightness $L^*=40$ to 70) uniform image is outputted. The occurrence of such a striped density variation in an output image gives an extremely unnatural impression so that it becomes a major factor which causes image-quality degradation.

As factors which cause banding, mention may be made of uneven scanning with a beam (a so-called face angle error of a polygon mirror or vibration of an optical element), inconsistent rotation speed of the photoconductive drum, inconsistent rotation speed of the development sleeve, and a variation in development gap (displacement of the photoconductive drum or the development sleeve). Improvements have been made by taking measures against these factors but, to utterly eliminate the factors, it is required to solidly fabricate the entire apparatus, increase the precision of each of the components, and the like. However, such requirements lead to a larger-size apparatus and higher cost and are therefore difficult to satisfy in reality.

The present inventors conducted an experiment in which uniform images satisfying Lightness $L^*=50$ were formed at 200 lpi and 240 lpi under the conditions of each of Examples A-1 to 59 and Comparative Examples A to 1 to 27 and banding was visually inspected. In the experiment, images subjected to banding evaluation described above were outputted by using the apparatus for the experiment described in Examples A. Subsequently, the images were visually evaluated by using the following criteria:

Rank 5: Banding is imperceptible at each of 200 lpi and 240 lpi

Rank 4: Banding is imperceptible at 200 lpi but subtly perceptible at 240 lpi.

Rank 3: Banding is subtly perceptible at 200 lpi (subtly perceptible even at 240 lpi).

Rank 2: Banding is distinctly perceptible at 200 lpi (distinctly perceptible even at 240 lpi).

Rank 1: Banding is conspicuous even at 200 lpi (conspicuous even at 200 lpi)

According to the result of the experiment conducted by the present inventors, banding is more conspicuous with a larger number of lines (more conspicuous at 240 lpi than at 200 lpi). This is why the aforementioned criteria focusing on an image at 200 lpi were set.

The results of evaluating banding in each of Examples A-1 to 59 and Comparative Examples A-1 to 27 are shown in the following table. A dither texture was no more perceived if the number of lines used in a halftoning operation was 200 lpi or more. Therefore, an image judged to be on Rank 4 or higher according to the aforementioned criteria is considered to have an acceptable level of quality.

TABLE 53

| Ex. No. | Banding Rank |
|---|---|
| A-1 | 4 |
| A-2 | 4 |
| A-3 | 4 |
| A-4 | 4 |
| A-5 | 4 |
| A-6 | 4 |
| A-7 | 4 |
| A-8 | 4 |
| A-9 | 4 |
| A-10 | 4 |
| A-11 | 4 |
| A-12 | 4 |
| A-13 | 4 |
| A-14 | 4 |
| A-15 | 4 |
| A-16 | 5 |
| A-17 | 5 |
| A-18 | 4 |
| A-19 | 5 |
| A-20 | 4 |
| A-21 | 4 |
| A-22 | 4 |
| A-23 | 4 |
| A-24 | 4 |
| A-25 | 4 |
| A-26 | 5 |
| A-27 | 5 |
| A-28 | 4 |
| A-29 | 5 |
| A-30 | 4 |
| A-31 | 4 |
| A-32 | 4 |
| A-33 | 5 |
| A-34 | 5 |
| A-35 | 4 |
| A-36 | 4 |
| A-37 | 5 |
| A-38 | 4 |
| A-39 | 4 |
| A-40 | 5 |
| A-41 | 4 |
| A-42 | 4 |

TABLE 53-continued

| | |
|---|---|
| A-43 | 4 |
| A-44 | 5 |
| A-45 | 4 |
| A-46 | 4 |
| A-47 | 4 |
| A-48 | 4 |
| A-49 | 4 |
| A-50 | 4 |
| A-51 | 5 |
| A-52 | 4 |
| A-53 | 4 |
| A-54 | 5 |
| A-55 | 4 |
| A-56 | 4 |
| A-57 | 4 |
| A-58 | 4 |
| A-59 | 4 |

| Comp. Ex. No. | Banding Rank |
|---|---|
| A-1 | 1 |
| A-2 | 2 |
| A-3 | 2 |
| A-4 | 2 |
| A-5 | 3 |
| A-6 | 2 |
| A-7 | 3 |
| A-8 | 2 |
| A-9 | 3 |
| A-10 | 2 |
| A-11 | 3 |
| A-12 | 2 |
| A-13 | 3 |
| A-14 | 2 |
| A-15 | 3 |
| A-16 | 2 |
| A-17 | 3 |
| A-18 | 2 |
| A-19 | 3 |
| A-20 | 2 |
| A-21 | 3 |
| A-22 | 2 |
| A-23 | 3 |
| A-24 | 2 |
| A-25 | 3 |
| A-26 | 2 |
| A-27 | 3 |

From the results of the experiment, it will be appreciated that an image forming apparatus capable of successfully preventing banding, which is a type of abnormal image, can be implemented if an optical write operation is performed with a laser beam having a diameter of 35 $\mu$m and if the charge transporting layer of the photoconductor has a carrier mobility of $1\times10^{-5}$ $cm^2\cdot V^{-1}\cdot sec^{-1}$ or more under an electric field of $3\times10^5$ $V\cdot cm^{-1}$.

In each of Examples A-1 to 12, an image forming apparatus free of banding can be implemented without increasing the size and cost of the apparatus.

While the present invention has been described in its preferred embodiments, it is to be understood that the embodiments described herein are merely exemplary of the invention and not restrictive of the scope of the invention. Therefore, those skilled in the art may practice the invention in various other forms obtained by making many variations and modifications to the embodiments without departing from the spirit of the invention.

As is apparent from the aforementioned description, both of high image qualities and a photoconductor with high durability are obtainable if settings are made to satisfy the conditions placed on the combination of the structure of a writing system (resolution of a write operation, the number of lines, or the diameter of a beam) and the structure of a photoconductor (prescriptions for a charge transporting layer).

EXAMPLES B

The image forming apparatus according to the third and fourth aspects of the present invention will be described herein below in greater detail by using examples. However, the construction of the present invention is not limited to the examples.

EXAMPLE B-I

An image forming apparatus produced in Example B-I will be described schematically by using FIG. 1.

The photoconductive drum 1 has a photoconductor with a film thickness of 20 $\mu$m provided on a surface of a conductor made of aluminum. The photoconductor is a multilayer electrophotographic photoconductor (OPC) having the protection layer 39, the charge transporting layer 37, an undercoat layer, and the charge generating layer 35 and is rotated in the direction indicated by the arrow in FIG. 1. The diameter of the photoconductive drum 1 was set to 60 mm and the circumferential speed thereof was set to 230 mm/sec.

As the charging means 2, a so-called contact roller charger was used. A dc voltage (−1.21 kV) is applied from a power supply to a charging roller composed of an elastic layer having a thickness of 3 mm and so-called intermediate-resistance conductivity which is formed on a cored bar, thereby uniformly charging the photoconductor (−550 V).

The exposing means 3 irradiates a surface of the photoconductor charged uniformly by the charging means 2 with light corresponding to an objective image and thereby forms a latent electrostatic image thereon. A light source for the exposing means 3 is a laser diode which scans the surface of the photoconductor by using a polygon mirror, while irradiating the surface of the photoconductor with a laser beam. The diameter of the beam was 35 $\mu$m in the main scanning direction and 35 $\mu$m in the subordinate scanning direction.

FIG. 6 is a structural view of the exposing means 3. As shown in FIG. 6, the exposing means 3 has an LD array of 4-ch (4-channel) type having four LDs (laser diodes) 51 at a wavelength of 780 nm mounted thereon. The laser beam from the LD is applied to the polygon mirror 56 via a collimator lens 52, the ND filter 53, the aperture 54, and the cylindrical lens (cylinder lens) 55. As the polygon mirror 56, a hexahedral type was used and rotated at the number of revolutions of 2716.5 rpm.

The laser beam is reflected by the polygon mirror 56 to form an image on the photoconductor via the return mirrors 58 and 59 and the f-θ lenses 57 and 60.

In Example B-1, the diameter of the laser beam was adjusted to 35 $\mu$m (in the main scanning direction)×35 $\mu$m (in the subordinate scanning direction) on the photoconductor. As the f-θ lenses 56 and 57, plastic lenses each formed from a molded plastic were used and the configuration of each of the lenses was designed with a so-called A-C plane, whereby an extremely small beam diameter of 35 $\mu$m (in the main scanning direction)×35 $\mu$m (in the subordinate scanning direction) was implemented.

In Example B-1, the laser beam scans the surface of the photoconductor with the rotation of the polygon mirror 56. In Example B-1, the resolution was set to 1200 dpi and the dimensions of one pixel were set to 21.3 $\mu$m×21.3 $\mu$m. That is, the laser beam was applied to the photoconductor, while it was moved at a rate of 16.9 nsec per pixel. A so-called pixel clock was adjusted to 59.2 MHz and the LD was optically modulated at a frequency of 59.2 MHz.

A synchronous detection plate 12 was constructed such that, if the laser beam was applied to a non-image region, it was incident thereon. The synchronous detection plate 12 generates a reference signal in response to the incidence of the laser beam and resets a clock signal forming a timing (so-called pixel clock) for a position at which an image is written based on the reference signal. This allowed the laser beam that had been optically modulated to be incident on a specified position on the photoconductor.

In Example B-1, such a multi-value write operation is performed by changing the pulse width of the LD in four levels such that four-tone reproduction, i.e., so-called quaternary writing which allowed four-tone reproduction of each pixel was performed.

As the developing means 4, a so-called two-component development unit was used. The development vessel of the development unit was filled with a developer prepared by mixing a toner (with a volume average particle diameter of 6.8 μm) with a carrier (with a particle diameter of 50 μm) such that a toner concentration of 5.0% was achieved.

The development unit 4 carries the developer to the portion of the photoconductor opposing the development sleeve by means of the development sleeve. The distance (a so-called development gap) between the photoconductor and the development sleeve was adjusted to 0.3 mm. A dc voltage (−400 V) was applied from the power supply to the development sleeve. As a result, the toner adhered to the photoconductor in correspondence with the latent electrostatic image (reversal development) on the photoconductor. The circumferential speed of the development sleeve was set to 460 nm/sec so that a so-called circumferential speed ratio was 2.0.

The transferring means 5 transfers a toner image developed by the developing means 4 from paper feeding means not shown to the recording sheet 6 that had been carried. As the transferring means 5 according to Example B-1, a unit composed of a transfer belt and a power supply and applying a voltage from the power supply to the transfer belt was used. The applied voltage was controlled with a constant current of 30 μA.

The cleaning means 7 is composed of a blade made of an elastic material and performs cleaning of a residual toner image (so-called toner left untransferred) from the surface of the photoconductor.

The toner image transferred onto the recording sheet such as paper by the transferring means 5 is carried to the fixing means 8 and fixed onto the recording sheet with the application of heat and pressure by the fixing means 8. The recording sheet is discharged from the image forming apparatus.

The image forming apparatus used in Example B-1 forms an image on the recording sheet by successively performing the aforementioned process with the rotation of the photoconductive drum 1.

A detailed description will be given next to a method for producing the photoconductor used in Example B-1. It is defined herein that each of "parts" used below indicates "a part by weight". The ionization potential Ip of the charge transporting substance was measured by using a surface analyzer (AC-1 manufactured by Riken Keiki Co., Ltd.).

Specifications for Photoconductor

A coating liquid for the undercoat layer, a coating liquid for the charge generating layer 35, and a coating liquid for the charge transporting layer 37 having the following compositions were coated successively by dip coating on an aluminum cylinder having a diameter of ϕ60 and dried so that the undercoat layer with a film thickness of 3.5 μm, the charge generating layer with a film thickness of 0.2 μm, and the charge transporting layer with a thickness of 15 μm were formed.

Coating Liquid for Undercoat Layer

Titanium Dioxide Powder: 400 parts

Melamine Resin: 65 parts

Alkyd Resin: 120 parts

2-Buthanone: 400 parts

Coating Liquid for Charge Generating Layer 35

Y-Oxotitanium Phthalocyanine Pigment: 2 parts

Polyvinyl Butyral: (S-LEC BM-2: manufactured by Sekisui Chemical Co., Ltd.): 1.0 part Tetrahydrofuran: 50 parts Coating Liquid for Charge Transporting Layer 37

Polycarbonate (Z Polyka, Manufactured by Teijin Chemicals Ltd.): 10 parts

Charge transporting substance expressed by following structural formula (B-XI) (Ip: 5.4 eV): 6 parts Tetrahydrofuran: 100 parts

[Structural formula (B-XI)]

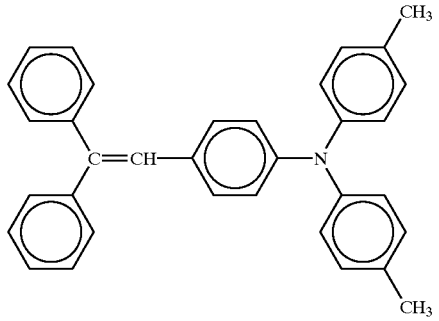

A coating liquid for the protection layer 39 having the following composition was further coated by spray coating on the charge transporting layer 35 to form a protection layer having a total film thickness of 5 μm, whereby the photoelectric photoconductor was produced.

Coating Liquid for Protection Layer 39 . . . Protection Layer 39 with 95% Transmittance Alumina (Average Primary Particle Diameter: 0.3 μm, Manufactured by Sumitomo Chemical Co., Ltd.): 3.0 parts (Refractive Index: 1.76, pH: 5.5)

Unsaturated Polycarboxylic Acid Polymer (Acid Value 180 mgKOH/g, Manufactured by BYK-Chemie GmbH): 0.06 parts Charge transporting substance Expressed by Aforementioned Structural formula (B-XI): 5.0 parts Polycarbonate (Z Polika, Manufactured by Teijin Chemicals Ltd.): 7.0 parts Tetrahydrofuran: 230 parts Cyclohexane: 70 parts Image-Quality Evaluation Method Image-quality evaluation was performed by measuring tone which greatly affects image qualities.

The evaluation of tone was performed by outputting a set of 17 patches processed with a halftoning operation while varying the number of lines and measuring the lightnesses (L*) of the patches. Halftoning operations were performed by using the numbers of lines of 150 lpi, 200 lpi, and 240 lpi.

For the measurement of the lightness (L*), a spectrodensito/colori-meter (938 manufactured by X-Rite Ltd.) was used.

Numerification of the tone was effected by calculating the square (so-called R^2) of an autocorrelation coefficient obtained through the approximation of a linear expression from the linearity of lightness values obtained by performing colorimetry with respect to the set of 17 patches relative to input (area ratio on data). If the relationship between the aforementioned input data and the lightnesses (L*) is linear, the value of R^2 is close to 1.0, as shown in FIG. 10. As the relationship becomes less linear, the value of R^2 becomes smaller, as shown in FIG. 11.

As a result of preliminarily evaluating an image of which high tone is required, such as a natural image, from a personal point of view, the present inventors have determined that the evaluated image had excellent qualities if a R^2 value is 0.98 or more.

The value of R^2 tends to be higher on a so-called low-line-number image. It was found that, if the number of lines is 200 lpi or less, the user recognized a so-called dither texture so that an image obtained gave an unnatural impression to the user. This is why the inventors had determined that an image had high qualities if a tone value R^2 was 0.98 or more when the number of lines used in a halftoning operation is 200 or more.

The result of evaluation is shown in Table 2.

On the other hand, a recording density influences the image qualities of a character/line drawing and exerts a particularly great influence on a jaggy property. A writing density at which the jaggy becomes indistinct is normally 900 dpi or more, preferably 1200 dpi or more.

Accordingly, the present inventors outputted an image by using the photoconductor to an image forming apparatus (manufactured by Ricoh Co., Ltd. under the trade name of MF4570) which had been modified to be capable of performing a 2-bit write operation and set to a resolution of 1200 dpi.

The beam diameter was measured by using Beamscan manufactured by PHOTON, Inc. and the film thickness of the photoconductor was measured by using FISHERSCOPE, which is a thickness gage manufactured by Fisher Technology, Inc.

Evaluation is shown in Table 2.

EXAMPLES B-2 to 8 AND COMPARATIVE EXAMPLES B-1 to 12

An image was outputted and the image qualities were evaluated in the same manner as in Example B-1 except that the thickness of the charge transporting layer of the photoconductor, the transmittance of the protection layer (the prescriptions thereof will be shown later), a system of written dots during exposure, and the writing density used in Example B-1 were changed as shown in Table 54.

TABLE 54

| | writing density (dpi) | Film-Thickness of Charge Transport Layer (mm) | light-transmittance of protection layer | writing beam diameter (mm) |
|---|---|---|---|---|
| Ex. A-2 | 1200 | 10 | 95 | 35 |
| Comp. Ex. A-1 | 1200 | 10 | 95 | 45 |
| Ex. A-3 | 1200 | 15 | 95 | 25 |
| Ex. A-1 | 1200 | 15 | 95 | 35 |
| Comp. Ex. A-2 | 1200 | 15 | 95 | 45 |
| Ex. A-4 | 1200 | 15 | 98 | 35 |
| Comp. Ex. A-3 | 1200 | 15 | 85 | 35 |
| Comp. Ex. A-4 | 1200 | 20 | 95 | 25 |
| Comp. Ex. A-5 | 1200 | 20 | 95 | 35 |
| Comp. Ex. A-6 | 1200 | 25 | 95 | 35 |
| Ex. A-5 | 1800 | 10 | 95 | 35 |
| Comp. Ex. A-7 | 1800 | 10 | 95 | 45 |
| Ex. A-6 | 1800 | 15 | 95 | 25 |
| Ex. A-7 | 1800 | 15 | 95 | 35 |
| Comp. Ex. A-8 | 1800 | 15 | 95 | 45 |

TABLE 54-continued

| | writing density (dpi) | Film-Thickness of Charge Transport Layer (mm) | light-transmittance of protection layer | writing beam diameter (mm) |
|---|---|---|---|---|
| Ex. A-8 | 1800 | 15 | 98 | 35 |
| Comp. Ex. A-9 | 1800 | 15 | 85 | 35 |
| Comp. Ex. A-10 | 1800 | 20 | 95 | 25 |
| Comp. Ex. A-11 | 1800 | 20 | 95 | 35 |
| Comp. Ex. A-12 | 1800 | 25 | 95 | 35 |

The protection layer 39 with a 98% transmittance (Protection Layer Transmittance) and the protection layer 39 with a 85% transmittance were produced by using coating liquids for the protection layers 39 having the following compositions in the same manner as in Example B-1.

Images were formed by using the produced image forming apparatus in the same manner as in Example B-1 and the images obtained were evaluated in the same manner as in Example B-1. The results of image-quality evaluation in Examples B-2 to 8 and Comparative Examples B-1 to 12 are shown in Table 55.

Coating Liquid for Protection Layer 39 with 98% Transmittance Silica (Average Primary Particle Diameter: 0.3 μm, Sumitomo Chemical Co., Ltd.): 3.0 parts (Refractive Index: 1.54, pH: 5.0)

Unsaturated Polycarboxylic Acid Polymer (Acid Value 180 mgKOH/g, manufactured by BYK-Chemie GmbH): 0.06 parts Charge transporting substance expressed by the aforementioned structural formula (B-XI): 5.0 parts Polycarbonate (Z Polika, Manufactured by Teijin Chemicals Ltd.): 7.0 parts Tetrahydrofuran: 230 parts Cyclohexane: 70 parts Coating Liquid for Protection Layer 39 with 85% Transmittance Titanium Oxide (Average Primary Particle Diameter: 0.25 μm, Manufactured by Ishihara Sangyo Kaisha, Ltd.): 1.5 parts (Refractive Index: 2.71, pH: 6.4)

Unsaturated Polycarboxylic Acid Polymer (Acid Value 180 mgKOH/g, Manufactured by BYK-Chemie GmbH): 0.06 parts Charge transporting substance Expressed by Aforementioned Structural formula (B-XI): 5.0 parts Polycarbonate (Z Polika, Manufactured by Teijin Chemicals Ltd.): 7.0 parts Tetrahydrofuran: 230 parts Cyclohexane: 70 parts

TABLE 55

| | Tone R^2 | | |
|---|---|---|---|
| | 150 lpi | 200 lpi | 240 lpi |
| Ex. B-1 | 0.990 | 0.984 | 0.975 |
| Ex. B-2 | 0.995 | 0.990 | 0.983 |
| Ex. B-3 | 0.995 | 0.990 | 0.981 |
| Ex. B-4 | 0.990 | 0.984 | 0.976 |
| Ex. B-5 | 0.990 | 0.983 | 0.973 |
| Ex. B-6 | 0.995 | 0.989 | 0.981 |
| Ex. B-7 | 0.995 | 0.989 | 0.979 |
| Ex. B-8 | 0.990 | 0.983 | 0.974 |
| COMP. Ex. B-1 | 0.988 | 0.979 | 0.965 |

TABLE 55-continued

| | Tone R^2 | | |
|---|---|---|---|
| | 150 lpi | 200 lpi | 240 lpi |
| COMP. Ex. B-2 | 0.985 | 0.970 | 0.940 |
| COMP. Ex. B-3 | 0.988 | 0.979 | 0.966 |
| COMP. Ex. B-4 | 0.982 | 0.971 | 0.950 |
| COMP. Ex. B-5 | 0.985 | 0.978 | 0.960 |
| COMP. Ex. B-6 | 0.980 | 0.966 | 0.942 |
| COMP. Ex. B-7 | 0.988 | 0.977 | 0.960 |
| COMP. Ex. B-8 | 0.982 | 0.970 | 0.947 |
| COMP. Ex. B-9 | 0.985 | 0.969 | 0.935 |
| COMP. Ex. B-10 | 0.988 | 0.977 | 0.962 |
| COMP. Ex. B-11 | 0.985 | 0.977 | 0.958 |
| COMP. Ex. B-12 | 0.980 | 0.965 | 0.940 |

COMPARATIVE EXAMPLE B-13

An electrophotographic photoconductor was produced in the same manner as in Example B-1 except that alumina used as a filler in Example B-1 was not added to the coating liquid for the protection layer 39. Images were formed by using the produced image forming apparatus in the same manner as in Example B-1.

Running evaluation of the electrophotographic photoconductor thus produced was performed by using an image forming apparatus (manufactured by Ricoh Co., Ltd. under the trade name of MF4570). The images were evaluated in the same manner as in Example B-1. The beam diameter was set to 35 μm and the writing density was set to 1200 dpi.

In the halftoning operation, images were outputted while the number of lines was maintained at a level of 200 lpi.

A process for evaluation is as follows.

(1) Measurement of the film thickness of the photoconductor.

(2) Formation of a partial image, followed by the evaluation thereof (Measurement of the tone R^2).

(3) Measurement of a potential at a lighter portion (setting of VD=−800 V).

(4) Printing of a total of twenty thousand sheets in 1 to 2, followed by measurement of a potential at a lighter portion in the same manner as in (3).

(5) Evaluation of the images in the same manner as in (2).

(6) Image formation on eighty thousand more sheets (a total of hundred thousand sheets), followed by measurement of the film thickness of the photoconductor. Evaluation of an amount of abrasion based on the difference between the film thickness obtained and the film thickness (initial value of the film thickness) in (1).

As for image qualities other than tone, they were visually inspected by the present inventors.

The result of evaluation is shown in Table 56.

Similar evaluation was also performed in each of Example B-1 and Comparative Example B-3. The results thereof are shown in Table 56.

EXAMPLE B-9

An electrophotographic photoconductor was produced in the same manner as in Example B-1 except that the unsaturated polycarboxylic acid polymer contained in the coating liquid for the protection layer 39 in Example B-1 was changed as follows. Evaluation was performed by using the produced image forming apparatus in the same manner as in Comparative Example B-13, the result of which is shown in Table 56.

Coating Liquid: Unsaturated Polycarboxylic Acid Polymer (Acid Value 130 mgKOH/g, Manufactured by BYK-Chemie GmbH): 0.06 parts

EXAMPLE B-10

An electrophotographic photoconductor was produced in the same manner as in Example B-1 except that the unsaturated polycarboxylic acid polymer contained in the coating liquid for the protection layer 39 in Example B-1 was changed as follows. Evaluation was performed by using the produced image forming apparatus in the same manner as in Comparative Example B-13, the result of which is shown in Table 56.

Coating Liquid: Unsaturated Polycarboxylic Acid Polymer (Acid Value 365 mgKOH/g, Manufactured by BYK-Chemie GmbH): 0.03 parts

EXAMPLE B-11

An electrophotographic photoconductor was produced in the same manner as in Example B-1 except that the unsaturated polycarboxylic acid polymer contained in the coating liquid for the protection layer 39 in Example B-1 was changed as follows. Evaluation was performed by using the produced image forming apparatus in the same manner as in Comparative Example B-13, the result of which is shown in Table 56.

Coating Liquid: Acrylic Acid/Hydroxyethyl Methacrylate Copolymer (Acid Value 130 mgKOH/g): 0.10 parts

EXAMPLE B-12

An electrophotographic photoconductor was produced and evaluated in the same manner as in Example B-1 except that the filler contained in the coating liquid for the protection layer 39 in Example B-1 was changed as follows. Evaluation was performed by using the produced image forming apparatus in the same manner as in Comparative Example B-13, the result of which is shown in Table 56.

Alumina (Average Primary Particle Diameter 0.15 μm pH: 5.3): 3.0 parts

EXAMPLE B-13

An electrophotographic photoconductor was produced in the same manner as in Example B-1 except that the filler contained in the coating liquid for the protection layer 39 in Example B-1 was changed as follows. Evaluation was performed by using the produced image forming apparatus in the same manner as in Comparative Example B-13, the result of which is shown in Table 56.

Alumina (Average Primary Particle Diameter 0.45 μm pH: 5.7): 3.0 parts

EXAMPLE B-14

An electrophotographic photoconductor was produced in the same manner as in Example B-1 except that the filler contained in the coating liquid for the protection layer 39 in Example B-1 was changed as follows. Evaluation was performed by using the produced image forming apparatus in the same manner as in Comparative Example B-13, the result of which is shown in Table 56.

Alumina Treated with Titanate Coupling Agent (3% Amount of Treatment): 3.0 parts

EXAMPLE B-15

An electrophotographic photoconductor was produced in the same manner as in Example B-1 except that the charge transporting substance contained in the coating liquid for the protection layer 39 in Example B-1 was changed to the charge transporting substance (Ip: 5.3 eV) expressed by the following structural formula (B-XII). Evaluation was performed by using the produced image forming apparatus in the same manner as in Comparative Example B-13, the result of which is shown in Table 56.

[Structural formula (B-XII)]

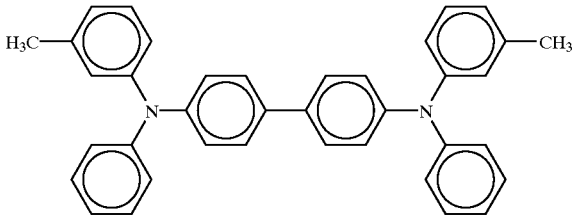

EXAMPLE B-16

An electrophotographic photoconductor was produced in the same manner as in Example B-1 except that the charge transporting substance contained in the coating liquid for the protection layer 39 in Example B-1 was changed to the charge transporting substance (Ip: 5.5 eV) expressed by the following structural formula (B-XIII). Evaluation was performed by using the produced image forming apparatus in the same manner as in Comparative Example B-13, the result of which is shown in Table 56.

[Structural formula (B-XIII)]

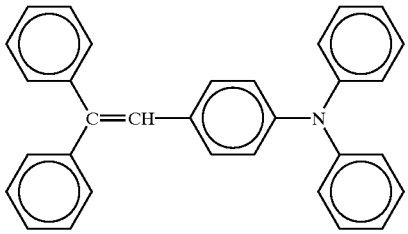

EXAMPLE B-17

An electrophotographic photoconductor was produced in the same manner as in Example B-1 except that each of the charge transporting substance and binder resin contained in the coating liquid for the protection layer 39 in Example B-1 was changed to the following material. Evaluation was performed by using the produced image forming apparatus in the same manner as in Comparative Example B-13, the result of which is shown in Table 56.

Polymer Charge transporting substance (Ip: 5.4 eV) Expressed by Following Structural formula (B-XIV): 5 parts

[Structural formula (B-XIV)]

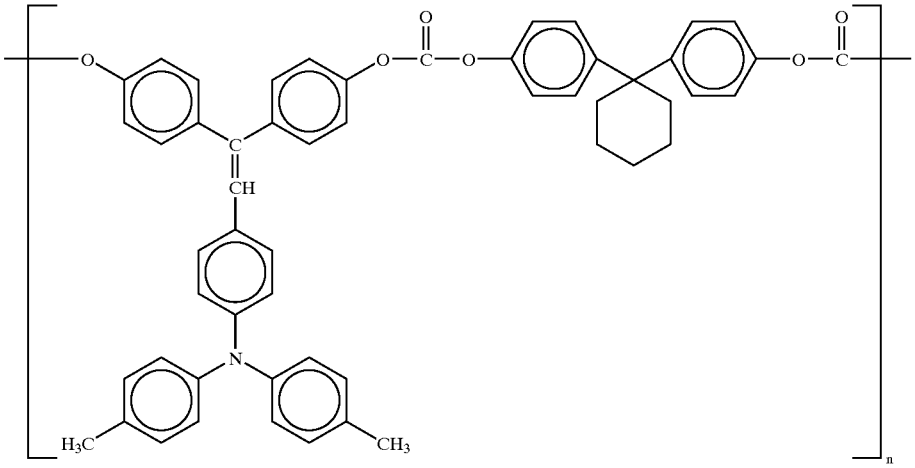

EXAMPLE B-18

An electrophotographic photoconductor was produced in the same manner as in Example B-1 except that the binder resin contained in the coating liquid for the protection layer 39 in Example B-1 was changed as follows. Evaluation was performed by using the produced image forming apparatus in the same manner as in Comparative Example B-13, the result of which is shown in Table 56.

Polyarylate Resin (U Polymer/PET, Manufactured by Unitika Ltd.): 7.0 parts

EXAMPLE B-19

An electrophotographic photoconductor was produced in the same manner as in Example B-1 except that the binder resin contained in the coating liquid for the protection layer 39 in Example B-1 was changed as follows. Evaluation was performed by using the produced image forming apparatus in the same manner as in Comparative Example B-13, the result of which is shown in Table 56.

Polycarbonate (C Polika, Manufactured by Teijin Chemicals Ltd.): 7.0 parts

TABLE 56

| | Initial Stage | | | After 20,000 run | | | |
|---|---|---|---|---|---|---|---|
| | Tone ^2 | (−V) | Image Quality | Tone ^2 | (−V) | Image Quality | Abrasion (mm) |
| Ex. A-1* | 0.984 | 140 | good | 0.982 | 160 | good | 1.40 |
| Ex. A-9 | 0.984 | 140 | good | 0.982 | 160 | good | 1.35 |
| Ex. A-10 | 0.984 | 135 | good | 0.980 | 150 | good | 1.45 |
| Ex. A-11 | 0.984 | 140 | good | 0.982 | 160 | good | 1.45 |
| Ex. A-12 | 0.984 | 140 | good | 0.981 | 160 | good | 1.40 |
| Ex. A-13 | 0.984 | 140 | good | 0.983 | 160 | good | 1.40 |
| Ex. A-14 | 0.984 | 145 | good | 0.980 | 170 | good | 1.50 |
| Ex. A-15 | 0.984 | 135 | good | 0.982 | 155 | good | 1.40 |
| Ex. A-16 | 0.984 | 145 | good | 0.982 | 165 | good | 1.35 |
| Ex. A-17 | 0.984 | 145 | good | 0.981 | 170 | good | 1.25 |
| Ex. A-18 | 0.984 | 130 | good | 0.983 | 145 | good | 1.65 |
| Ex. A-19 | 0.984 | 140 | good | 0.981 | 165 | good | 1.75 |
| Comp. Ex. A-3* | 0.970 | 180 | good | 0.960 | 260 | Decreasing Image Concentration | 1.45 |
| Comp. Ex. A-13 | 0.985 | 120 | good | N/A due to toner deposition | 120 | Toner Deposition on the background of Images Occured | 7.00 |

Results of Evaluation

From Table 2, it will be understood that, to form an image with excellent tone, a specific combination of the beam diameter, the film thickness of the charge transporting layer, and the transmittance of the protection layer should be determined. The combination (conditions for forming an image with excellent tone) is shown below.

(Preconditions) An image forming apparatus using an electrophotographic process in which the resolution of an optical write operation is 1200 dpi or more and/or an image forming apparatus using an electrophotographic process which forms an image from image data obtained by performing a half-toning operation using the number of lines of 200 lpi or more with respect to an input image.

(1) The diameter of a beam from optical writing means is 35 μm or less.

(2) A protection layer with a transmittance of 90% or more with respect to the laser beam from the optical writing means is provided.

(3) A total film thickness of the protection layer and a charge transporting layer is 20 μm or less.

It was also found that, if a photoconductor having a filler, a dispersing agent, a charge transporting substance, and/or a binder resin contained in a protection layer thereof is used, an increase in residual potential can be suppressed, image degradation such as the occurrence of a non-uniform image or reduced tone can be suppressed, and localized abrasion and abnormal abrasion can also be suppressed.

If the beam diameter is adjusted to 35 μm or less, the protection layer with a transmittance of 90% or more is provided, and a total thickness of the charge transporting layer and the protection layer is adjusted to 20 μm or less, so-called banding can be reduced.

Banding is a density variation in the main scanning direction (direction of travel of the paper) of an electrophotographic image. When an intermediate-density (Lightness L*=40 to 70) uniform image is outputted, in particular, the density varies in stripes in a relatively long cycle (in a cycle of 1 to 20 mm). If such a striped density variation occurs in an outputted image, an extremely unnatural image is obtained disadvantageously.

As factors which cause banding, mention may be made of uneven scanning with a beam (a so-called face angle error of a polygon mirror or vibration of an optical element), inconsistent rotation speed of the photoconductive drum, inconsistent rotation speed of the development sleeve, and a variation in development gap (displacement of the photoconductive drum or the development sleeve).

Although measures have been taken conventionally against these factors, they are difficult to overcome in reality since the measures taken against the factors lead to a larger-size apparatus and higher cost. This is because, to utterly eliminate the factors, it is required to solidly fabricate the entire apparatus, increase the precision of each of the components, and the like.

The present inventors conducted an experiment in which uniform images satisfying Lightness L*=50 were formed at 200 lpi and 240 lpi under the conditions of each of Examples B-1 to 8 and Comparative Examples B-1 to 12 and banding was visually inspected. The images subjected to banding evaluation described above were outputted by using the apparatus for the experiment described in Example B-. The images were visually evaluated by using the following criteria:

Rank 5: Banding is imperceptible at each of 200 lpi and 240 lpi

Rank 4: Banding is imperceptible at 200 lpi but subtly perceptible at 240 lpi.

Rank 3: Banding is subtly perceptible at 200 lpi (subtly perceptible even at 240 lpi).

Rank 2: Banding is distinctly perceptible at 200 lpi (distinctly perceptible even at 240 lpi).

Rank 1: Banding is conspicuous even at 200 lpi (conspicuous even at 200 lpi)

The present inventors found that banding was more conspicuous with a larger number of lines. This is why the aforementioned criteria focusing on an image at 200 lpi were set.

The results of evaluating banding in each of Examples B-1 to 8 and Comparative Examples B-1 to 12 are shown below. A dither texture was no more perceived if the number of lines used in a halftoning operation was 200 lpi or more. Therefore, an image judged to be on Rank 4 or higher according to the aforementioned criteria is considered to have an acceptable level of quality with regard to banding.

Example B-1: Rank 4
Example B-2: Rank 5
Example B-3: Rank 5
Example B-4: Rank 4
Example B-5: Rank 4
Example B-6: Rank 5
Example B-7: Rank 5
Example B-8: Rank 4
Comparative Example B-1: Rank 3
Comparative Example B-2: Rank 2
Comparative Example B-3: Rank 3
Comparative Example B-4: Rank 2
Comparative Example B-5: Rank 3
Comparative Example B-6: Rank 1
Comparative Example B-7: Rank 2
Comparative Example B-8: Rank 2
Comparative Example B-9: Rank 2
Comparative Example B-10: Rank 3
Comparative Example B-11: Rank 3
Comparative Example B-12: Rank 1

From the results of the experiment, it was proved that banding was reduced in the image forming apparatus satisfying the aforementioned conditions, i.e., excellent images were obtainable.

γ-linearity not only implements an image forming apparatus with excellent tone as described above. If γ-linearity is 0.98 or more, an image forming apparatus in which banding is substantially imperceptible can be implemented, as can be seen from the results of the experiment.

As is apparent from the aforementioned description, if settings are made to satisfy the conditions placed on the combination of the structure of the writing system (the resolution of a write operation, the number of lines, or the beam diameter) and the structure of the photoconductor (the light transmittance of the protection layer or the film thickness of the protection layer and the charge transporting layer), there can be provided an image forming apparatus with high durability in which the resolution of a write operation is 1200 dpi or more and an image can be formed from image data obtained by performing a halftoning operation using the number of lines of 200 lpi or more with respect to an input image without degrading image quality.

What is claimed is:

1. An image forming apparatus comprising:

a photoconductor which comprises a charge generating layer containing a charge generating substance and a charge transporting layer containing a charge transporting substance; and a charger for charging the photoconductor;

an irradiator for irradiating a laser beam having a diameter of 35 μm or less to the photoconductor for optically writing in with a resolution of 1200 dpi or more to form a latent electrostatic image;

wherein the charge transporting layer has a carrier mobility of $1\times10^{-5}$ $cm^2\cdot V^1\cdot sec^{-1}$ or more under an electric field of $3\times10^5$ $V\cdot cm^{-1}$.

2. The image forming apparatus according to claim 1, wherein the charge transporting layer contains a triarylamine structure.

3. The image forming apparatus according to claim 2, wherein the compound having the triarylamine structure is a compound expressed by the following structural formula (A-I):

[Structural formula (A-I)]

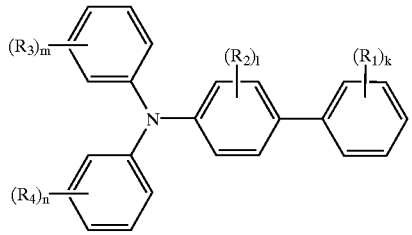

(where $R_1$, $R_3$, and $R_4$ may be the same or different and each independently represents a hydrogen atom, an amino group, an alkoxy group, a thioalkoxy group, an aryloxy group, a methylenedioxy group, a substituted or unsubstituted alkyl group, a halogen atom, or a substituted or unsubstituted aryl group; $R_2$ represents a hydrogen atom, an alkoxy group, a substituted or unsubstituted alkyl group or halogen, except for a combination in which each of $R_1$, $R_2$, $R_3$, and $R_4$ is a hydrogen atom; and k, l, m, and n are each independently 1, 2, 3, or 4).

4. The image forming apparatus according to claim 2, wherein the compound having the triarylamine structure is a compound expressed by the following structural formula (A-II):

Structural formula (A-II)

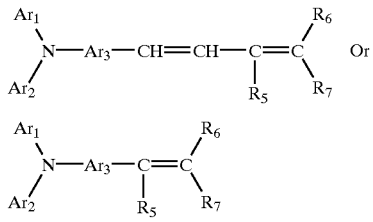

(where $Ar_1$ and $Ar_2$ may be the same or different and each independently represents a substituted or unsubstituted aryl group or a substituted or unsubstituted heterocyclic group; $R_6$, $R_7$, and $R_5$ may be the same or different and each independently represents a hydrogen atom, a substituted or unsubstituted alkyl group, a substituted or unsubstituted alkoxy group, a substituted or unsubstituted aryl group, or a substituted or unsubstituted heterocyclic group, of which $R_7$ and $R_6$ may be combined to form a ring; and $Ar_3$ represents a substituted or unsubstituted allylene group).

5. The image forming apparatus according to claim 2, wherein the compound having the triarylamine structure is a compound expressed by the following structural formula (A-III):

[Structural formula (A-III)]

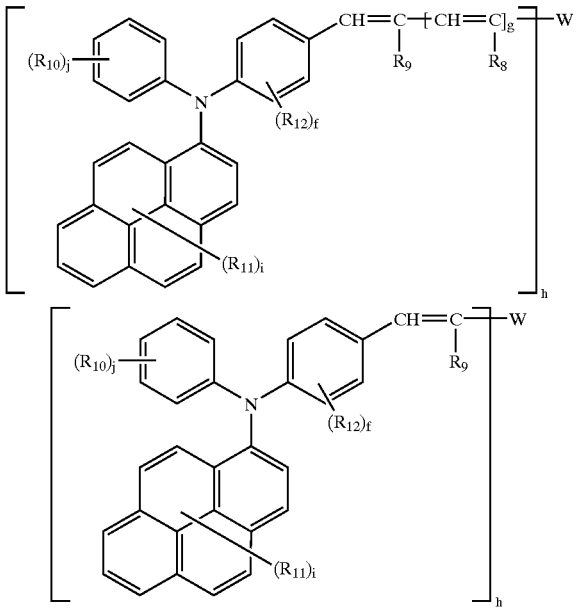

(where $R_{10}$, $R_{11}$, and $R_{12}$ may be the same or different and each independently represents a hydrogen atom, a halogen atom, a nitro group, a substituted or unsubstituted alkyl group, a substituted or unsubstituted alkoxy group, or a substituted or unsubstituted aryl group; $R_8$ and $R_9$ may be the same or different and each independently represents a hydrogen atom, an alkoxycarbonyl group, a substituted or unsubstituted alkyl group, or a substituted or unsubstituted aryl group; W represents a hydrogen atom, a substituted or unsubstituted alkyl group, a phenylthio group, a divalent chain unsaturated hydrocarbon group, a monovalent or divalent and substituted or unsubstituted carbocyclic aromatic group, or a monovalent or divalent and substituted or unsubstituted heterocyclic group; j represents an integer of 1 to 5; f represents an integer of 1 to 4; g represents an integer of 1 or 2; h represents an integer of 1 or 2; and i represents an integer of 1 to 3).

6. The image forming apparatus according to claim 2, wherein the compound having the triarylamine structure is a compound expressed by the following structural formula (A-IV):

[Structural formula (A-IV)]

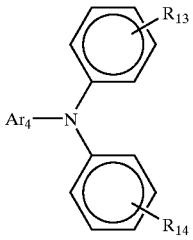

(where $Ar_4$ represents a condensed polycyclic hydrocarbon group having 18 or less carbon atoms; and $R_{13}$ and $R_{14}$ may be the same or different and each independently represents a hydrogen atom, a halogen atom, a substituted or unsubstituted alkyl group, an alkoxy group, or a substituted or unsubstituted phenyl group).

7. The image forming apparatus according to claim 2, wherein the compound having the triarylamine structure is a compound expressed by the following structural formula (A-V):

[Structural Formula (A-V)]

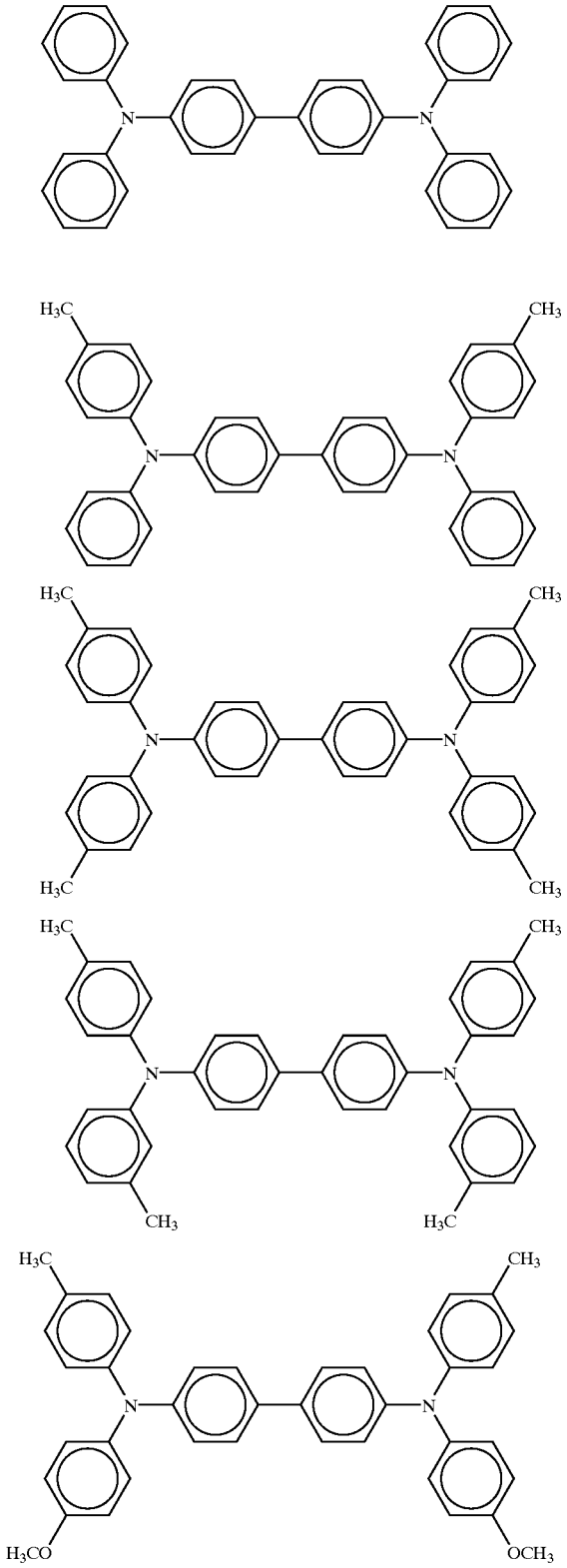

-continued

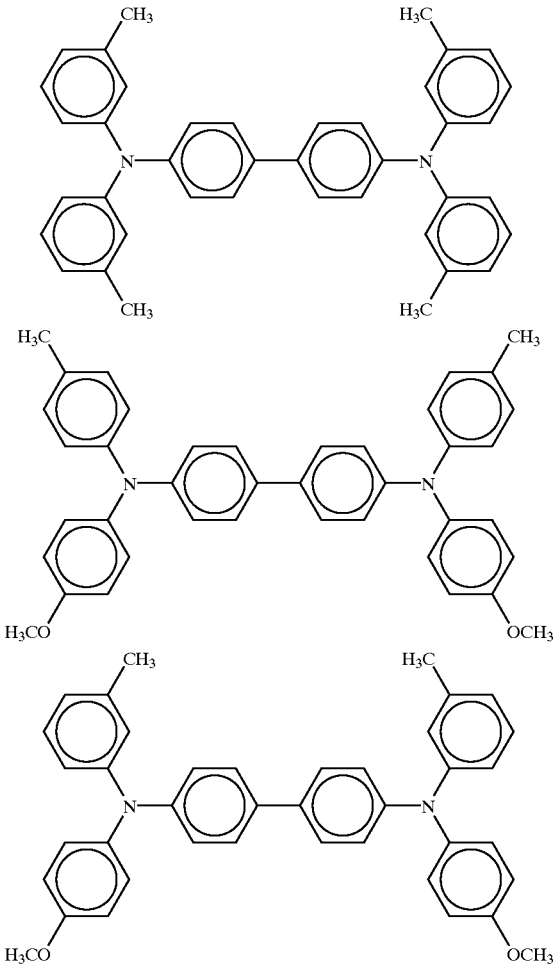

(where $R_{15}$ and $R_{16}$ may be the same or different and each independently represents a lower alkyl group, a lower alkoxy group, or a halogen atom; p and q each independently represents an integer of 1 to 4; and $R_1$ and $R_{18}$ may be the same or different and each independently represents a hydrogen atom, a lower alkyl group, a lower alkoxy group, or a halogen atom).

8. The image forming apparatus according to claim 2, wherein the compound having the triarylamine structure is a compound expressed by the following structural formula (A-VI):

[Structural formula (A-VI)]

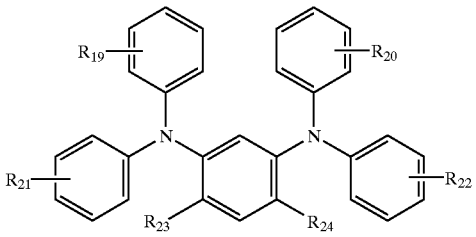

(where $R_{19}$, $R_{20}$, $R_{21}$, and $R_{22}$ may be the same or different and each independently represents a hydrogen atom, an alkyl group which may have a substituent, an alkoxy group, an allyl group, an aryl group, or a halogen atom; and $R_{23}$ and $R_{24}$ may be the same or different and each independently represents a hydrogen atom, an alkyl group, an alkoxy group, a halogen atom, an amino group, an N-substituted amino group, an allyl group, or an aryl group).

9. The image forming apparatus according to claim 1, wherein a content of the charge transporting substance in the charge transporting layer is 40% by weight or more with respect to a total amount of the charge transporting layer.

10. The image forming apparatus according to claim 1, wherein a film thickness of the charge transporting layer is 20 $\mu$m or less.

11. The image forming apparatus according to claim 1, wherein the photoconductor has a protection layer.

12. The image forming apparatus according to claim 11, wherein a transmittance of the protection layer with respect to the laser beam is 90% or more and a total film thickness of the charge transporting layer and the protection layer is 20 $\mu$m or less.

13. An image forming apparatus comprising:

a photoconductor which comprises a charge generating layer containing a charge generating substance and a charge transporting layer containing a charge transporting substance;

a charger for charging the photoconductor;

an image processor for performing a halftoning operation with respect to an input image; and an irradiator for irradiating a laser beam having a diameter of 35 $\mu$m or less to the photoconductor for optically writing in to form a latent electrostatic image based on an image data obtained by the halftoning operation using a number of lines of 200 lpi or more with respect to the input image;

wherein the charge transporting layer has a carrier mobility of $1\times10^{-5}$ $cm^2\cdot V^{-1}\cdot sec^{-1}$ or more under an electric field of $3\times10^5 V\cdot cm^{-1}$, and the optical writing is based on.

14. The image forming apparatus according to claim 13, wherein a resolution of the optical writing is 1200 dpi or more.

15. The image forming apparatus according to claim 13, wherein the charge transporting layer contains a triarylamine structure.

16. The image forming apparatus according to claim 15, wherein the compound having the triarylamine structure is a compound expressed by the following structural formula (A-I):

[Structural formula (A-I)]

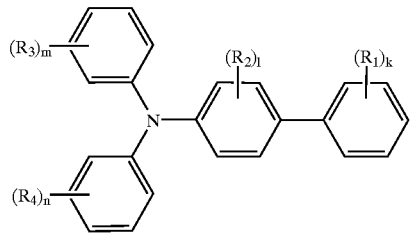

(where $R_1$, $R_3$, and $R_4$ may be the same or different and each independently represents a hydrogen atom, an amino group, an alkoxy group, a thioalkoxy group, an aryloxy group, a methylenedioxy group, a substituted or unsubstituted alkyl group, a halogen atom, or a substituted or unsubstituted aryl group; $R_2$ represents a hydrogen atom, an alkoxy group, a substituted or unsubstituted alkyl group or halogen, except for a combination in which each of $R_1$, $R_2$, $R_3$, and $R_4$ is a hydrogen atom; and k, l, m, and n are each independently 1, 2, 3, or 4).

17. The image forming apparatus according to claim 15, wherein the compound having the triarylamine structure is a compound expressed by the following structural formula (A-II):

[Structural formula (A-II)]

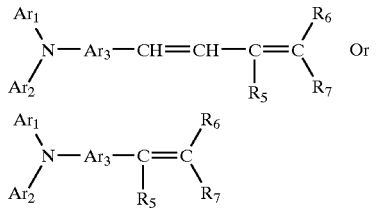

(where $Ar_1$ and $Ar_2$ may be the same or different and each independently represents a substituted or unsubstituted aryl group or a substituted or unsubstituted heterocyclic group; $R_6$, $R_7$, and $R_5$ may be the same or different and each independently represents a hydrogen atom, a substituted or unsubstituted alkyl group, a substituted or unsubstituted alkoxy group, a substituted or unsubstituted aryl group, or a substituted or unsubstituted heterocyclic group, of which $R_7$ and $R_6$ may be combined to form a ring; and $Ar_3$ represents a substituted or unsubstituted allylene group).

18. The image forming apparatus according to claim 15, wherein the compound having the triarylamine structure is a compound expressed by the following structural formula (A-III):

[Structural formula (A-III)]

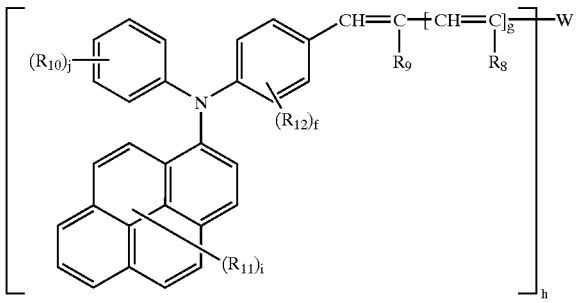

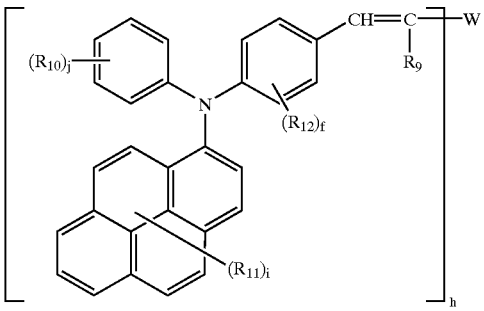

(where $R_{10}$, $R_{11}$, and $R_{12}$ may be the same or different and each independently represents a hydrogen atom, a halogen atom, a nitro group, a substituted or unsubstituted alkyl group, a substituted or unsubstituted alkoxy group, or a substituted or unsubstituted aryl group; $R_8$ and $R_9$ may be the same or different and each independently represents a hydrogen atom, an alkoxycarbonyl group, a substituted or unsubstituted alkyl group, or a substituted or unsubstituted aryl group; W represents a hydrogen atom, a substituted or unsubstituted alkyl group, a phenylthio group, a divalent chain unsaturated hydrocarbon group, a monovalent or divalent and substituted or unsubstituted carbocyclic aromatic group, or a monovalent or divalent and substituted or unsubstituted heterocyclic group; j represents an integer of 1 to 5; f represents an integer of 1 to 4; g represents an integer of 1 or 2; h represents an integer of 1 or 2; and i represents an integer of 1 to 3).

19. The image forming apparatus according to claim 15, wherein the compound having the triarylamine structure is a compound expressed by the following structural formula (A-IV):

[Structural formula (A-IV)]

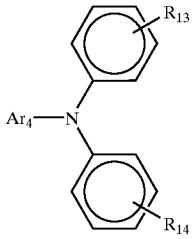

(where $Ar_4$ represents a condensed polycyclic hydrocarbon group having 18 or less carbon atoms; and $R_{13}$ and $R_{14}$ may be the same or different and each independently represents a hydrogen atom, a halogen atom, a substituted or unsubstituted alkyl group, an alkoxy group, or a substituted or unsubstituted phenyl group).

20. The image forming apparatus according to claim 15, wherein the compound having the triarylamine structure is a compound expressed by the following structural formula (A-V):

[Structural Formula (A-V)]

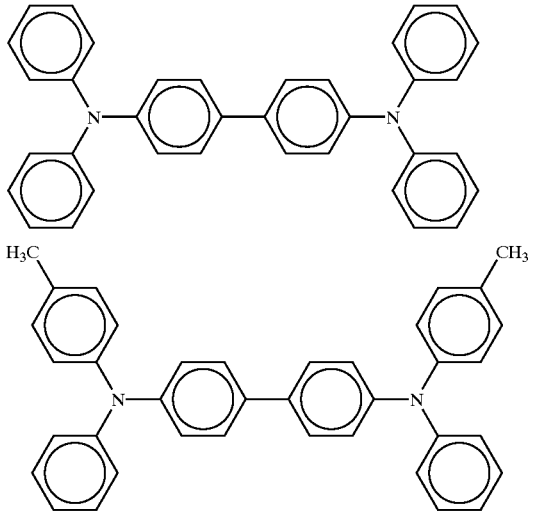

-continued

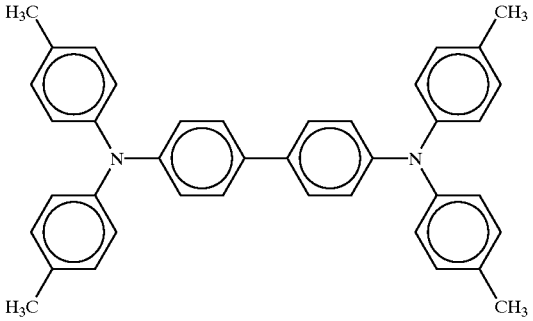

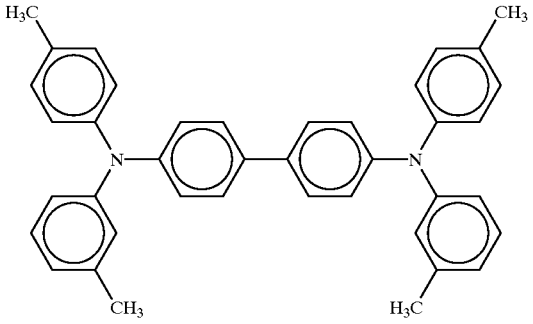

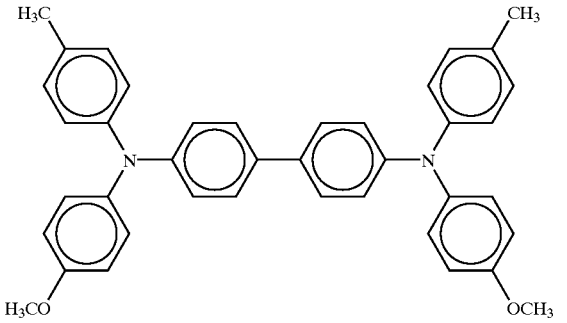

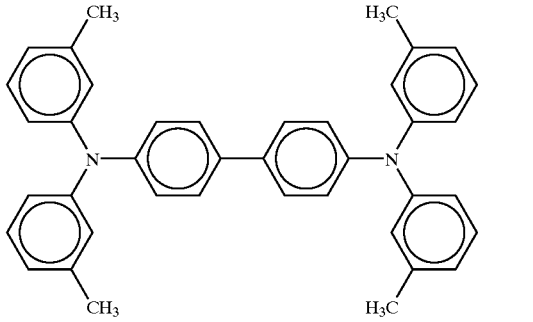

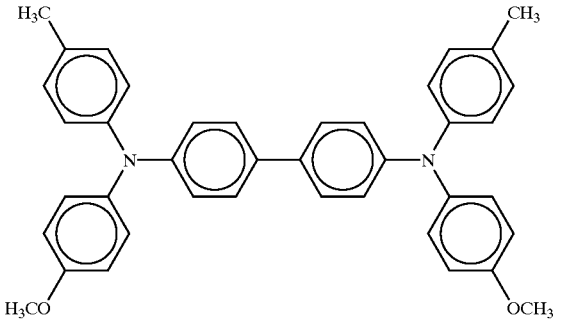

-continued

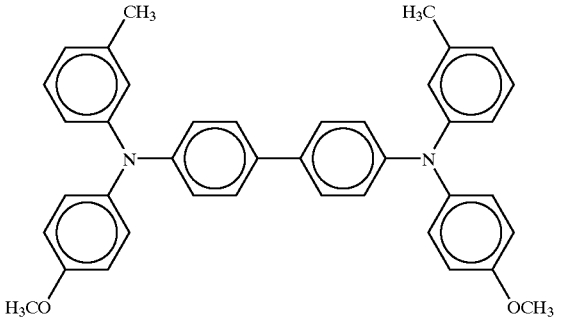

(where $R_{15}$ and $R_{16}$ may be the same or different and each independently represents a lower alkyl group, a lower alkoxy group, or a halogen atom; p and q each independently represents an integer of 1 to 4; and $R_{17}$ and $R_{18}$ may be the same or different and each independently represents a hydrogen atom, a lower alkyl group, a lower alkoxy group, or a halogen atom).

21. The image forming apparatus according to claim 15, wherein the compound having the triarylamine structure is a compound expressed by the following structural formula (A-VI):

[Structural formula (A-VI)]

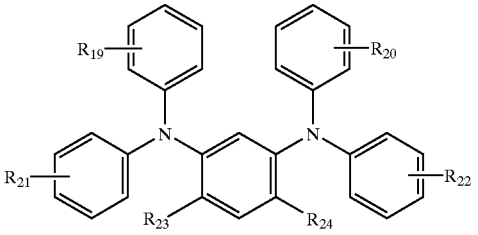

(where $R_{19}$, $R_{20}$, $R_{21}$, and $R_{22}$ may be the same or different and each independently represents a hydrogen atom, an alkyl group which may have a substituent, an alkoxy group, an allyl group, an aryl group, or a halogen atom; and $R_{23}$ and $R_{24}$ may be the same or different and each independently represents a hydrogen atom, an alkyl group, an alkoxy group, a halogen atom, an amino group, an N-substituted amino group, an allyl group, or an aryl group).

22. The image forming apparatus according to claim 13, wherein a content of the charge transporting substance in the charge transporting layer is 40% by weight or more with respect to a total amount of the charge transporting layer.

23. The image forming apparatus according to claim 13, wherein a film thickness of the charge transporting layer is 20 $\mu$m or less.

24. The image forming apparatus according to claim 13, wherein the photoconductor comprises a protection layer.

25. The image forming apparatus according to claim 24, wherein a transmittance of the protection layer with respect to the laser beam is 90% or more and a total film thickness of the charge transporting layer and the protection layer is 20 $\mu$m or less.

26. An image forming apparatus comprising:

a photoconductor which comprises: a charge generating layer containing a charge generating substance; a charge transporting layer containing a charge transporting substance; and a protection layer disposed closer to a surface of the photoconductor than the charge generating layer and the charge transporting layer and having a transmittance of 90% or more with respect to the laser beam; the charge transporting layer and the protection layer has a total thickness of 20 μm or less;

a charger for charging the photoconductor; and an irradiator for irradiating a laser beam having a diameter of 35 μm or less to the photoconductor for optically writing in with a resolution of 1200 dpi or more to form a latent electrostatic image.

27. The image forming apparatus according to claim 26, wherein the protection layer contains at least one of a filler, a charge transporting substance, and a binder resin.

28. The image forming apparatus according to claim 27, wherein the filler has a refractive index in a range of 1.0 to 2.0.

29. The image forming apparatus according to claim 28, wherein the filler is at least one of an inorganic pigment and a metal oxide.

30. The image forming apparatus according to claim 26, wherein the protection layer is formed from a water dispersion containing at least one of an inorganic pigment and a metal oxide dispersed therein, and a pH of the water dispersion is 5 or more.

31. The image forming apparatus according to claim 26, wherein the protection layer contains at least one of an inorganic pigment and a metal oxide, processed with a surface treatment using at least one surface treatment agent.

32. The image forming apparatus according to claim 26, wherein, the protection layer contains a dispersing agent and the dispersing agent is an organic compound having at least one carboxyl group in a structure thereof.

33. The image forming apparatus according to claim 32, wherein the dispersing agent is a polycarboxylic acid derivative.

34. The image forming apparatus according to claim 32, wherein the dispersing agent is an organic compound having an acid value of 10 to 400 (mgKOH/g).

35. The image forming apparatus according to claim 32, wherein the dispersing agent is added in an amount selected from a range satisfying the following expression:

$$0.1 \leqq (\text{Amount of Added Dispersing Agent} \times \text{Acid Value of Dispersing Agent})/(\text{Amount of Added Filler}) \leqq 20.$$

36. The image forming apparatus according to claim 26, wherein a maximum intensity of an electric field applied by the charging means to the charge transporting layer and to the protection layer is −30 V/μm.

37. An image forming apparatus comprising:

a photoconductor which comprises: a charge generating layer containing a charge generating substance; a charge transporting layer containing a charge transporting substance; and a protection layer disposed closer to a surface of the photoconductor than the charge generating layer and the charge transporting layer and having a transmittance of 90% or more with respect to the laser beam; the charge transporting layer and the protection layer has a total thickness of 20 μm or less;

a charger for charging the photoconductor;

an irradiator for irradiating a laser beam having a diameter of 35 μm or less to the photoconductor for optically writing in to form a latent electrostatic image based on an image data obtained by the halftoning operation using a number of lines of 200 lpi or more with respect to an input image; and an image processor for performing a halftoning operation with respect to the input image.

38. The image forming apparatus according to claim 37, wherein a resolution of the optical write operation performed by the optical writing means is 1200 dpi or more.

39. The image forming apparatus according to claim 37, wherein the protection layer contains a filler, a charge transporting substance, and/or a binder resin.

40. The image forming apparatus according to claim 39, wherein the filler has a refractive index in a range of 1.0 to 2.0.

41. The image forming apparatus according to claim 40, wherein the filler is at least one of an inorganic pigment and a metal oxide.

42. The image forming apparatus according to claim 37, wherein the protection layer is formed from a water dispersion containing an inorganic pigment and/or a metal oxide dispersed therein and a pH of the water dispersion is 5 or more.

43. The image forming apparatus according to claim 37, wherein the protection layer contains an inorganic pigment and/or a metal oxide processed with a surface treatment using at least one surface treatment agent.

44. The image forming apparatus according to claim 37, wherein, the protection layer contains a dispersing agent and the dispersing agent is an organic compound having at least one carboxyl group in a structure thereof.

45. The image forming apparatus according to claim 44, wherein the dispersing agent is a polycarboxylic acid derivative.

46. The image forming apparatus according to claim 44, wherein the dispersing agent is an organic compound having an acid value of 10 to 400 (mgKOH/g).

47. The image forming apparatus according to claim 44, wherein the dispersing agent is added in an amount selected from a range satisfying the following expression:

$$0.1 \leqq (\text{Amount of Added Dispersing Agent} \times \text{Acid Value of Dispersing Agent})/(\text{Amount of Added Filler}) \leqq 20.$$

48. The image forming apparatus according to claim 37, wherein a maximum intensity of an electric field applied by the charging means to the charge transporting layer and to the protection layer is −30 V/μm.

* * * * *